US011495082B2

(12) United States Patent
Lamb

(10) Patent No.: US 11,495,082 B2
(45) Date of Patent: Nov. 8, 2022

(54) ELECTRONIC GAMING DEVICE WITH A MULTI-AXIS MOVABLE 3-DIMENSIONAL DISPLAY

(71) Applicant: Aristocrat Technologies, Inc. (ATI), Las Vegas, NV (US)

(72) Inventor: William Lamb, Eagleville, TN (US)

(73) Assignee: Aristocrat Technologies, Inc. (ATI), Las Vegas, NV (US)

( * ) Notice: Subject to any disclaimer, the term of this patent is extended or adjusted under 35 U.S.C. 154(b) by 63 days.

(21) Appl. No.: 17/191,502

(22) Filed: Mar. 3, 2021

(65) Prior Publication Data

US 2021/0319648 A1 Oct. 14, 2021

Related U.S. Application Data

(60) Provisional application No. 63/008,567, filed on Apr. 10, 2020.

(51) Int. Cl.

| | |
|---|---|
| ***A63F 9/24*** | (2006.01) |
| ***A63F 11/00*** | (2006.01) |
| ***G06F 13/00*** | (2006.01) |
| ***G06F 17/00*** | (2019.01) |
| ***G07F 17/32*** | (2006.01) |

(52) U.S. Cl.
CPC ..... *G07F 17/3211* (2013.01)

(58) Field of Classification Search
CPC ..... G07F 17/32; G07F 17/3211
USPC ..... 463/1, 20, 22, 25, 30, 31
See application file for complete search history.

(56) References Cited

U.S. PATENT DOCUMENTS

| | | | |
|---|---|---|---|
| 5,462,277 | A | 10/1995 | Takemoto |
| 6,663,488 | B1 | 12/2003 | Adams |
| D503,951 | S | 4/2005 | Karstens |
| D512,464 | S | 12/2005 | Karstens |
| D523,093 | S | 6/2006 | Kaminkow |
| D524,380 | S | 7/2006 | Seelig |
| D558,835 | S | 1/2008 | Zielinski |

(Continued)

FOREIGN PATENT DOCUMENTS

| | | |
|---|---|---|
| AT | 0001545130003 S | 6/2004 |
| EM | 0001545130005 | 3/2004 |
| EM | 0001545210004 | 3/2004 |

OTHER PUBLICATIONS

Gumball Machine, first available Oct. 17, 2006, amazon.com [online], [site visited Sep. 22, 2021], Available from internet URL:https://amzn.to/3AATWEj (Year: 2006).

(Continued)

*Primary Examiner* — Adetokunbo O Torimiro
(74) *Attorney, Agent, or Firm* — McAndrews, Held & Malloy, Ltd.

(57) ABSTRACT

An electronic gaming device comprising a first display device operable to present a game, an activation structure, a three-dimensional second display device positioned relative to the first display device and the activation structure, and a game controller having at least one processor and a memory storing a set of symbols and at least a sequence of instructions. When the instructions are executed, the game controller causes the at least one processor to at least levitate the three-dimensional second display device relative to the first display device and the activation structure, move the three-dimensional second display device in relation to at least one of a plurality of axes, and display game information on the three-dimensional second display.

20 Claims, 49 Drawing Sheets

(56) References Cited

U.S. PATENT DOCUMENTS

| | | | |
|---|---|---|---|
| D590,025 | S | 4/2009 | Fiore |
| D591,360 | S | 4/2009 | Fiore |
| 7,559,840 | B1 | 7/2009 | D Avanzo |
| 7,918,725 | B2 | 4/2011 | Baerlocher |
| D665,853 | S | 8/2012 | Desimone |
| D681,129 | S | 4/2013 | Desimone |
| 9,524,615 | B2 | 12/2016 | Daeges |
| 9,940,795 | B2 | 4/2018 | Van Linden |
| D843,469 | S | 3/2019 | Nettenstrom |
| D847,906 | S | 5/2019 | Colvin |
| D875,838 | S | 2/2020 | Urban |
| D884,080 | S | 5/2020 | Gibson |
| D895,021 | S | 9/2020 | Tang |
| 10,810,824 | B2 | 10/2020 | Danielson |
| D905,791 | S | 12/2020 | French |
| D914,807 | S | 3/2021 | Olive |
| 2019/0096156 | A1 | 3/2019 | Kato |

OTHER PUBLICATIONS

Giant LED Gumball Machine, first available 2020, sharperimage.com [online], [site visited Sep. 22, 2021], Available from internet URL:https://bit.ly/3u4K3w9 (Year: 2020).

Black Obsidian Crystal Ball, first available Jan. 1, 2018, amazon.com [online], [site visited Sep. 22, 2021], Available from internetURL: https://amzn.to/3kyjyMh (Year: 2018).

Phocus S104 hybrid cabinet, first available Sep. 29, 2020, gamingarts.com [online], [site visited Jan. 12, 2022], Available from internet URL: https://bit.ly/3HZNaev (Year: 2020).

Office Action dated Jan. 25, 2022 for U.S. Appl. No. 29/727,552 (pp. 1-9).

ELECTRONIC GAMING DEVICE WITH A MULTI-AXIS MOVABLE 3-DIMENSIONAL DISPLAY

RELATED APPLICATIONS

The present application claims priority to U.S. Provisional Patent Application No. 63/008,567, filed Apr. 10, 2020, and entitled "Electronic Gaming Device with a Multi-Axis Movable 3-Dimensional Display" and is related to U.S. Design Pat. No. 29/727,552 filed on Mar. 11, 2020, entitled "Gaming Machine," both of which are hereby incorporated by reference herein in their entireties.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In some cases, a player may qualify for a special mode of the base game, a secondary game, or a bonus round of the base game by attaining a certain winning combination or triggering event in, or related to, the base game, or after the player is randomly awarded the special mode, secondary game, or bonus round. In the special mode, secondary game, or bonus round, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

In existing gaming systems, feature games, secondary or bonus games, may be triggered for players in addition to the base game. A feature game gives players an additional opportunity to win prizes, or the opportunity to win larger prizes, than would otherwise be available in the base game. Feature games can also offer altered game play to enhance player enjoyment.

The popularity of such gaming machines with players is heavily dependent on the entertainment value of the machine relative to other gaming options and the player's gambling experience. Operators of gaming businesses therefore strive to provide the most entertaining, engaging, and exciting machines to attract customers to use the machines while also providing a machine that allows the player to enjoy their gambling experience. Accordingly, there is a continuing need for gaming machine manufacturers to develop new games in order to maintain or increase player enjoyment.

Gaming machine designers typically are constrained by fixed, or relatively fixed, displays, orientation, and/or geometry of the displays. In particular, the numbers, orientation and/or geometry of displays may present specific limitations on how a spinning wheel can be presented on a topper display, such as, for example, wheel sizes, number of wheels, number of symbols on the wheel, wheel orientation (s), wheel resolutions, viewing angles, and wheel rotational directions.

A typical planar wheel on a secondary display, a topper display, or a communal display has a limited number of positions, slices, and/or awards. For example, due to stepper motor limitations, a spinning wheel may only have 11 or 22 possible outcomes. The limited number of positions, slices, and/or awards constraints the gaming machine to provide only limited ordinary jackpots with ordinary awards, making it difficult for gaming machine designers to offer harder jackpots with higher awards while simultaneously offering the traditional jackpots.

SUMMARY

Embodiments of the present disclosure represent a technical improvement in the art of electronic gaming machines, systems, and operating for such electronic gaming machines or systems. For example, at least some embodiments of the present disclosure provide an electronic gaming device that includes a credit input device, a first display device operable to present a game, a second display device, and a game controller. The second display device comprising a three-dimensional display device that is removably disposed on a base. The second display device also has a plurality of symbols displayed thereon, and is operable to move in relation to one or more of a plurality of axes. The game controller also includes a memory that stores instructions. When the instructions are executed, the game controller at least controls the second display device to levitate away from the base, controls the second display device to move in relation to the one or more of the plurality of axes, and displays a portion of the plurality of symbols selected based on one or more random numbers generated by a random number generator in a plurality of symbol positions on the second display device.

Embodiments of the present disclosure represent another technical improvement in the art of electronic gaming machines, systems, and operating for such electronic gaming machines or systems. For example, at least some embodiments of the present disclosure also provide an electronic gaming device that includes a credit input device, a first display device operable to present a game, a second display device, and a game controller. The second display device comprising a three-dimensional display device that includes a display strip thereon. The second display device is also operable to move the strip and in relation to a plurality of axes. The game controller also includes a memory that stores instructions. When the instructions are executed, the game controller at least controls the second device to rotate in relation to at least one of the plurality of axes, and rotates the display strip to reveal one of a plurality of prizes selected, based on one or more random numbers generated by a random number generator, in relation to at least one of the plurality of axes.

One aspect of the embodiment provides a sphere that may be spun to land in between symbols or with symbols oriented differently, for example, right side up, upside down, and/or sideways. In such cases, a symbol may be a loser when the symbol lands upside down. However, if the sphere is reactivated, the symbol may land right side up for a win.

Another aspect of the embodiment provides a sphere that may be spun in a plurality of directions, for example, horizontally, vertically, diagonally, omni-directionally or even randomly. Multi-directional and multi-axis movement, e.g., horizontal spinning, vertical spinning or tilting, may allow for a multitude of outcomes depending on, for example, the size of and/or the number of symbols displayed or presented on the sphere. For example, a player may choose the number of symbols to be evaluated from those displayed on the sphere based on wagers that the player makes. Thus, higher wagers result in more symbols that may be evaluated. For another example, a player may also choose where the symbols on the sphere are to be evaluated. In one example, two players on a multi-player station that consists of a plurality of gaming machines sharing the same sphere may choose the same area of symbols to be evaluated for a win for the players, respectively.

Still another aspect of the embodiment provides a sphere that is elevated or suspended in the air. In such a case, the sphere may have a wide-variety of size of and/or the number of symbols displayed or presented on the sphere. Alternatively and/or concurrently, the player may be allowed to select the size of and/or the number of symbols displayed or presented on the sphere. Furthermore, a game may be controlled to change or adjust the size of and/or the number of symbols displayed or presented on the sphere based on results of previous plays. Still furthermore, the sphere may initially sit on a platform and be elevated when an elevation event or a trigger event is detected. In some cases, the sphere may be projected from a display. In other cases, the sphere may be suspended magnetically. In still other cases, the sphere may be a lightweight spherical structure suspended via precise jet air controls. Alternatively, the sphere may be a projected holographic sphere, 2-dimensional or 3-dimensional. In one example, a projector at a multi-player station that consists of a plurality of gaming machines sharing the same 3-dimensional sphere may be configured to project the holographic sphere to spin in a plurality of directions and in relation to any number of axes. In another example, a projector may project a 2-dimensional sphere for an individual gaming machine. In yet another example, a projector within the sphere may project symbols or game information on an inner surface of a spherical display device so as to be viewable on the outer surface by the player.

Further aspect of the embodiment provides a communal sphere that is transparent or clear with visible symbols displayed or projected thereon. In such a case, players may be able to see most, if not all, of the possible outcomes at any given time. In some cases, the sphere may be moved via rotational movements exhibited by stepper, brushless and/or induction motors such as Tesla electric motors, via one or more tracks or channels. In some cases, the communal sphere may be located in the center of a multi-player station for a communal game in which the players may be able to see each other through the transparent sphere, and what lands on the other side of the transparent sphere. A transparent or clear communal sphere with visible symbols may be advantageous because the players around the multi-player station may visually connect with each other, and improve social and game interactions.

Another further aspect of the embodiment provides a communal sphere that is transparent or clear translucent or transparent without symbols. In such a case, the clear communal sphere embeds a number of dice. When the communal sphere is spun, for example, horizontally, vertically, diagonally, omni-directionally or even randomly, the dice are rolled around within the communal sphere to show their face values, respectively. In some alternate embodiments, the communal sphere is fixed in place with the dice embedded therein, and a die-rolling actuator, such as a track ball, may be initiated to roll the embedded dice. In some cases, the gaming machine may include a plurality of die-rolling actuators for rolling the plurality of dice, respectively. In other cases, only the gaming machine among the multi-player station that triggers a feature game may be enabled to roll the dice.

Further aspect of the embodiment provides a holographic communal sphere that is transparent or clear translucent or transparent without symbols. In some cases, the communal sphere may be projected from a display. The communal sphere may also be projected to embed a plurality of dice. When the display animates a movement, like spinning or rotating, of the communal sphere, the dice may be animated as being rolled around until the communal sphere is displayed as coming to a stop. When the rolling dice also come to a stop, the dice show their face values, respectively.

Still another aspect of the embodiment provides a communal cube that is transparent or clear translucent or transparent without symbols. The communal cube further includes a spinnable sphere which further embeds a plurality of dice. The dice may be magnetically bounced when the dice are actuated.

Yet another aspect of the embodiment provides a plurality of spinning spheres forming an outcome. Each of the spinning spheres displays a plurality of symbols being able to rotate or spin in a plurality of directions, for example, horizontally, vertically, diagonally, omni-directional or even randomly. When the spheres stop spinning, the outcome may be shown at one or more gaming devices. The sphere is levitated and controlled by pulsating electrical coils within a housing, enabling the spheres to rotate in any direction and present the symbol patterns to a player.

Still another aspect of the embodiment provides a spinning sphere having a plurality of magnets attached to the inside surface would sit inside a housing containing electrical coils. The coils may be energized and pulsated to spin the sphere containing a plurality of symbols in any direction in a controlled fashion. The electrical coils may be mounted in an aluminum die cast housing with two halves of the spinning sphere bolted together. In a case where the spinning sphere is a plastic sphere, two halves of the plastic sphere may have magnets attached inside in a set orientation with the two halves glued or pressed together to form the assembly and the symbols graphically attached or electronically projected. The spinning sphere may also be levitated within the housing and may be operated via brushless motors. The spinning sphere may provide a new mechanical reel game and/or topper bonus feature, which in turn, may enhance player interactions and gaming mechanic experiences. The spinning sphere may also allow for new mathematical models, providing game development opportunities, attract mode spinning effects, and/or synchronization capability with visual, audio, and/or four-dimensional events.

Another aspect of the embodiment provides a sphere that includes a plurality of layers and/or slices of displayed or presented symbols. For example, the layers may be spun horizontally and the slices may be spun vertically, either consecutively or concurrently.

Another aspect of the embodiment provides for a plurality of concentric spheres, for example, having an inner sphere within an outer sphere where at least one of the plurality of concentric spheres includes a plurality of layers and/or slices of displayed or presented symbols. In one embodiment, the inner sphere and the outer sphere may be spun horizontally and the slices may be spun vertically, either consecutively or concurrently. In another embodiment, layers and/or slices of displayed or presented symbols of the inner sphere may align with layers and/or slices of displayed or presented symbols of the outer sphere. For example, the outer sphere may provide a bonus multiplier to the inner sphere. In some embodiments, the outer sphere may be a translucent sphere having a plurality of bonus symbols. When aligned, some or all of the plurality of bonus symbols landing on symbols on in the inner sphere provide an increased payout.

BRIEF DESCRIPTION OF THE DRAWINGS

Features and advantages of certain embodiments of the present disclosure will become apparent from the following description of embodiments thereof, by way of example only, with reference to the accompanying drawings, in which.

Figure 1:
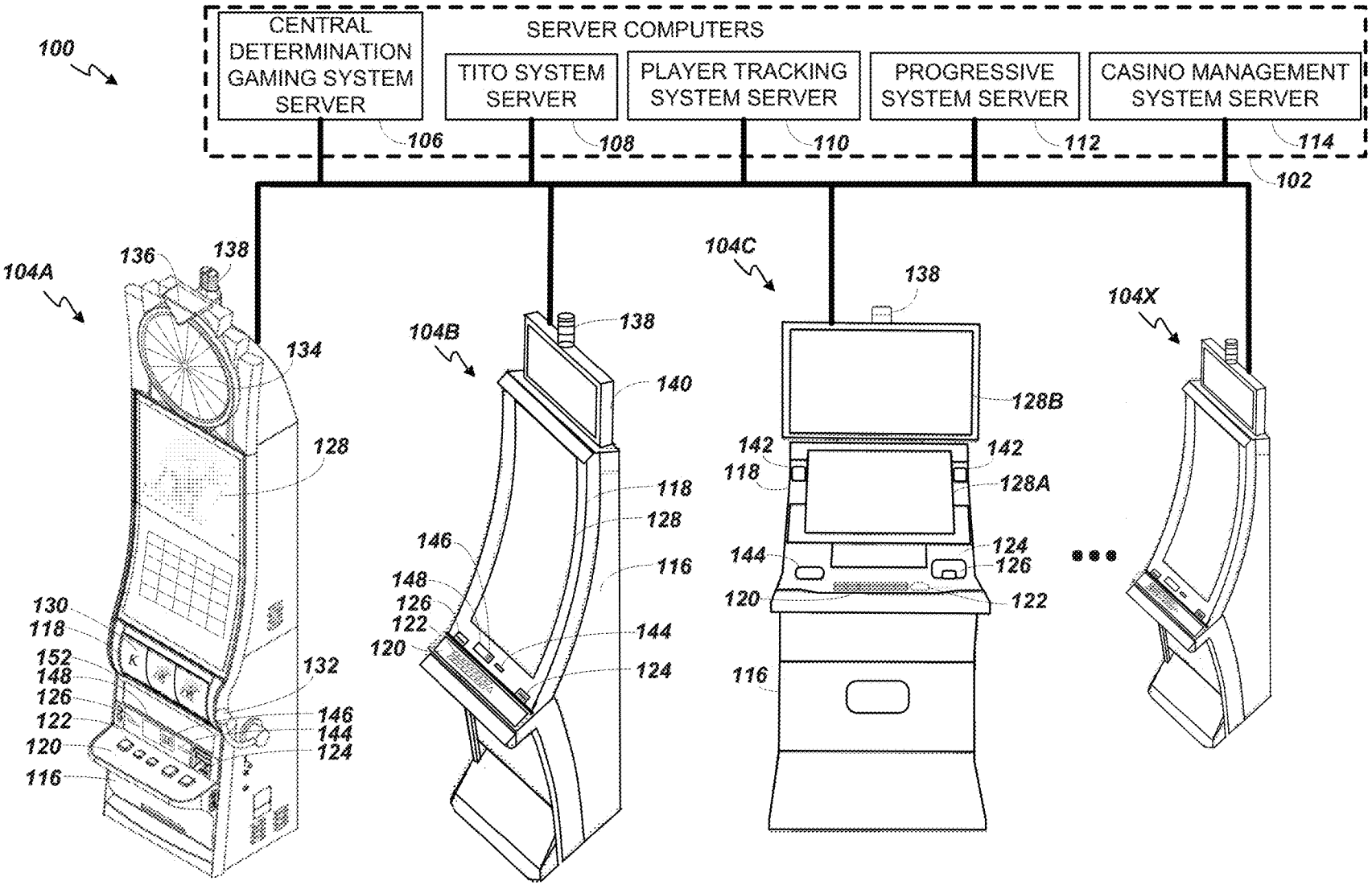
FIG. 1 is an exemplary diagram showing several EGMs networked with various gaming related servers.

The foregoing summary, as well as the following detailed description of certain embodiments of the present disclosure, will be better understood when read in conjunction with the appended drawings. For the purpose of illustrating the disclosure, certain embodiments are shown in the drawings. It should be understood, however, that the present disclosure is not limited to the arrangements and instrumentality shown in the attached drawings.

DETAILED DESCRIPTION

Systems, devices, machines, and methods for an interactive electronic gaming machine that include a 3-dimensional display which may be moveable in relation to multiple axes, e.g., tiltable and/or rotatable. In some embodiments, the 3-dimensional display may comprise a 3-dimensional spherical display, which may also be levitatable or suspendable in relation to a game machine housing.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi®) and Bluetooth®), cable TV, satellite links and the like.

In some implementation, server computers 102 may not be necessary and/or preferred. For example, in one or more implementations, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The mechanical reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution liquid crystal display (LCD), plasma, light emitting diode (LED), or organic light emitting diode (OLED) panel which may be flat or curved as shown, a cathode ray tube, or other conventional electronically controlled video monitor.

In some implementations, the bill validator 124 may also function as a "ticket-in" reader that allows the player to use a casino issued credit ticket to load credits onto the gaming device 104A (e.g., in a cashless ticket ("TITO") system). In such cashless implementations, the gaming device 104A may also include a "ticket-out" printer 126 for outputting a credit ticket when a "cash out" button is pressed. Cashless TITO systems are used to generate and track unique barcodes or other indicators printed on tickets to allow players to avoid the use of bills and coins by loading credits using a ticket reader and cashing out credits using a ticket-out printer 126 on the gaming device 104A. The gaming device 104A can have hardware meters for purposes including ensuring regulatory compliance and monitoring the player credit balance. In addition, there can be additional meters that record the total amount of money wagered on the gaming device, total amount of money deposited, total amount of money withdrawn, total amount of winnings on gaming device 104A.

In some implementations, a player tracking card reader 144, a transceiver for wireless communication with a mobile device (e.g., a player's smartphone), a keypad 146, and/or an illuminated display 148 for reading, receiving, entering, and/or displaying player tracking information is provided in gaming device 104A. In such implementations, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some implementations, the information panel(s) 152 may be implemented as an additional video display.

Gaming devices 104A have traditionally also included a handle 132 typically mounted to the side of main cabinet 116 which may be used to initiate game play.

Figure 2A:
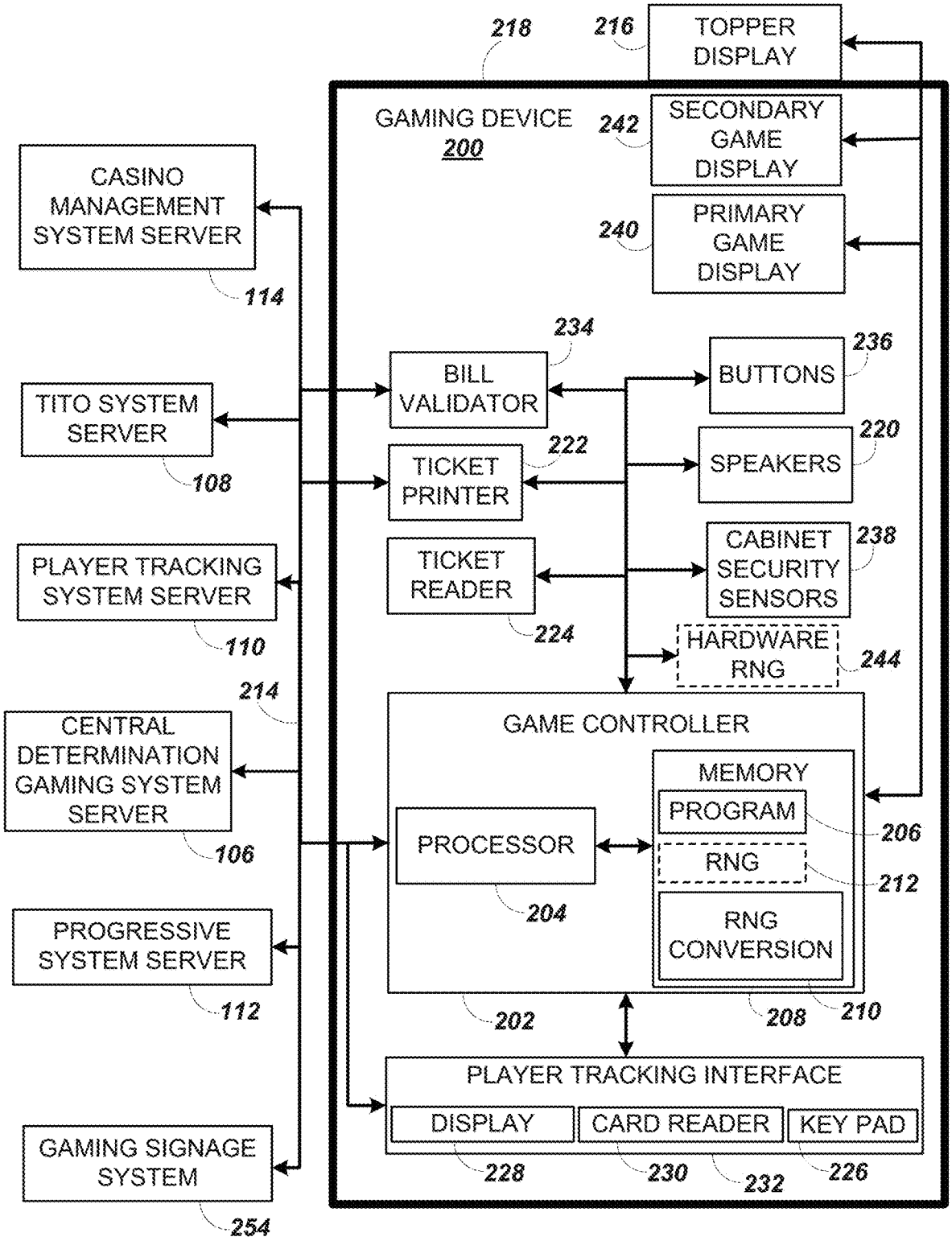
FIG. 2A is a block diagram showing various functional elements of an exemplary EGM.

Many or all the above described components can be controlled by circuitry (e.g., a game controller) housed inside the main cabinet 116 of the gaming device 104A, the details of which are shown in FIG. 2A.

An alternative example gaming device 104B illustrated in FIG. 1 is the Arc™ model gaming device manufactured by Aristocrat® Technologies, Inc. Note that where possible, reference numerals identifying similar features of the gaming device 104A implementation are also identified in the gaming device 104B implementation using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some implementations, the optional topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the main display 128A may have a curvature radius from top to bottom, or alternatively from side to side. In some implementations, main display 128A is a flat panel display. Main display 128A is typically used for primary game play while secondary display 128B is typically used for bonus game play, to show game features or attraction activities while the game is not in play or any other information or media desired by the game designer or operator. In some implementations, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2A is a block diagram depicting exemplary internal electronic components of a gaming device 200 connected to various external systems. All or parts of the gaming device 200 shown could be used to implement any one of the example gaming devices 104A-X depicted in FIG. 1. As shown in FIG. 2A, gaming device 200 includes a topper display 216 or another form of a top box (e.g., a topper wheel, a topper screen, etc.) that sits above cabinet 218. Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2A illustrates that game controller 202 includes a single processor 204, game controller 202 is not limited to this representation and instead can include multiple processors 204 (e.g., two or more processors).

FIG. 2A illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, universal serial bus (USB) flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2A illustrates that game controller 202 includes a single memory 208, game controller 202 could include multiple memories 208 for storing program instructions and/or data.

Memory 208 can store one or more game programs 206 that provide program instructions and/or data for carrying out various implementations (e.g., game mechanics) described herein. Stated another way, game program 206 represents an executable program stored in any portion or component of memory 208. In one or more implementations, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be set up to generate one or more game instances based on instructions and/or data that gaming device 200 exchanges with one or more remote gaming devices, such as a central determination gaming system server 106 (not shown in FIG. 2A but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2A illustrates that gaming device 200 could include an RNG 212 that utilizes hardware and/or software to generate RNG outcomes that lack any pattern. The RNG operations are often specialized and non-generic in order to comply with regulatory and gaming requirements. For example, in a slot game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more implementations, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

In FIG. 2A, RNG 212 and hardware RNG 244 are shown in dashed lines to illustrate that RNG 212, hardware RNG 244, or both can be included in gaming device 200. In one implementation, instead of including RNG 212, gaming device 200 could include a hardware RNG 244 that generates RNG outcomes. Analogous to RNG 212, hardware RNG 244 performs specialized and non-generic operations in order to comply with regulatory and gaming requirements. For example, because of regulation requirements, hardware RNG 244 could be a random number generator that securely produces random numbers for cryptography use. The gaming device 200 then uses the secure random numbers to generate game outcomes for one or more game features. In another implementation, the gaming device 200 could include both hardware RNG 244 and RNG 212. RNG 212 may utilize the RNG outcomes from hardware RNG 244 as one of many sources of entropy for generating secure random numbers for the game features.

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2A illustrates that gaming device 200 includes an RNG conversion engine 210 that translates the RNG outcome from RNG 212 to a game outcome presented to a player. To meet a designated RTP, a game developer can set up the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2A also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gaming device. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Additionally, or alternatively, gaming devices 104A-104X and 200 can include or be coupled to one or more wireless transmitters, receivers, and/or transceivers (not shown in FIGS. 1 and 2A) that communicate (e.g., Bluetooth® or other near-field communication technology) with one or more mobile devices to perform a variety of wireless operations in a casino environment. Examples of wireless operations in a casino environment include detecting the presence of mobile devices, performing credit, points, comps, or other marketing or hard currency transfers, establishing wagering sessions, and/or providing a personalized casino-based experience using a mobile application. In one implementation, to perform these wireless operations, a wireless transmitter or transceiver initiates a secure wireless connection between a gaming device 104A-104X and 200 and a mobile device. After establishing a secure wireless connection between the gaming device 104A-104X and 200 and the mobile device, the wireless transmitter or transceiver does not send and/or receive application data to and/or from the mobile device. Rather, the mobile device communicates with gaming devices 104A-104X and 200 using another wireless connection (e.g., WiFi® or cellular network). In another implementation, a wireless transceiver establishes a secure connection to directly communicate with the mobile device. The mobile device and gaming device 104A-104X and 200 sends and receives data utilizing the wireless transceiver instead of utilizing an external network. For example, the mobile device would perform digital wallet transactions by directly communicating with the wireless transceiver. In one or more implementations, a wireless transmitter could broadcast data received by one or more mobile devices without establishing a pairing connection with the mobile devices.

Although FIGS. 1 and 2A illustrate specific implementations of a gaming device (e.g., gaming devices 104A-104X and 200), the disclosure is not limited to those implementations shown in FIGS. 1 and 2. For example, not all gaming devices suitable for implementing implementations of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or tabletops and have displays that face upwards. Gaming devices 104A-104X and 200 may also include other processors that are not separately shown. Using FIG. 2A as an example, gaming device 200 could include display controllers (not shown in FIG. 2A) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Figure 2B:
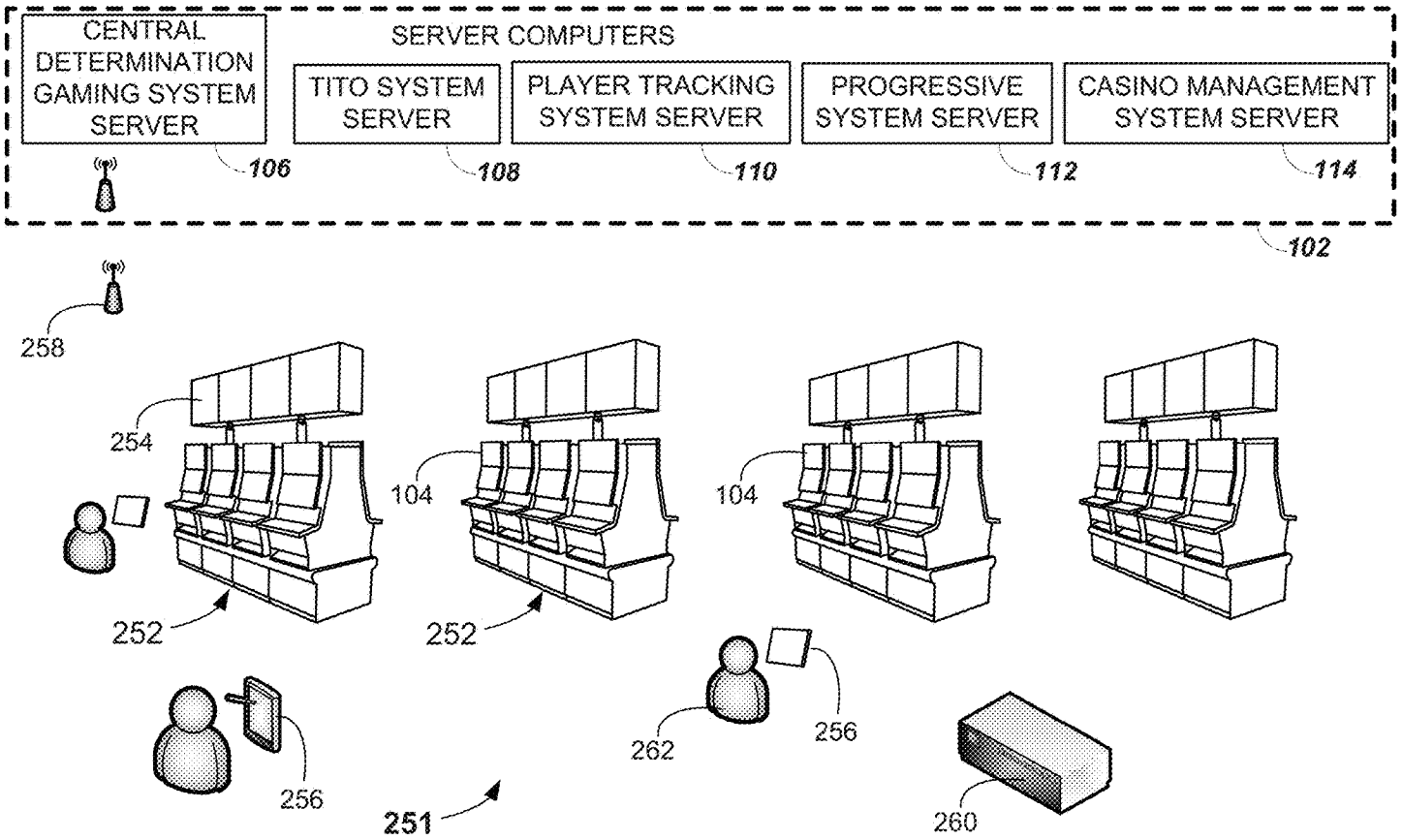
FIG. 2B depicts a casino gaming environment according to one example.

FIG. 2B depicts a casino gaming environment according to one example. In this example, the casino 251 includes banks 252 of EGMs 104. In this example, each bank 252 of EGMs 104 includes a corresponding gaming signage system 254 (also shown in FIG. 2A). According to this implementation, the casino 251 also includes mobile gaming devices 256, which are also configured to present wagering games in this example. The mobile gaming devices 256 may, for example, include tablet devices, cellular phones, smart phones and/or other handheld devices. In this example, the mobile gaming devices 256 are configured for communication with one or more other devices in the casino 251, including but not limited to one or more of the server computers 102, via wireless access points 258.

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the EGMs 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some implementations, the casino 251 may include one or more kiosks 260 that are configured to facilitate monetary transactions involving the mobile gaming devices 256, which may include cash out and/or cash in transactions. The kiosks 260 may be configured for wired and/or wireless communication with the mobile gaming devices 256. The kiosks 260 may be configured to accept monetary credits from casino patrons 262 and/or to dispense monetary credits to casino patrons 262 via cash, a credit or debit card, via a wireless interface (e.g., via a wireless payment app), via tickets, etc. According to some examples, the kiosks 260 may be configured to accept monetary credits from a casino patron and to provide a corresponding amount of monetary credits to a mobile gaming device 256 for wagering purposes, e.g., via a wireless link such as a near-field communications link. In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the casino patron 262 corresponding to the "cash out" signal, which may be in the form of cash, a credit ticket, a credit transmitted to a financial account corresponding to the casino patron, etc.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as a casino gaming area.

Figure 2C:
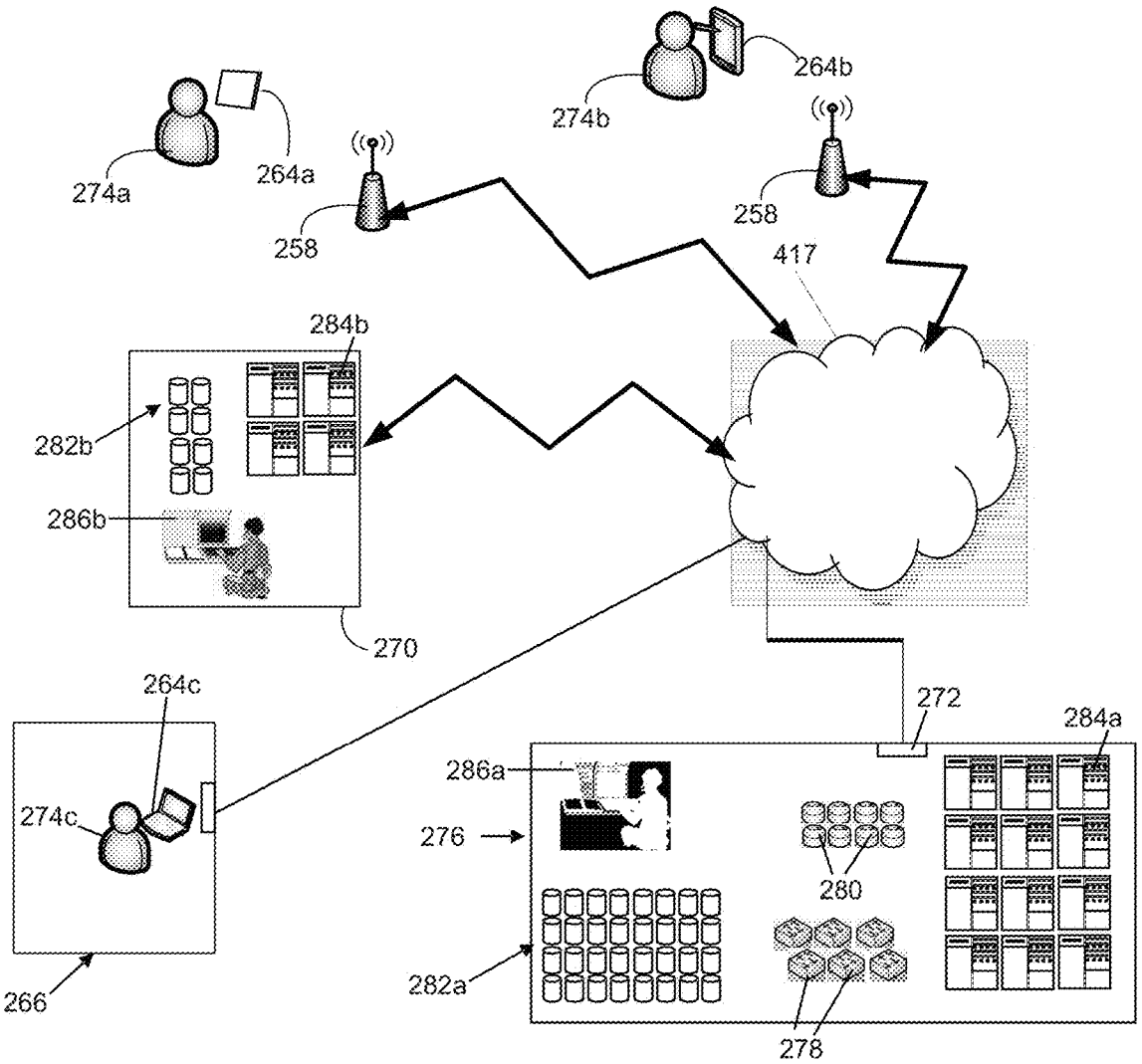
FIG. 2C is a diagram that shows examples of components of a system for providing online gaming according to some aspects of the present disclosure.

FIG. 2C is a diagram that shows examples of components of a system for providing online gaming according to some aspects of the present disclosure. As with other figures presented in this disclosure, the numbers, types and arrangements of gaming devices shown in FIG. 2C are merely shown by way of example. In this example, various gaming devices, including but not limited to end user devices (EUDs) 264*a*, 264*b* and 264*c* are capable of communication via one or more networks 417. The networks 417 may, for example, include one or more cellular telephone networks, the Internet, etc. In this example, the EUDs 264*a* and 264*b* are mobile devices: according to this example the EUD 264*a* is a tablet device and the EUD 264*b* is a smart phone. In this implementation, the EUD 264*c* is a laptop computer that is located within a residence 266 at the time depicted in FIG. 2C. Accordingly, in this example the hardware of EUDs is not specifically configured for online gaming, although each EUD is configured with software for online gaming. For example, each EUD may be configured with a web browser. Other implementations may include other types of EUD, some of which may be specifically configured for online gaming.

In this example, a gaming data center 276 includes various devices that are configured to provide online wagering games via the networks 417. The gaming data center 276 is capable of communication with the networks 417 via the gateway 272. In this example, switches 278 and routers 280 are configured to provide network connectivity for devices of the gaming data center 276, including storage devices 282*a*, servers 284*a* and one or more workstations 570*a*. The servers 284*a* may, for example, be configured to provide access to a library of games for online game play. In some examples, code for executing at least some of the games may initially be stored on one or more of the storage devices 282*a*. The code may be subsequently loaded onto a server 284*a* after selection by a player via an EUD and communication of that selection from the EUD via the networks 417. The server 284*a* onto which code for the selected game has been loaded may provide the game according to selections made by a player and indicated via the player's EUD. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 417. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, etc. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost. According to some such implementations, one or more of the servers 284*a* may be configured to monitor player credit balances, which may be expressed in game credits, in currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some alternative implementations, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

Figure 3:
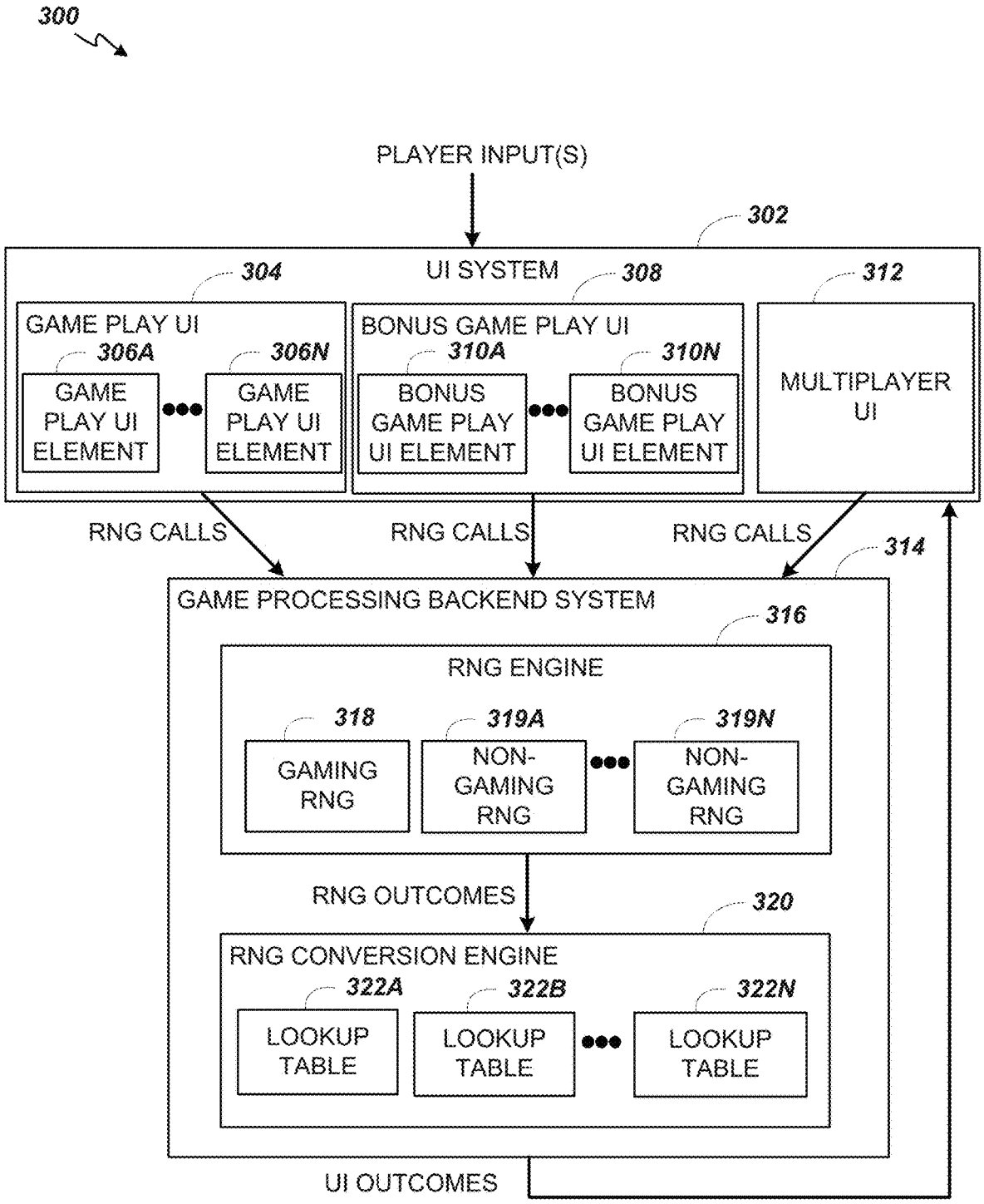
FIG. 3 illustrates, in block diagram form, an implementation of a game processing architecture algorithm that implements a game processing pipeline for the play of a game in accordance with various implementations described herein.

FIG. 3 illustrates, in block diagram form, an implementation of a game processing architecture 300 that implements a game processing pipeline for the play of a game in accordance with various implementations described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 312, where each UI type includes one or more mechanical UIs and/or graphical UIs (GUIs). In other words, game play UI 304, bonus game play UI 308, and the multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a user. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more implementations, at least some of the game play UI element 306A-306N are similar to the bonus game play UI elements 310A-310N. In other implementations, the game play UI element 306A-306N can differ from the bonus game play UI elements 310A-310N.

FIG. 3 also illustrates that UI system 302 could include a multiplayer UI 312 purposed for game play that differs or is separate from the typical base game. For example, multiplayer UI 312 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 could corresponds to RNG 212 or hardware RNG 244 shown in FIG. 2A. As previously discussed with reference to FIG. 2A, gaming RNG 318 often performs specialized and non-generic operations that comply with regulatory and/or game requirements. For example, because of regulation requirements, gaming RNG 318 could correspond to RNG 212 by being a cryptographic RNG or pseudorandom number generator (PRNG) (e.g., Fortuna PRNG) that securely produces random numbers for one or more game features. To securely generate random numbers, gaming RNG 318 could collect random data from various sources of entropy, such as from an operating system (OS) and/or a hardware RNG (e.g., hardware RNG 244 shown in FIG. 2A). Alternatively, non-gaming RNGs 319A-319N may not be cryptographically secure and/or be computationally less expensive. Non-gaming RNGs 319A-319N can, thus, be used to generate outcomes for non-gaming purposes. As an example, non-gaming RNGs 319A-319N can generate random numbers for generating random messages that appear on the gaming device.

The RNG conversion engine 320 processes each RNG outcome from RNG engine 316 and converts the RNG outcome to a UI outcome that is feedback to the UI system 302. With reference to FIG. 2A, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome and the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to updating the appropriate UI, the player may subsequently provide additional player inputs to initiate a subsequent game instance that progresses through the game processing pipeline.

To present an award, a feature, or a respin, some gaming systems may employ one or more moving displays, which may move in relation to one or more axes and may take the form of one or more spheres. These moving displays may enhance the excitement of the game presentation.

Figure 4A:
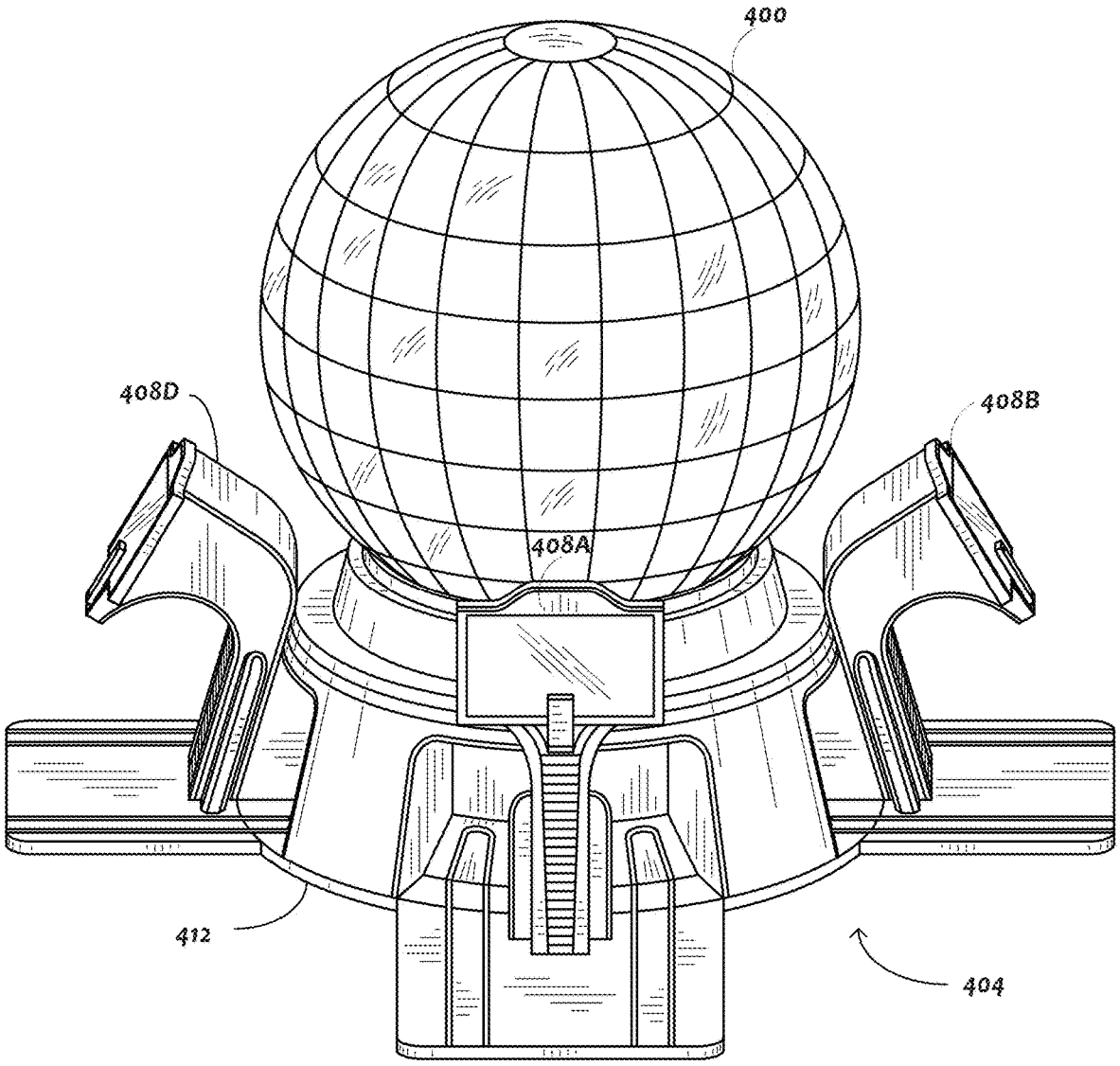
FIGS. 4A, 4B, and 4C illustrate different views of an embodiment of a first spinning sphere.
Figure 4B:
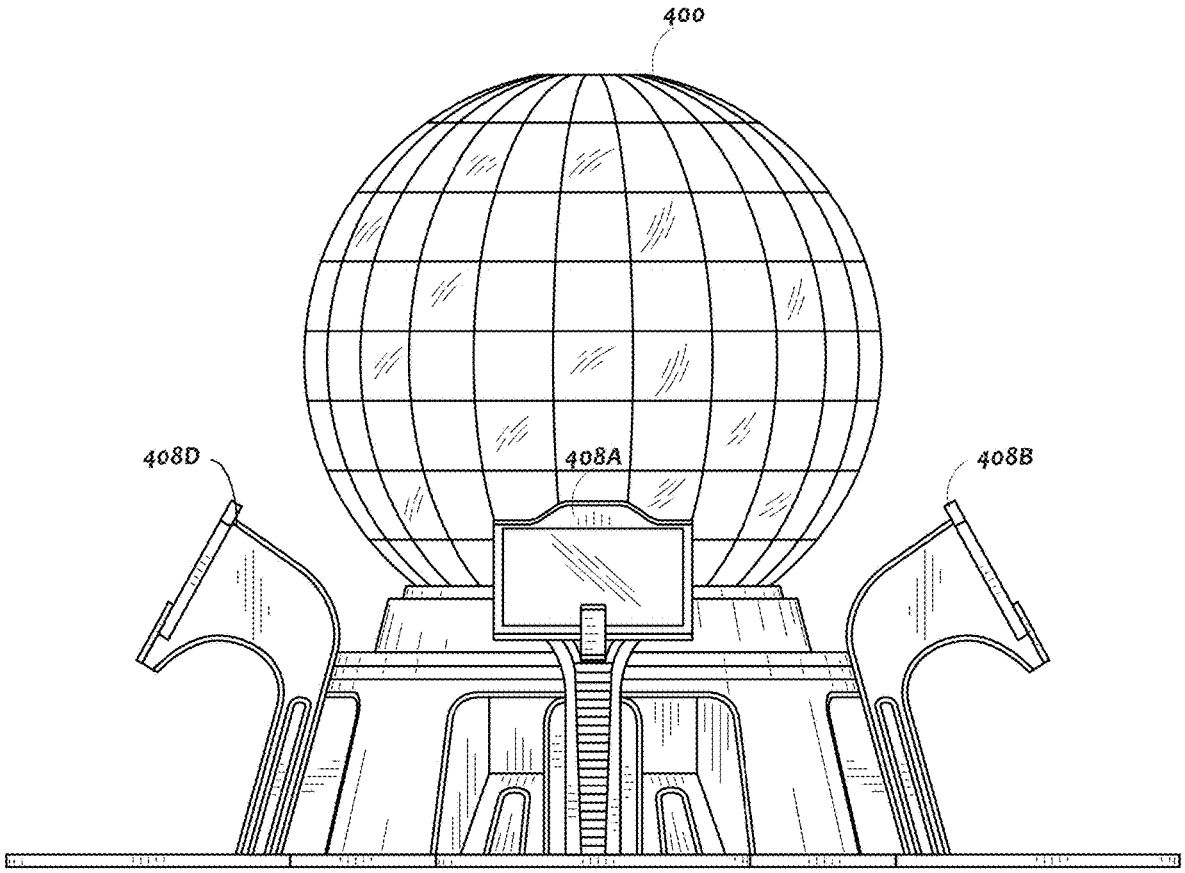
Figure 4C:
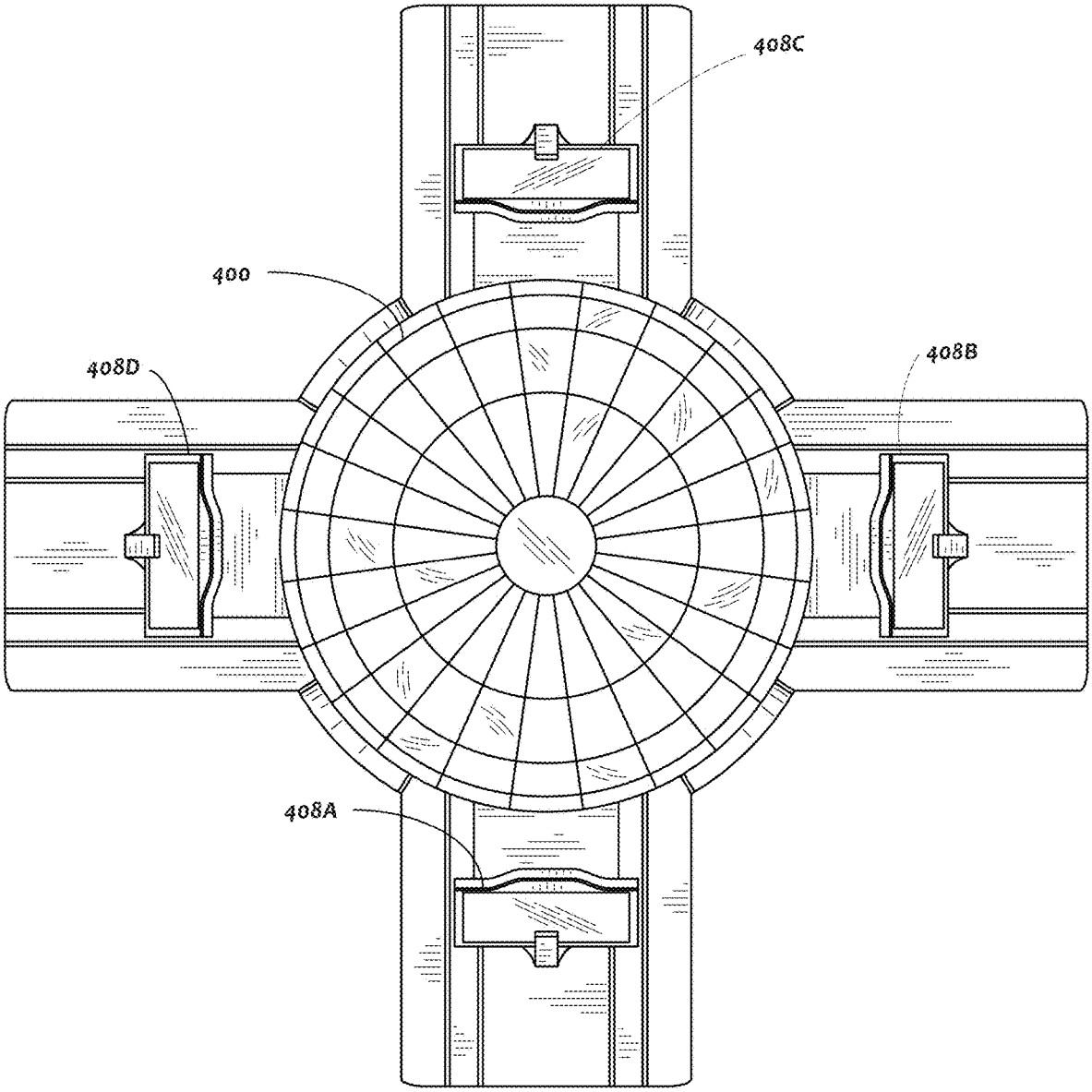

FIGS. 4A, 4B, and 4C illustrate different views of an embodiment of a three-dimensional display device 400. The three-dimensional display device 400 may have one of many geometric shapes with at least one viewing surface, e.g., a sphere, cone, cylinder, hemisphere, cube, cuboid, prism, hexagonal prism, or a pyramid. For example, FIG. 4A illustrates a perspective view of the three-dimensional display device 400 in the shape of a spinning sphere 400 positioned in a multi-player station 404. In the embodiment shown, the multi-player station 404 includes four gaming devices 408A, 408B, 408C, 408D. The gaming devices 408A, 408B, 408C, 408D are joined by a spinning activation structure 412 that, when actuated, spins the three-dimensional display device 400. The game play on the gaming devices 408A, 408B, 408C, 408D may be a shared game or separate games. The game play on the three-dimensional display device 400 may be a shared game and separate games, which may coincide with the game play on the gaming devices or be distinct games. Game and game-related information may be displayed on the gaming devices 408A, 408B, 408C, 408D and the three-dimensional display device 400.

The three-dimensional display device 400 comprises an aluminum die cast sphere that may include a plurality of magnets and number of electrical coils (not shown) on or in an interior of the three-dimensional display device 400. The three-dimensional display device 400 is typically elevated during use at least a small distance above the spinning activation structure 412, and is configured to be viewable from various player vantage points. By way of example, the plurality of magnets may be arranged as a 2-dimensional array of magnets in the interior of the first spinning sphere 400 for levitation, for example, via magnetic levitation (maglev) or magnetic suspension in which the three-dimensional display device 400 is suspended with no support other than magnetic fields, as discussed hereinafter. Two primary issues involved in magnetic levitation are lifting forces that provides an upward force sufficient to counteract a gravitational force exhibited by a sphere, and stability that ensures an equilibrium between the sphere and any supporting structure, such as the spinning activation structure 412, does not spontaneously slide or flip into a configuration where the lifting force is neutralized in relation to the spinning activation structure 412. In some embodiments, each of the 2-dimensional array of magnets may respond to the display of a symbol or symbol position on an exterior of the three-dimensional display device 400. Other suitable multi-dimensional magnet arrays are contemplated. The magnets may comprise permanent magnets or electromagnets, and may be high strength magnets sufficient to create magnetic fields in relation to the gaming machine or a gaming machine area to levitate the three-dimensional display device 400.

The spinning activation structure 412 may also comprise a plurality of magnets and a number of electrical coils (not shown) that, when energized, actuate the three-dimensional display device 400 to move, e.g., rise, lower, rotate, or tilt, depending on how and which of the coils are electrical energized, and the degree of energization, to force one or more of the corresponding plurality of magnets and, in turn, the three-dimensional display device 400, to move in a designated way. For example, when a particular magnet and/or electrical coil in the spinning activation structure 412 is energized near a relative bottom of the three-dimensional display device 400, a levitation force may be generated near a corresponding magnet in the 2-dimensional array of magnets at the relative bottom of the three-dimensional display device 400 thus inducing the three-dimensional display device 400 to levitate and/or spin. By way of another example, when two adjacent electrical coils in the spinning activation structure 412 are energized consecutively, the two adjacent electrical coils may generate a rotating or spinning force to rotate or spin the first spinning sphere 400 with respect to the spinning activation structure 412.

In some embodiments, the three-dimensional display device 400 may initially rise, lower, spin or rotate vertically (for example, with respect to gaming device 408A), diagonally, or horizontally, when some of the one or more magnets and/or electrical coils are energized. Although magnets and electrical coils are described with respect to movement, e.g., levitating, spinning, and rotating the first spinning sphere 400, other non-contact forces such as electrostatic force, or air or liquid jet pulsating force, may also be used to levitate, spin, and/or rotate the three-dimensional display device 400. Magnets or other devices to may be placed in structures away, e.g., other structures (like housings, tables, chairs), nearby devices, walls, or ceilings, from the spinning activation structure 412 to facilitate or enhance levitation or other movement of the three-dimensional display device 400. In some embodiment, the three-dimensional display device 400 may be spun or otherwise moved by a person (e.g., a host, player or dealer) during levitation.

In some embodiments, the three-dimensional display device 400 may display a plurality of symbol positions, and be configured to display or include a plurality of symbols at the plurality of symbol positions, respectively. The gaming machine 408A, spinning activation structure 412 or other device (e.g., a mobile device) configured for use with the gamine machine 408A, may also comprise one or more sensing modules (not shown). In relation to the one or more sensing modules (not shown), a wide variety of sensors, e.g., solid-state sensors, may be used in conjunction with available processors and memory. In general, the sensors may be analog or digital, and may also be composite sensors. The sensors may have various reporting modes, including continuous, one-time or other special modes. The sensors, by way of example, may include a sensing element that may respond to changes in some physical parameter to an electrical signal for detection purposes, and generate a signal that can be measured or interpreted and responded to. Some sensors may be magnetic position sensors. Other types of sensors may include force sensors, mass airflow sensors, pressure sensors, capacitive displacement sensors, eddy-current sensors, hall effect sensors, inductive sensors, optical sensors, encoder sensors, potentiometer sensors, proximity sensors, and ultrasonic sensors. The one or more sensing modules may sense and generate a signal in response to determining: the proximity of the three-dimensional display device 400 from the gaming device 408A, the magnetic field, temperature, humidity, or pressure conditions in a gaming area, the body conditions of a person (e.g., a host, player or dealer), the gestures or movements of a person, the proximity of a person or device to a gaming machine 408A, the three-dimensional display device 400 or spinning activation structure 412, what symbols are being presented or displayed at one or more of the plurality of symbol positions, or some combination of conditions. Other conditions that may be sensed may include tilt, rotation, gravity, acceleration, hinge angle, light levels and sound levels.

The sensed conditions may also be used to affect the movement of the three-dimensional display device 400 during operation. The movement of the three-dimensional display device 400 may be predetermined or random in response to random outcome from a random number generator, and may be based on one or more sensed conditions by the one or more sensing modules. For example, in some embodiments, when the plurality of symbols on the plurality of symbol positions are predetermined, the sensing module may be operable to determine what symbol or symbols are being presented on a display of a gaming device 408A.

In embodiments where the three-dimensional display device 400 is a light-weight plastic or similar material, the three-dimensional display device 400 may be transparent or translucent with symbols displayed or presented thereon. Alternatively, display panels may be used as a façade on the three-dimensional display device 400 to display gaming and other information. When the three-dimensional display device 400 stops rotating, the symbols are viewable by one or more persons (e.g., a host, player or dealer) at or around the multi-player station 404. For example, a player at gaming device 408A may also be able to view symbols stop at gaming device 408B as well as symbols stop at gaming devices 408C and 408D. In some cases, the first spinning sphere 400 may be levitated, and may include the array of magnets controlled by pulsating electrical coils within the spinning activation structure 412.

FIGS. 5A, 5B, 5C, 5D, 5E, and 5F illustrate different views of an embodiment of a three-dimensional display device 500. As shown, the second spinning sphere 500 is a communal topper display among a multi-player station 504 having four gaming devices 508A, 508B, 508C, 508D. The gaming devices 508A, 508B, 508C, 508D are joined by a spinning mechanism 512 that, when actuated, spins the second spinning sphere 500. As shown, the spinning activation structure 512 extends from the multi-player station 504, and include a first actuating arm 516, a second actuating arm 520, and a third actuating arm or a receptacle 522. In some embodiments, each of the first actuating arm 516 and the second actuating arm 520 may include specialized displays 524, 528, respectively, to highlight symbols and/or spinning of the second spinning sphere 500. As shown, the second spinning sphere 500 is arranged to spin with respect to the first actuating arm 516, the second actuating arm 520, and the receptacle 522. In some cases, the second spinning sphere 500 may be levitatable via the spinning activation structure 512 with respect to the gaming devices 508A, 508B, 508C, 508D. In other cases, the second spinning sphere 500 may not be levitatable. In some other embodiments, the first actuating arm 516, the second actuating arm 520, and the receptacle 522 may include a plurality of electrical coils (not shown), and the second spinning sphere 500 may also include a plurality of magnets, as discussed above with respect to the first spinning sphere 400. Thus, when energized, the first actuating arm 516, the second actuating arm 520, and the receptacle 522 may hold the second spinning sphere 500 in place magnetically. For example, when one or more of the plurality of electrical coils are energized, the second spinning sphere 500 may be levitated with respect to the third actuating arm or the receptacle 522. For another example, when one or more of the plurality of electrical coils are energized near a plurality of adjacent magnets in the second spinning sphere 500, the second spinning sphere 500 may be magnetically forced to spin or rotate while being held by the first actuating arm 516, the second actuating arm 520, and the receptacle 52, as discussed above with respect to the first spinning sphere 400.

In still some other embodiments, the multi-player station 504 may include a plurality of embedded stepper motors, or other types of motors, with rotating elements that can be actuated to spin the second spinning sphere 500, for example, when a special event occurs. For example, the receptacle 522 may include a plurality of stepper motors (not shown) that may control the second spinning sphere 500 to incrementally to spin vertically, horizontally, diagonally and/or omni-directionally, while the first actuating arm 516 and the second actuating arm 520 hold the second spinning sphere 500 in place. However, in some other embodiments, the multi-player station 504 may include a plurality of embedded stepper motors that can be actuated to spin the second spinning sphere 500 with the first actuating arm 516 and the second actuating arm 520, while the receptacle 522 may hold the second spinning sphere 500 in place. For example, when individually actuated, the first actuating arm 516 may spin about a vertical axis. Thus, a player viewing from gaming device 508A may observe a left to right or horizontal rotation. Conversely, when individually actuated, the second actuating arm 520 may move about a horizontal axis. Thus, the player viewing from gaming device 508A may observe a top to bottom or vertical rotation or spinning. When timely actuated together, the second actuating arm 520 may spin about vertically, horizontally, diagonally and/or omni-directionally.

In other embodiments, the multi-player station 504 may include a number of projectors (not shown) that are coupled to the gaming devices 508A, 508B, 508C, 508D. For example, the projectors may be embedded in the second spinning sphere 500, and in electrical communication with the gaming devices 508A, 508B, 508C, 508D to project the spinning and results of the spinning to players. For another example, the projectors may be located external to the second spinning sphere 500. These projectors may be activated to project the second spinning sphere 500 being spun and spinning being stopped to show symbols selected.

FIGS. 6A, 6B, 6C, 6D, 6E, and 6F illustrate different views of an embodiment of a third three-dimensional display device 600 as a topper display for an electronic gaming device 604. A mechanism 608 stabilizes the third spinning sphere 600 while a plurality of stepper motors, or other types of motors, with rotating elements embedded in a third receptacle 612 incrementally spins the third spinning sphere 600 vertically, horizontally, diagonally and/or omni-directionally with respect to the electronic gaming device 604.

FIGS. 7A, 7B, 7C, 7D, 7E, and 7F illustrate different views of an embodiment of a fourth three-dimensional display device 700. The fourth spinning sphere 700 is a topper display levitated above a fourth multi-player station 704 having two back-to-back gaming devices 708A, 708B. In some embodiments, the fourth spinning sphere 700 may embed one or more magnets (not shown), and one or more electrically-driven magnets (not shown) are embedded in a fourth receptacle 712. When energized, the one or more electrically-driven magnets drive the one or more magnets in the fourth spinning sphere 700 to hover above the fourth multi-player station 704 with respect to a levitating axis 716. Further, based on which and how each of the one or more electrically-driven magnets is driven, the fourth spinning sphere 700 spins vertically, horizontally, diagonally and/or omni-directionally with respect to the fourth receptacle 712 based on. For example, when the one or more electrically-driven magnets responsible for horizontal rotations are selectively, sequentially, and/or alternately energized, the fourth spinning sphere 700 moves, e.g., spins or tilts, horizontally in relation to vertical axis 720. For another example, when the one or more electrically-driven magnets responsible for vertically rotations are selectively, sequentially, and/or alternately energized, the fourth spinning sphere 700 spins vertically in relation to horizontal axis 724. For yet another example, when both the one or more electrically-driven magnets responsible for horizontal rotations and for vertically rotations are selectively, sequentially, and/or alternately energized, the fourth spinning sphere 700 may hover or levitate over the fourth receptacle 712 and move vertically, horizontally, diagonally and/or omni-directionally.

In some embodiments, the one or more electrically-driven magnets may be selectively energized to allow the fourth spinning sphere 700 to hover over the fourth receptacle 712 without spinning the fourth spinning sphere 700, for example, in an attract mode. In other embodiments, the one or more electrically-driven magnets may be selectively energized to allow the fourth spinning sphere 700 to spin, and hover over the fourth receptacle 712 by a predetermined amount of gap in the attract mode. Thus, in some cases, the fourth spinning sphere 700 may levitate at different heights depending on whether the gaming devices 708A, 708B are in the attract mode, or in a feature game mode.

In some embodiments, the fourth spinning sphere 700 is made with light weight ferrous materials. The one or more magnets may be strategically disposed within the fourth spinning sphere 700. Conversely, the fourth receptacle 712 may also include the one or more electrically-driven magnets that are strategically placed such that the fourth spinning sphere 700 may spin as discussed above. In other embodiments, the fourth spinning sphere 700 is made with light weight plastic with the one or more magnets embedded therein. In still other embodiments, the fourth spinning sphere 700 is made with a combination of metallic and plastic materials. The light-weight plastic material allows the one or more magnets disposed in the fourth spinning sphere 700 to be relatively light such that less energy may be needed to energize the one or more electrically-driven magnets in the fourth receptacle 712 to raise or lift the fourth spinning sphere 700.

Figure 8A:
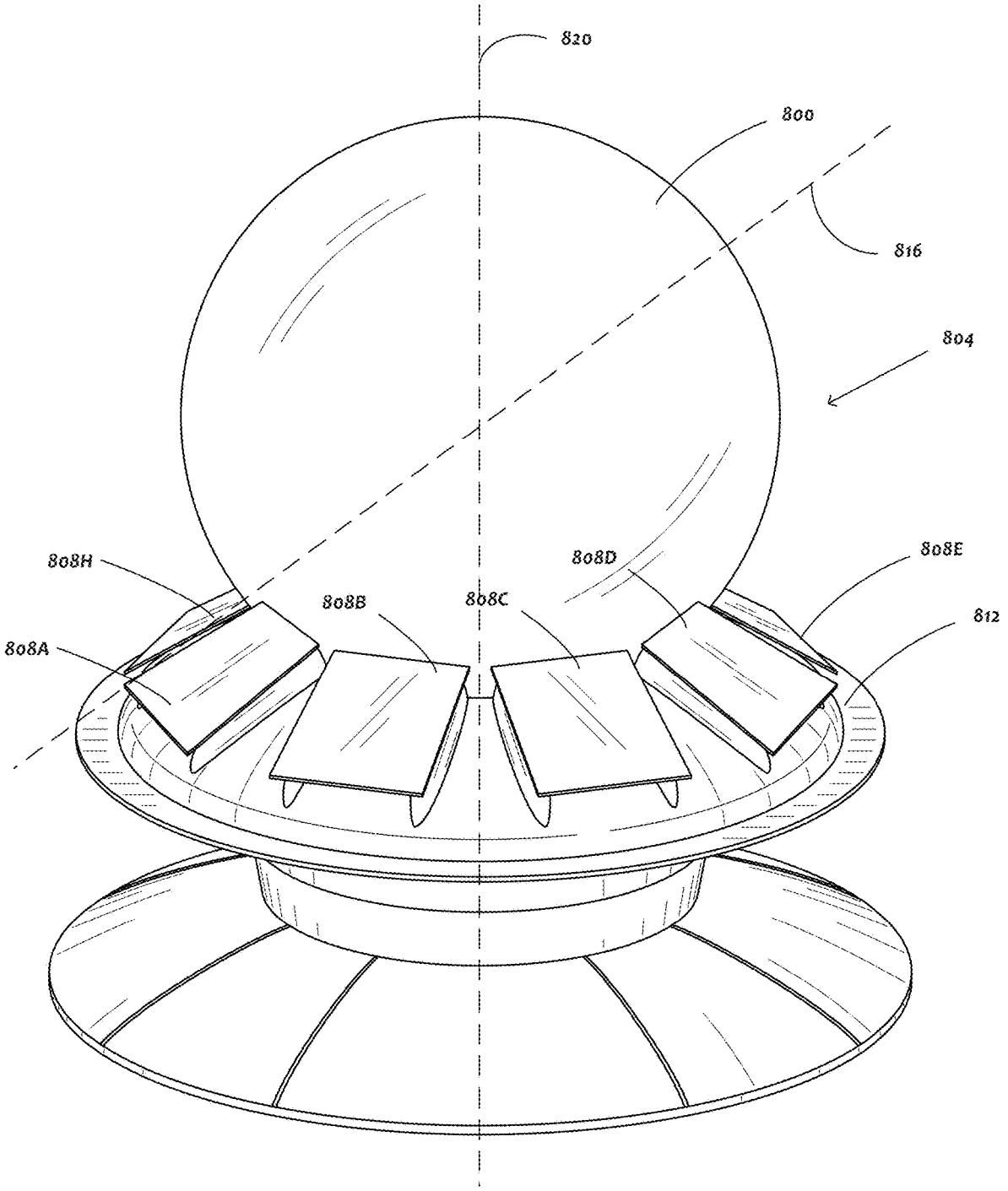
FIGS. 8A, 8B, and 8C illustrate different views of an embodiment of a fifth spinning sphere.
Figure 8B:
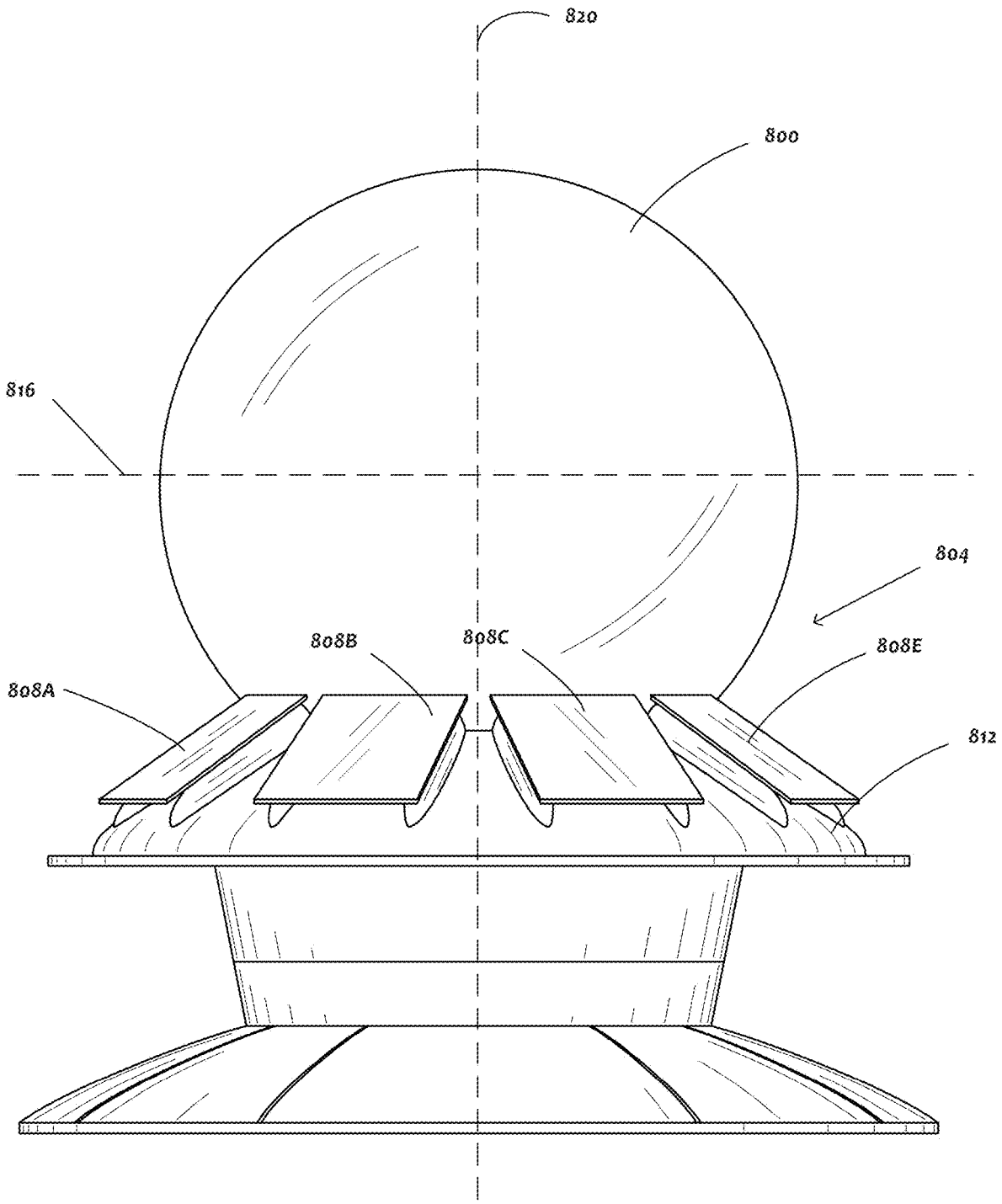
Figure 8C:
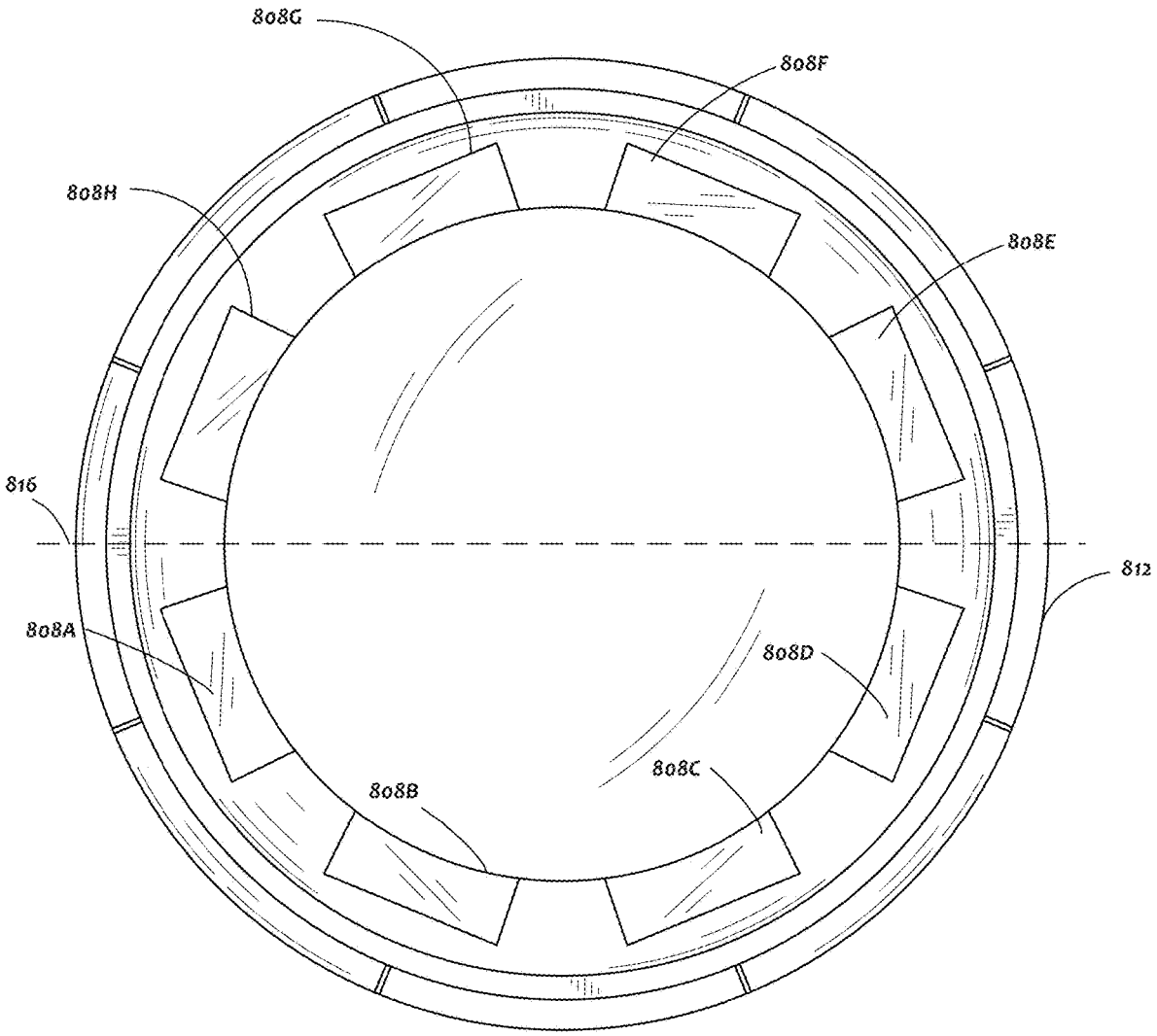

FIGS. 8A, 8B, and 8C illustrate different views of an embodiment of a fifth three-dimensional display device 800. As shown, the fifth spinning sphere 800 is a fifth communal topper display among a fifth multi-player station 804 having eight gaming devices 808A, 808B, 808C, 808D, 808E, 808F, 808G, 808H. The multi-player station 804 also includes a base 812 that supports the fifth spinning sphere 800. In some cases, the fifth spinning sphere 800 may be levitatable in relation to the base 812. In other cases, the fifth spinning sphere 800 may not be levitatable.

Figure 5A:
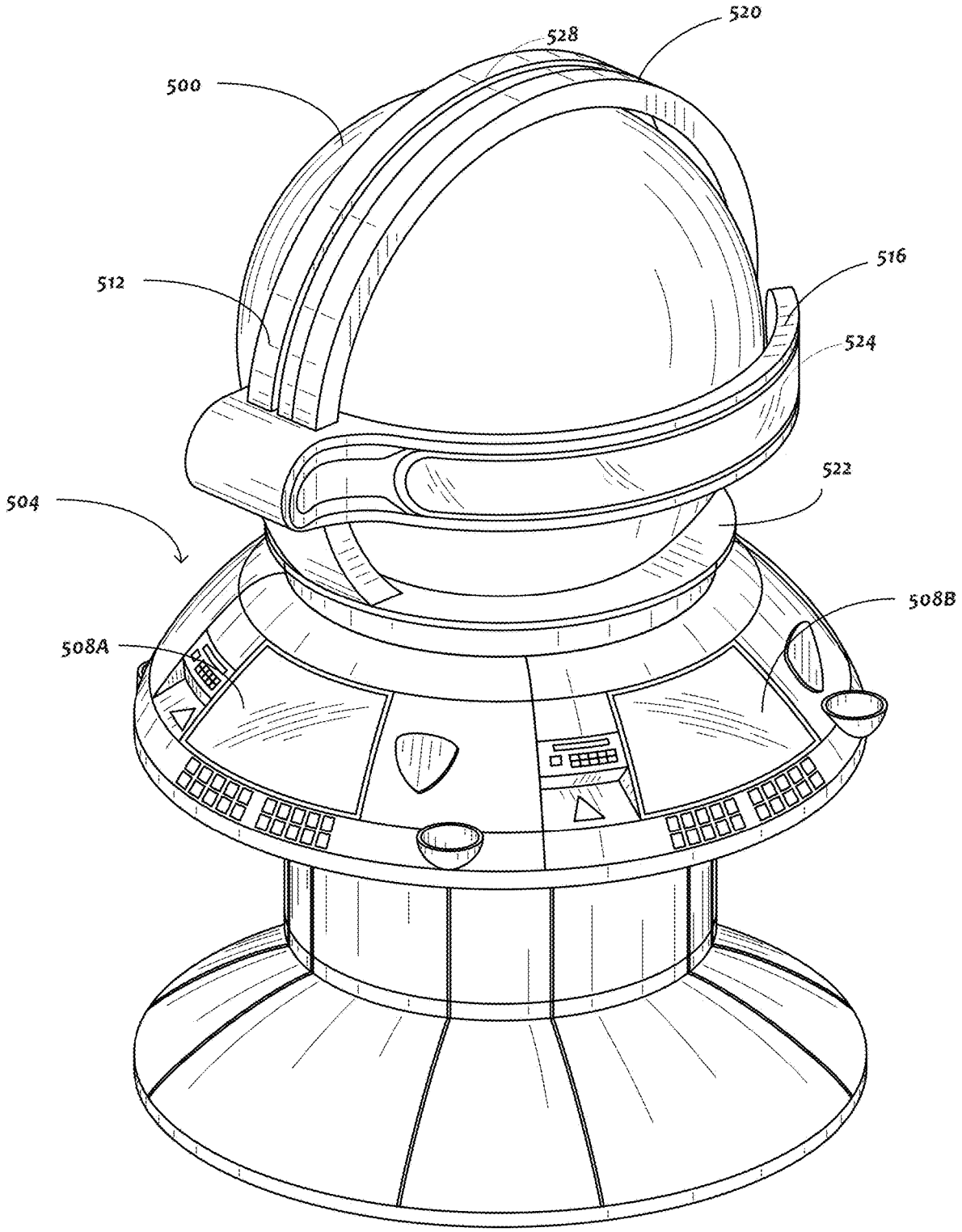
FIGS. 5A, 5B, 5C, 5D, 5E, and 5F illustrate different views of an embodiment of a second spinning sphere.
Figure 5B:
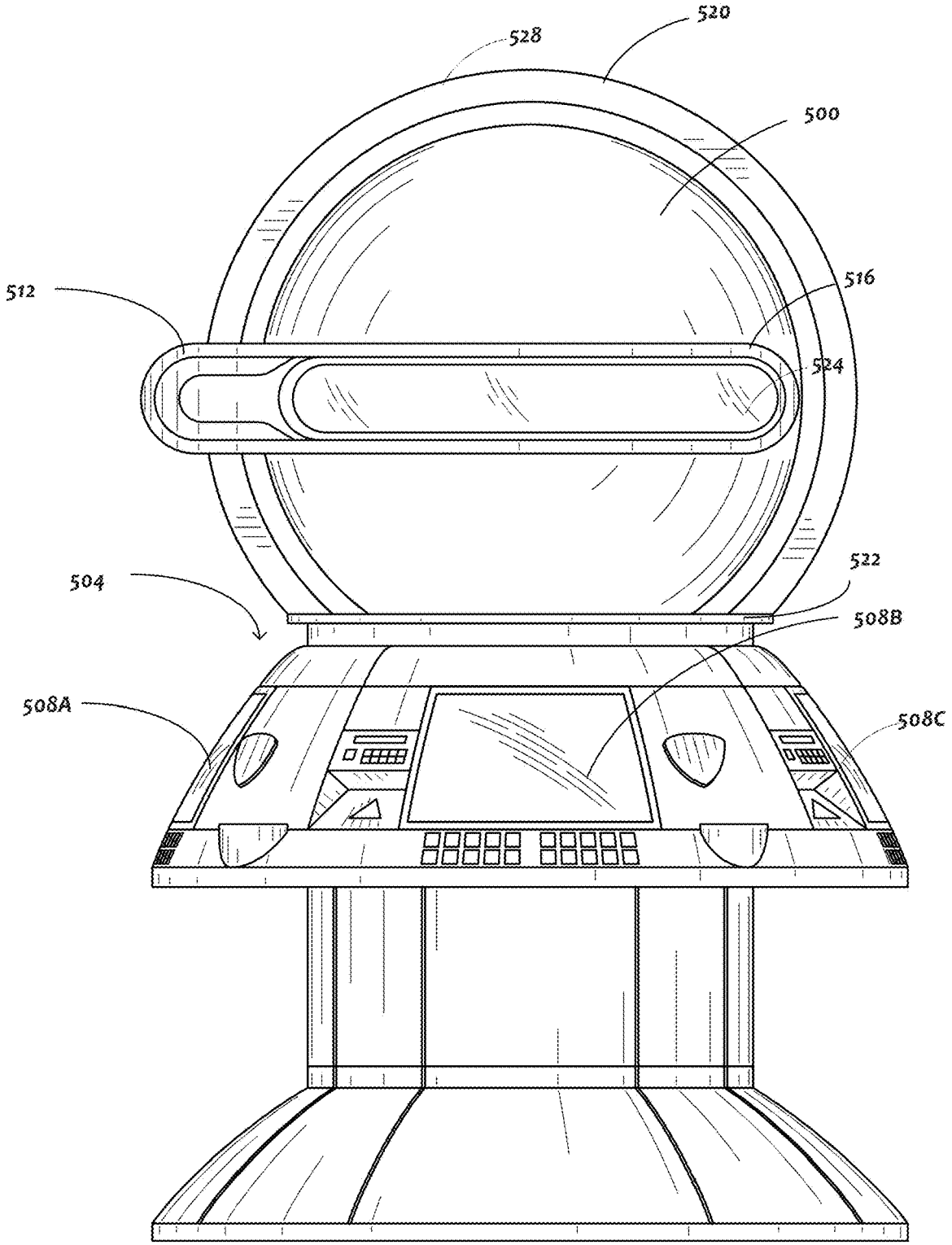
Figure 5C:
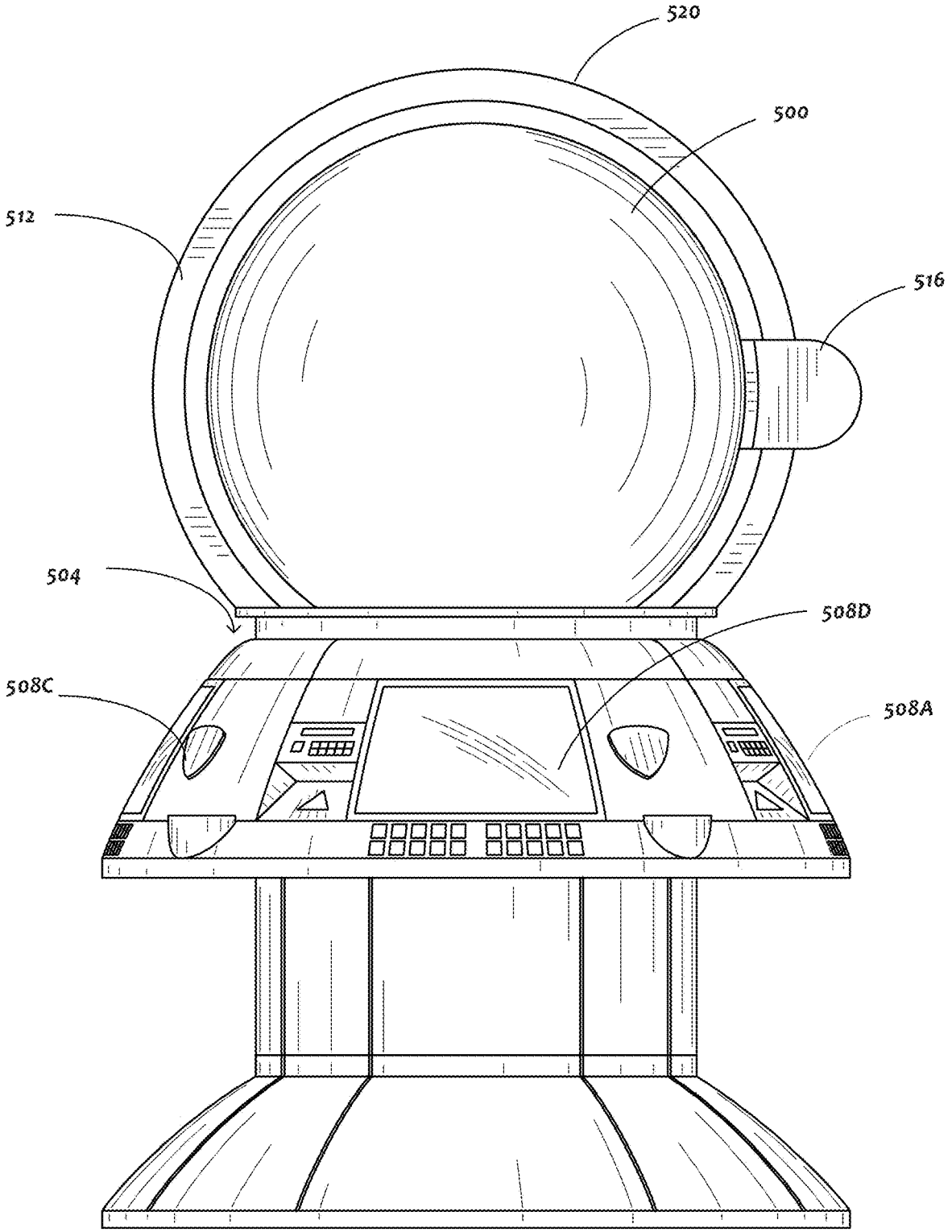
Figure 5D:
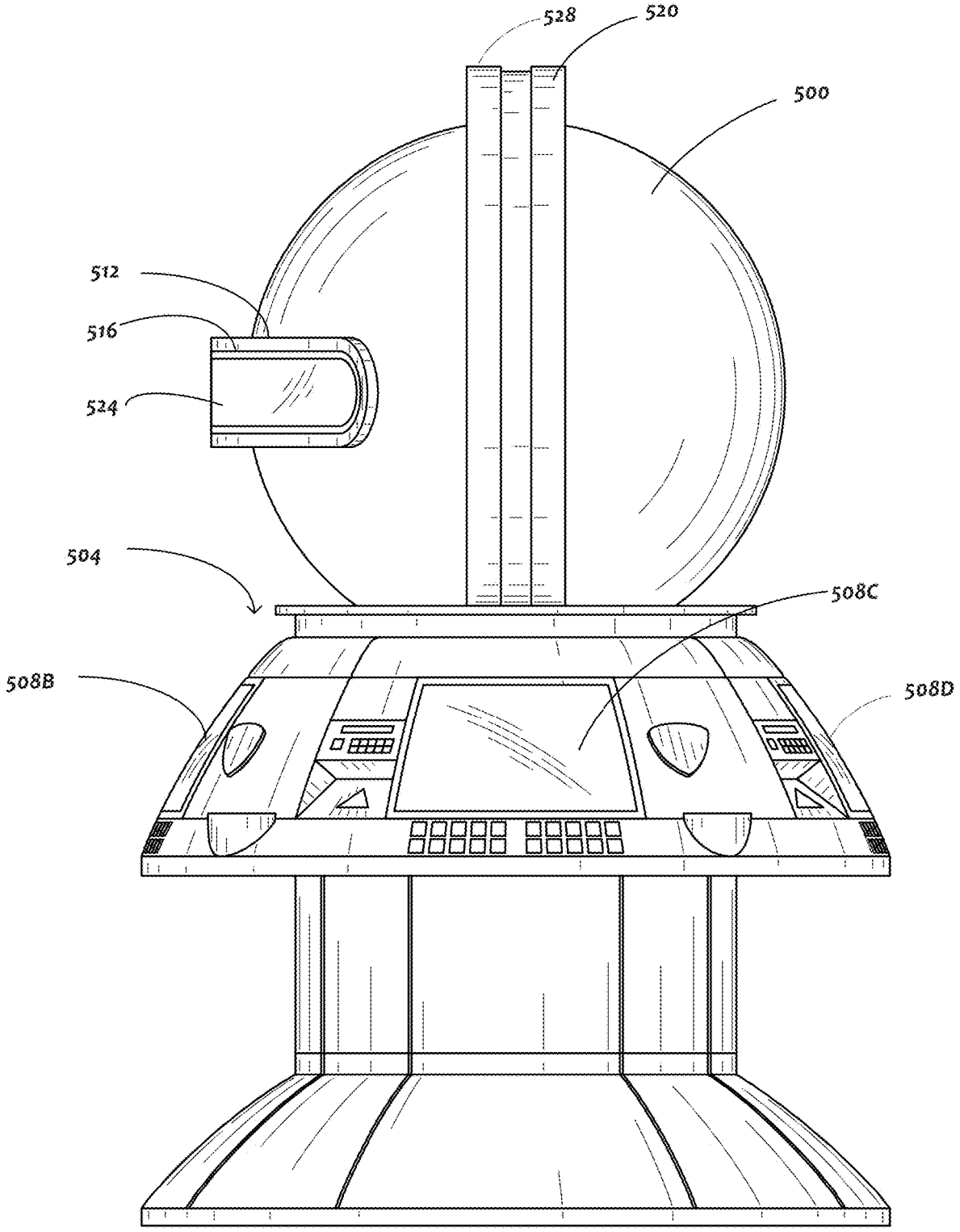
Figure 5E:
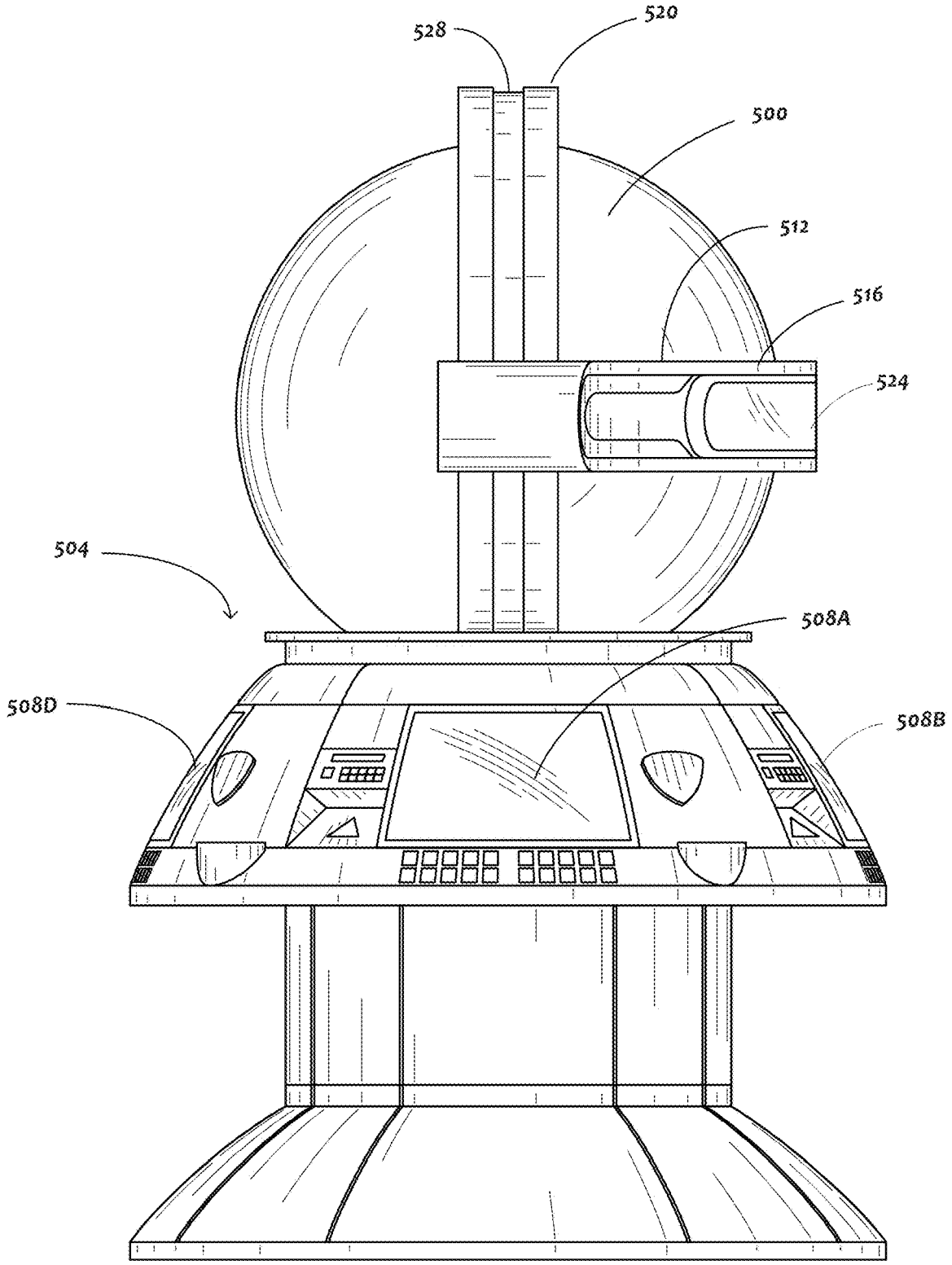
Figure 5F:
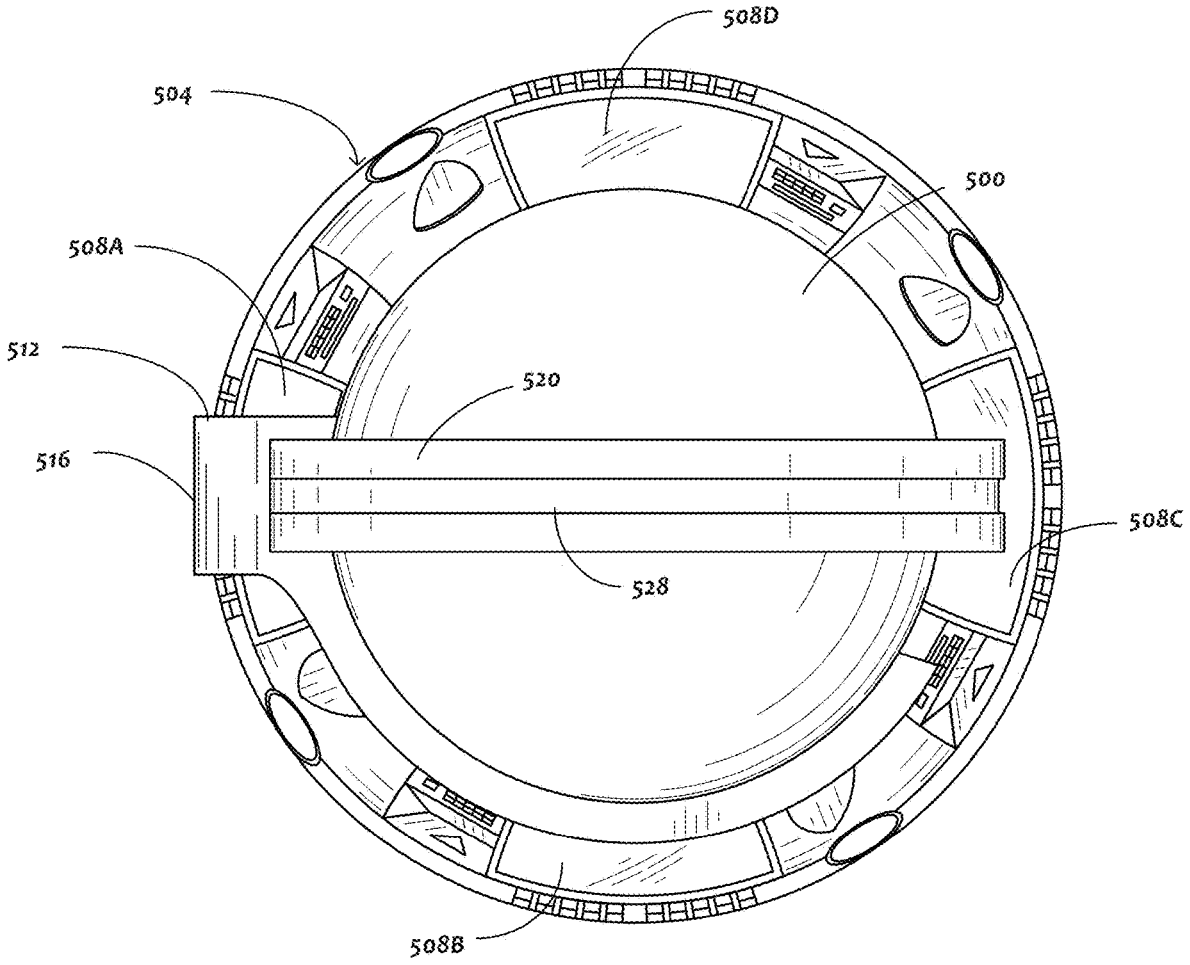
Figure 6A:
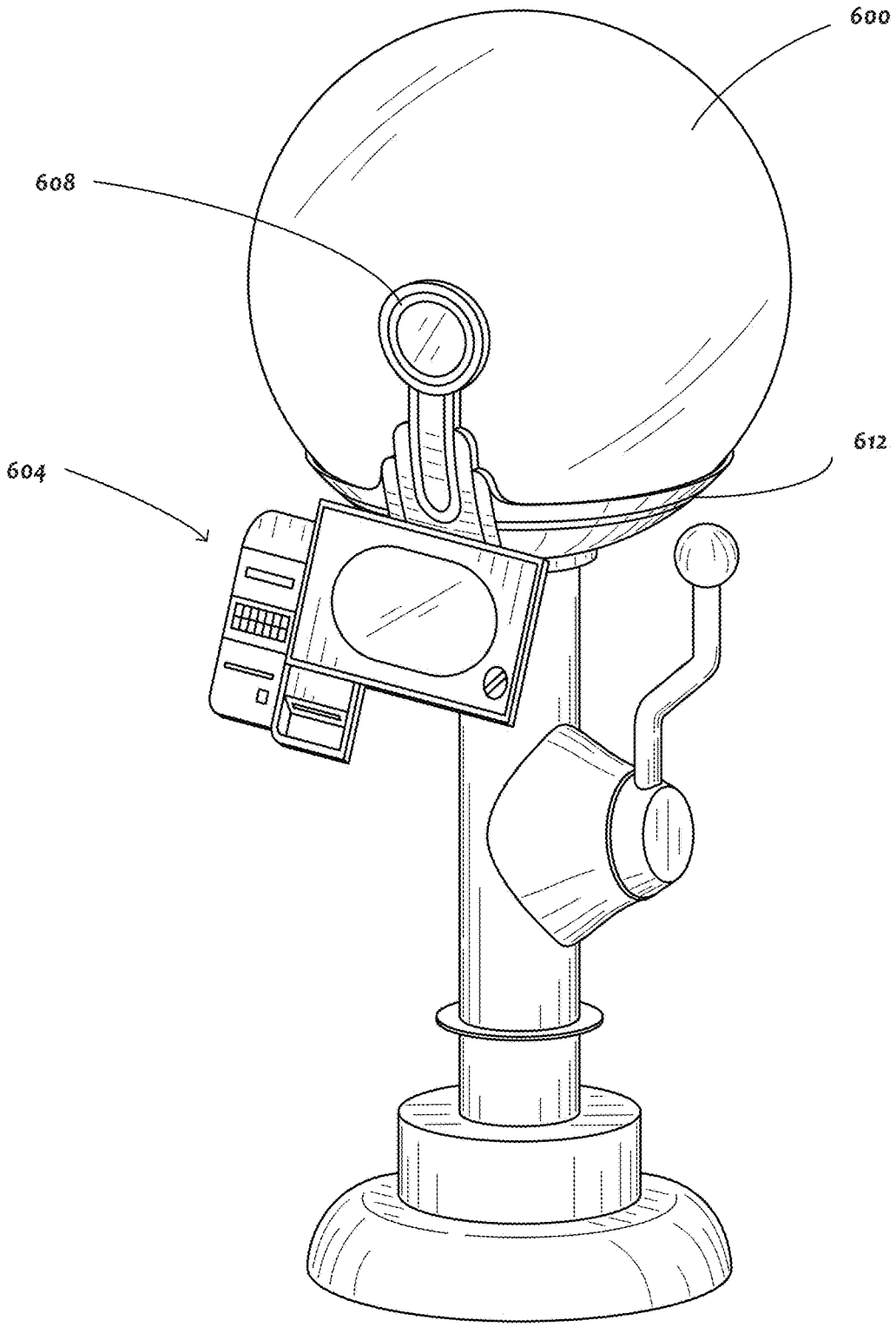
FIGS. 6A, 6B, 6C, 6D, 6E, and 6F illustrate different views of an embodiment of a third spinning sphere.
Figure 6B:
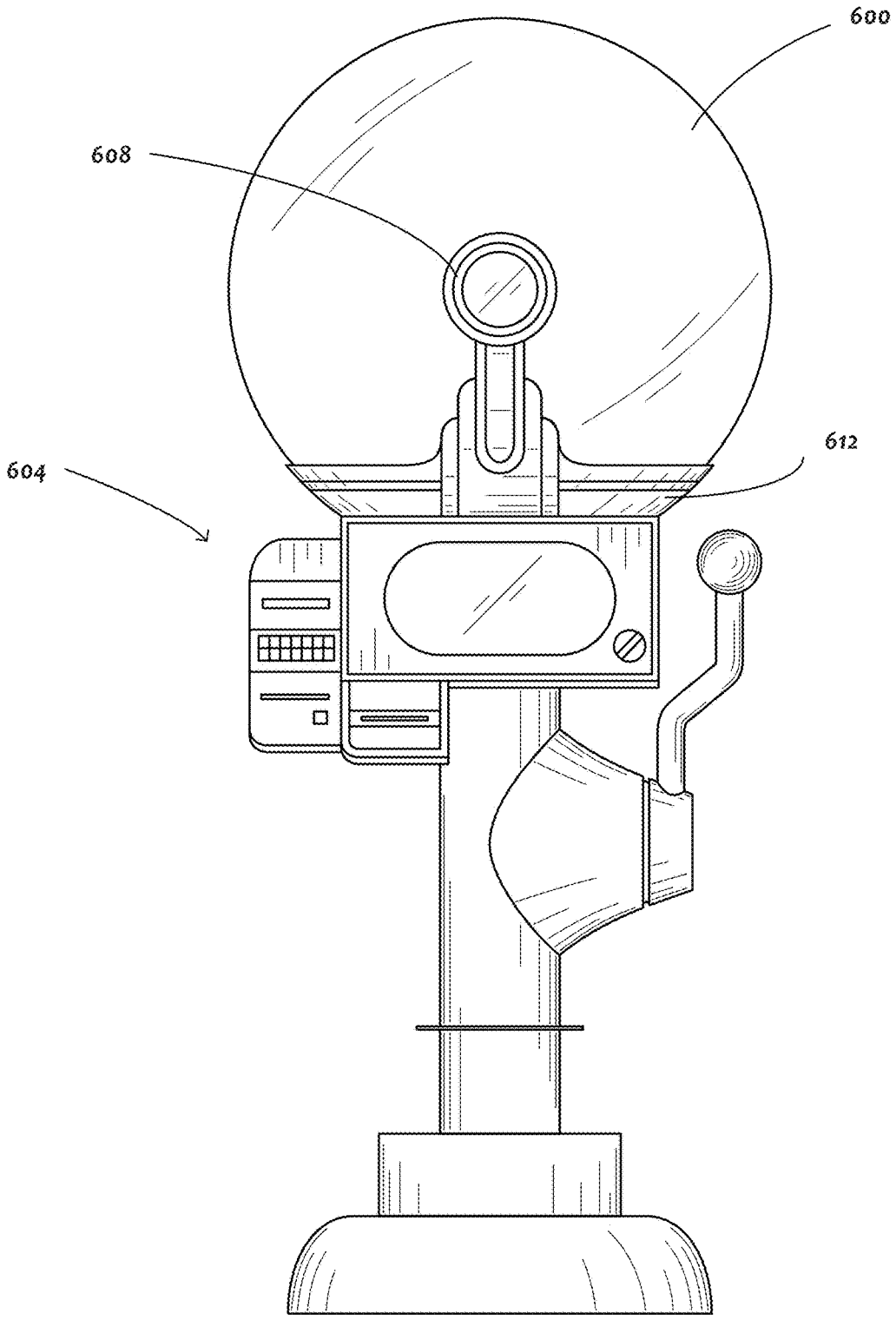
Figure 6C:
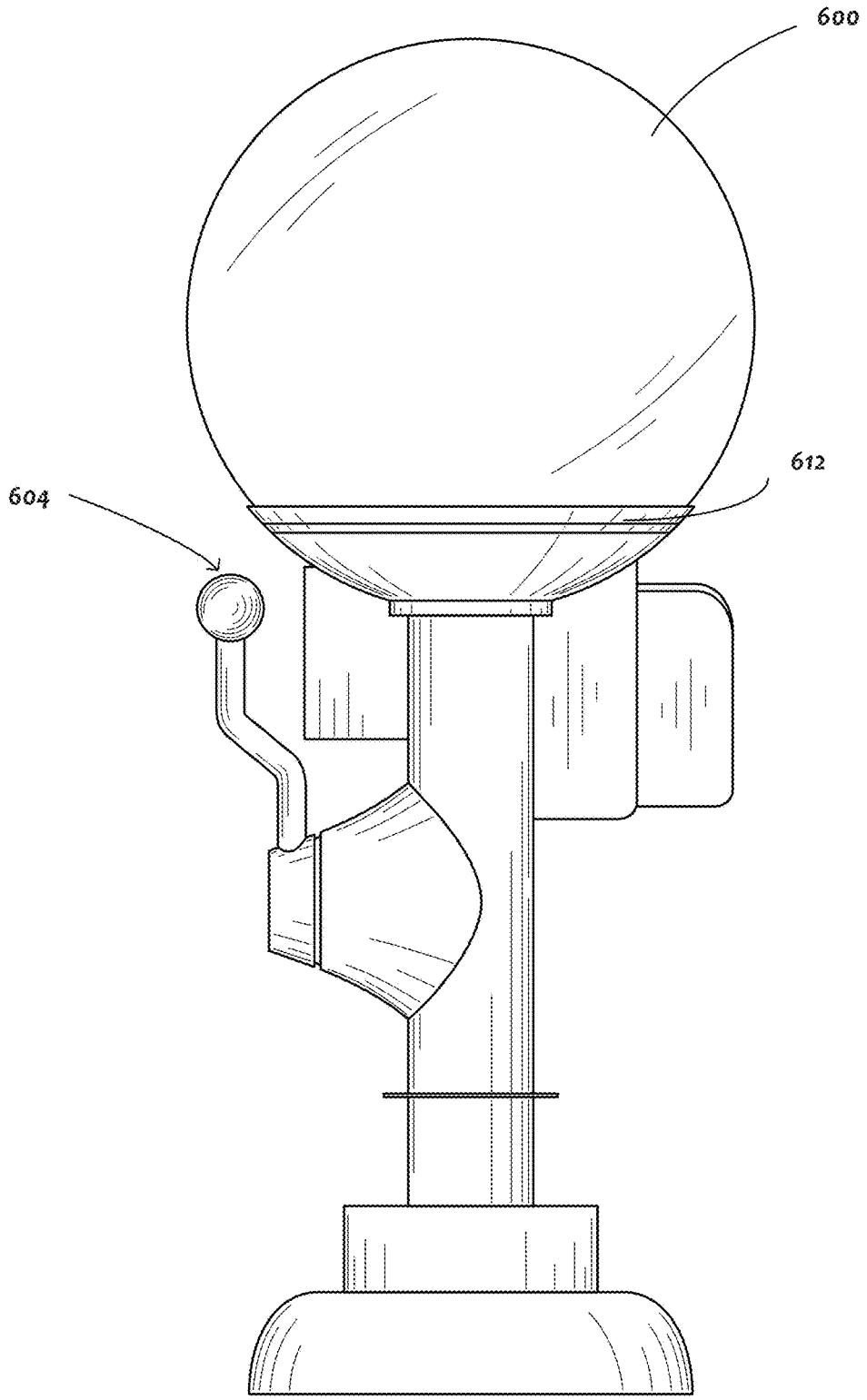
Figure 6D:
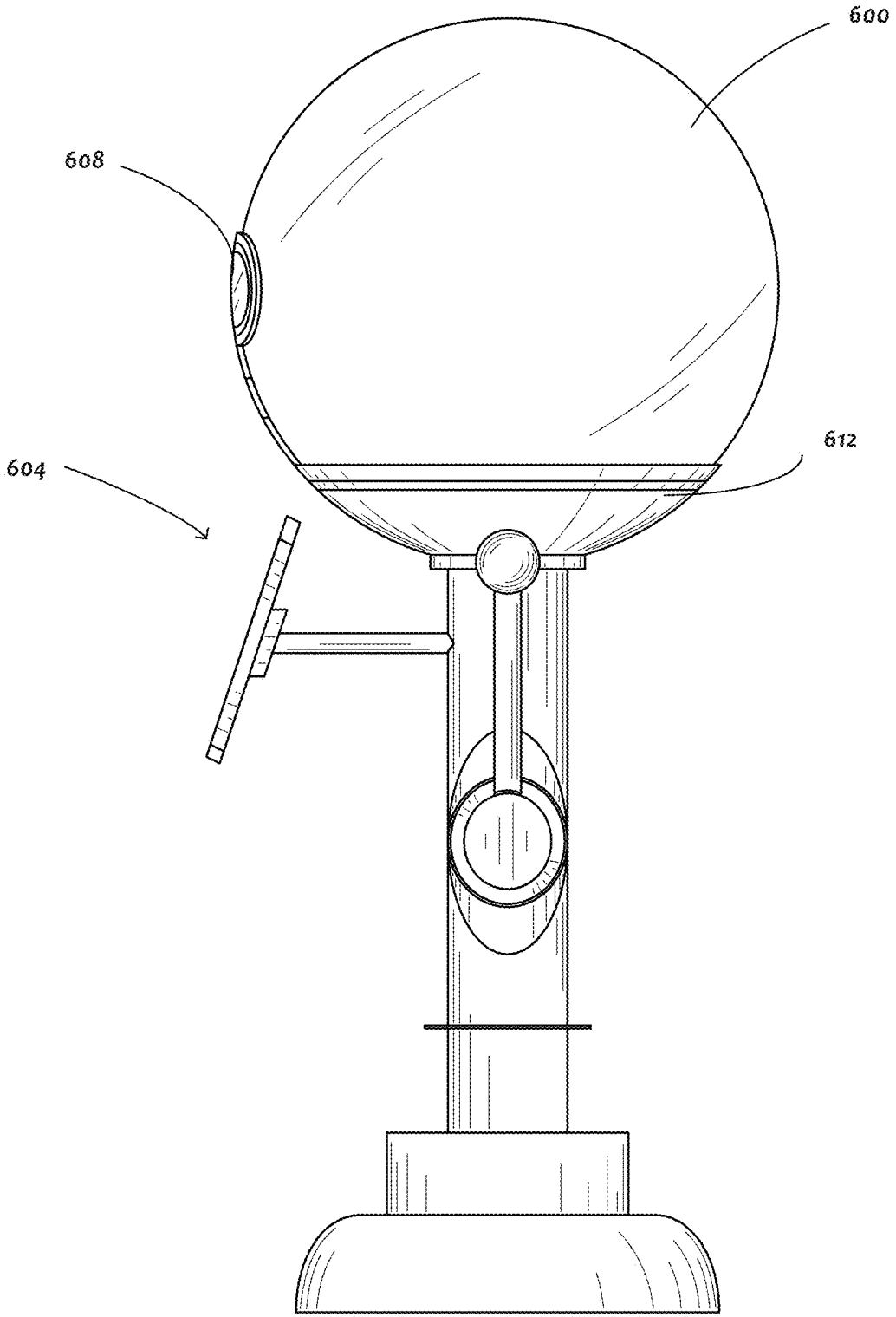
Figure 6E:
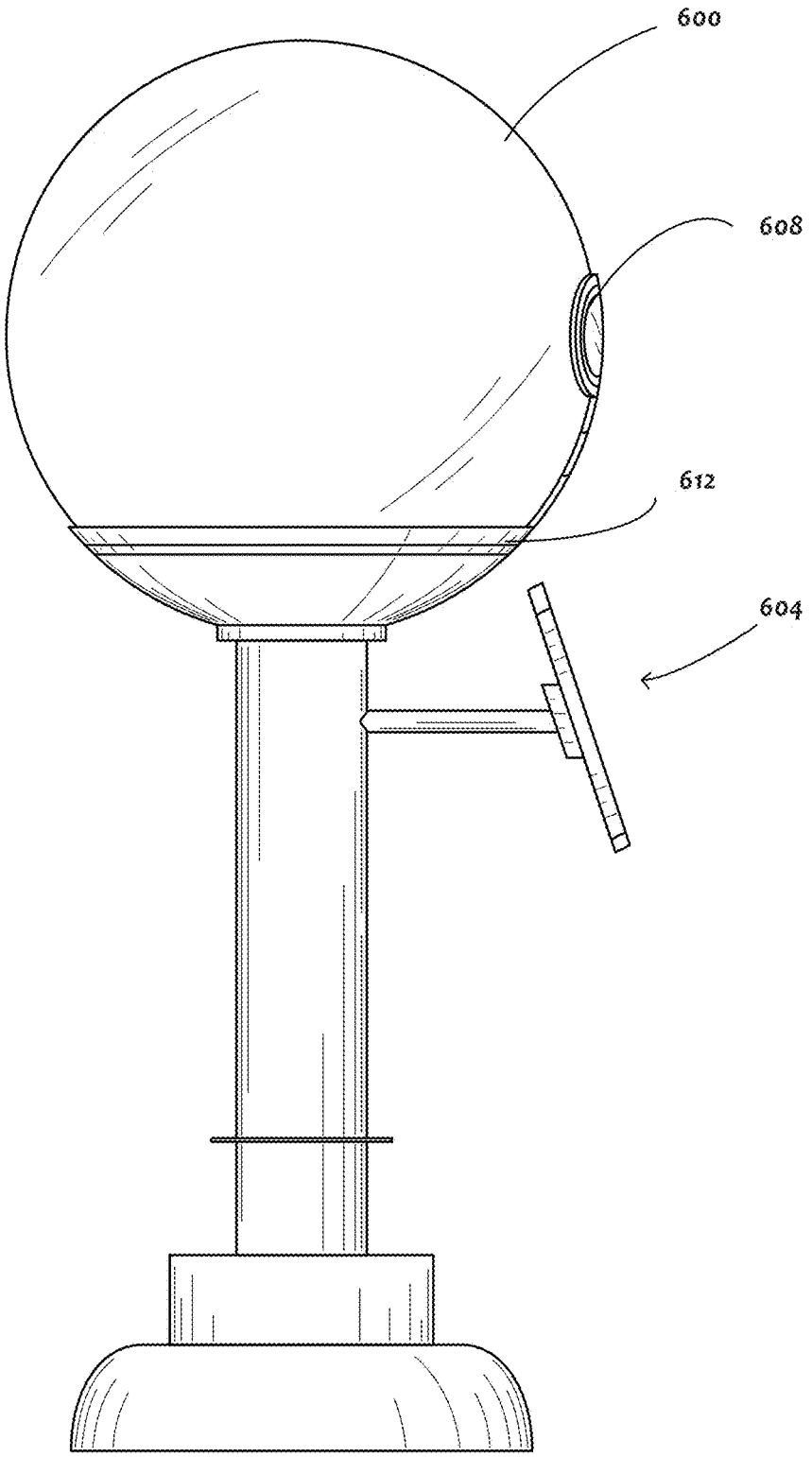
Figure 6F:
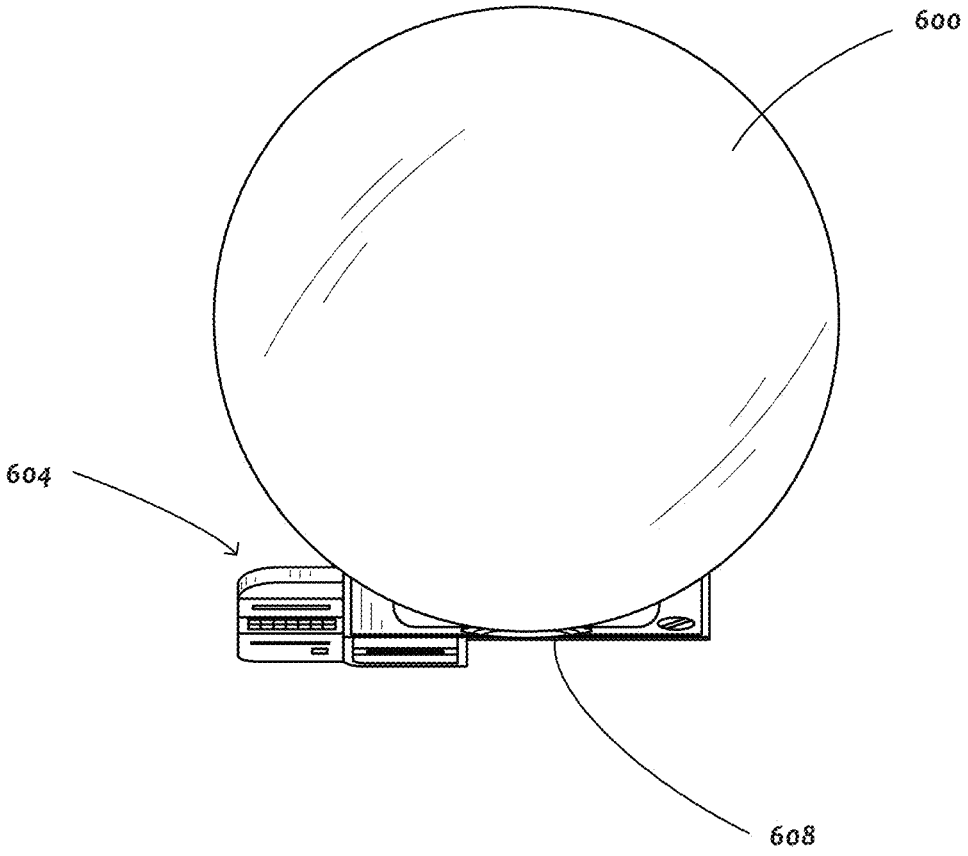
Figure 7A:
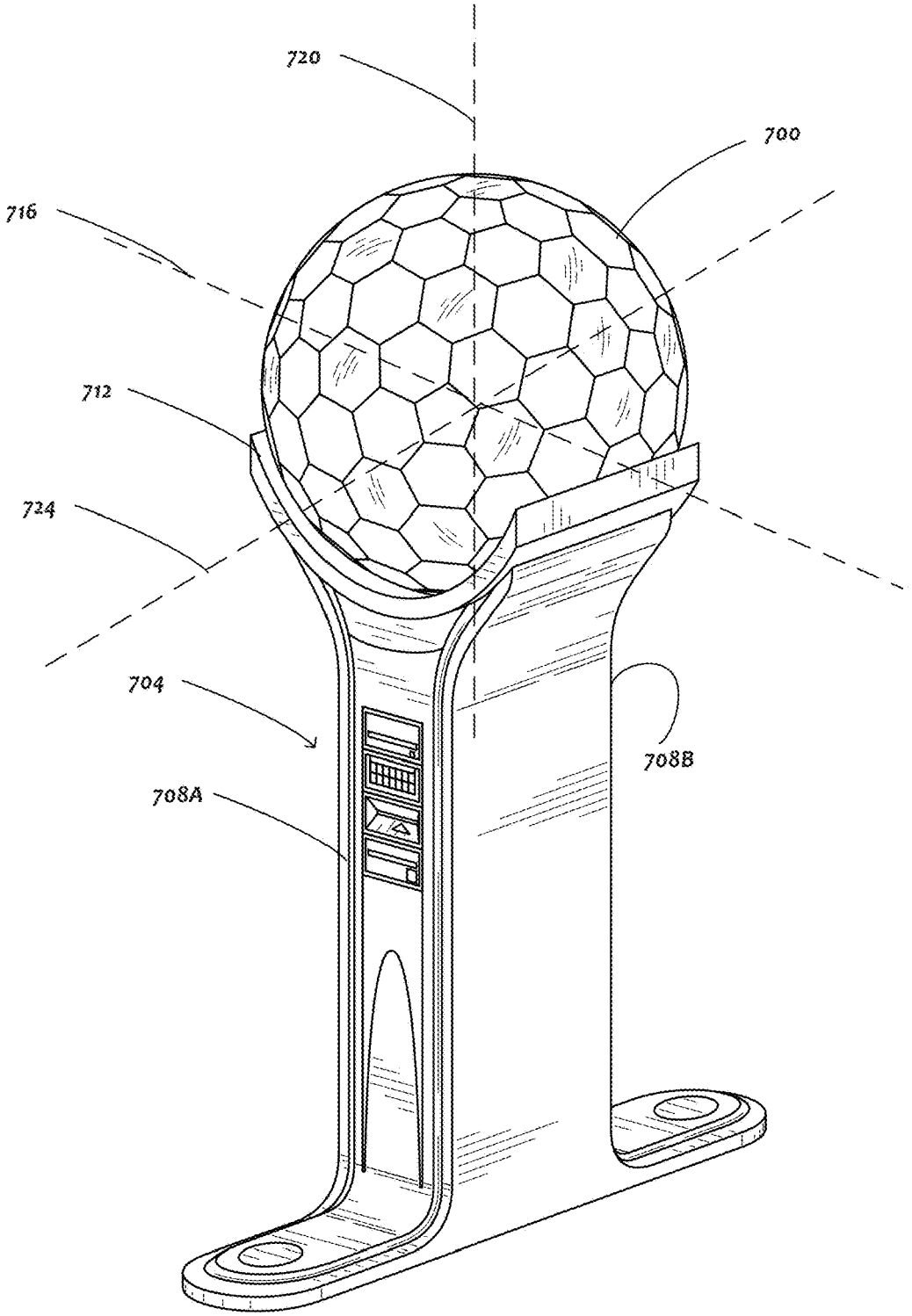
FIGS. 7A, 7B, 7C, 7D, 7E, and 7F illustrate different views of an embodiment of a fourth spinning sphere.
Figure 7B:
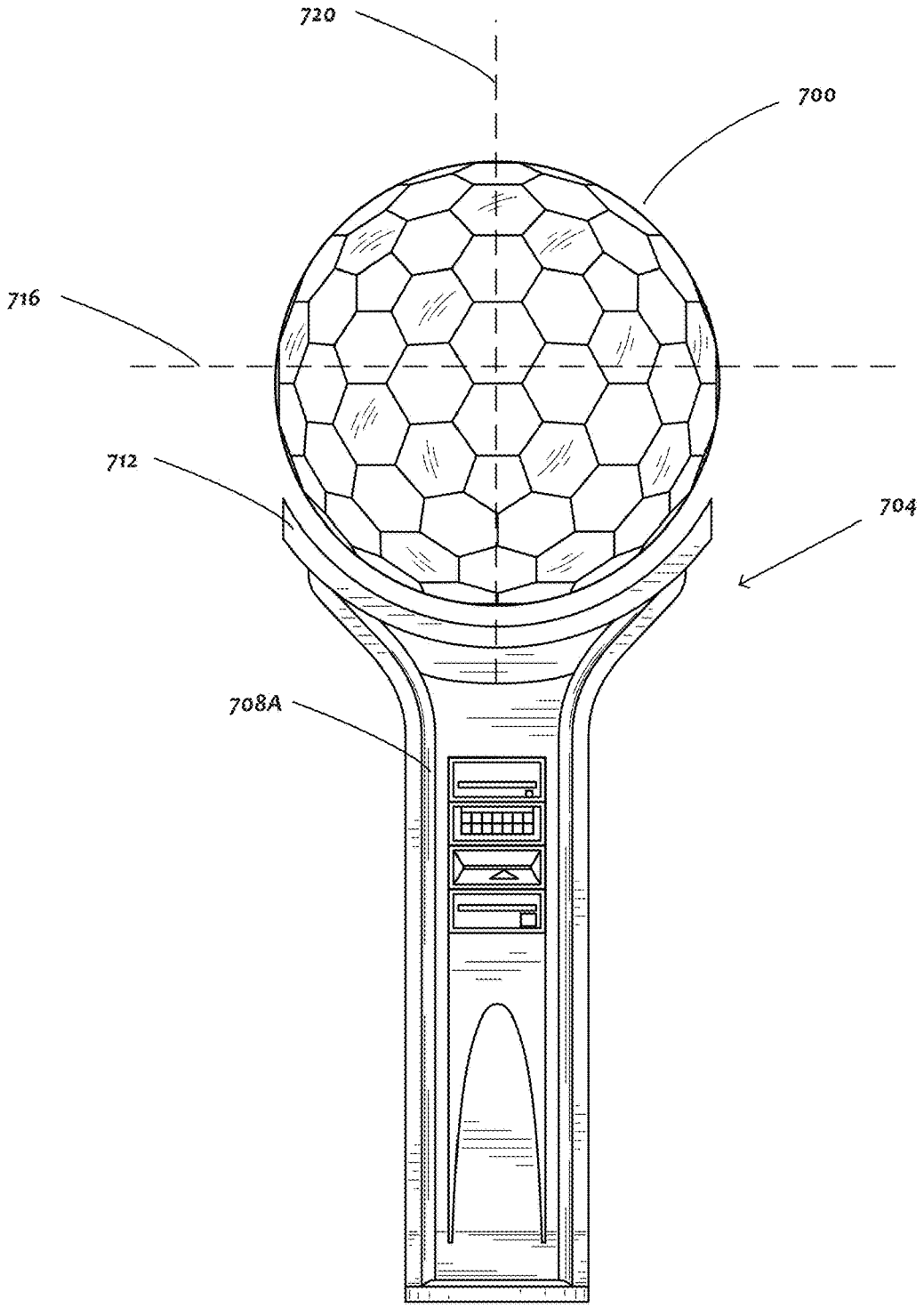
Figure 7C:
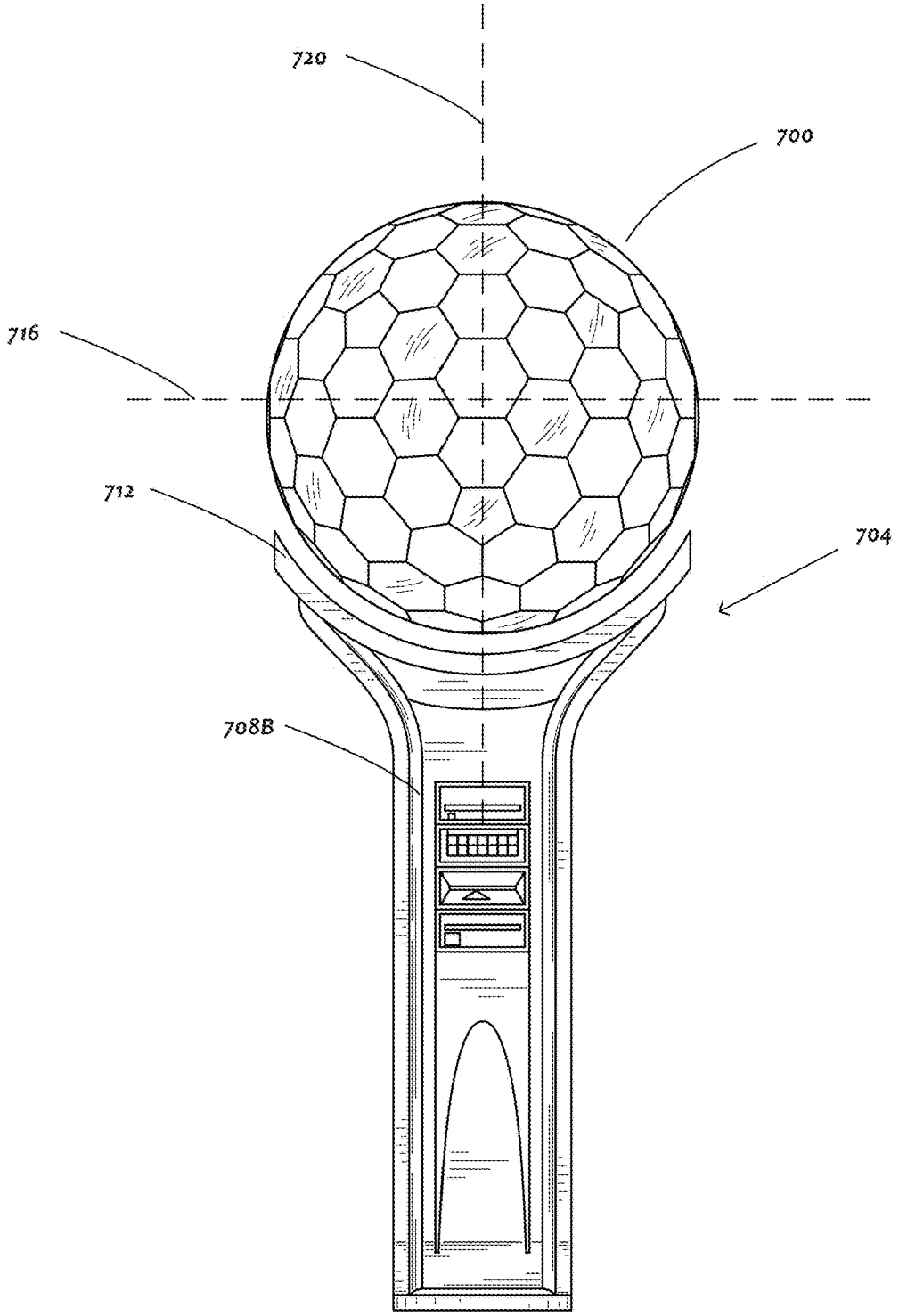
Figure 7D:
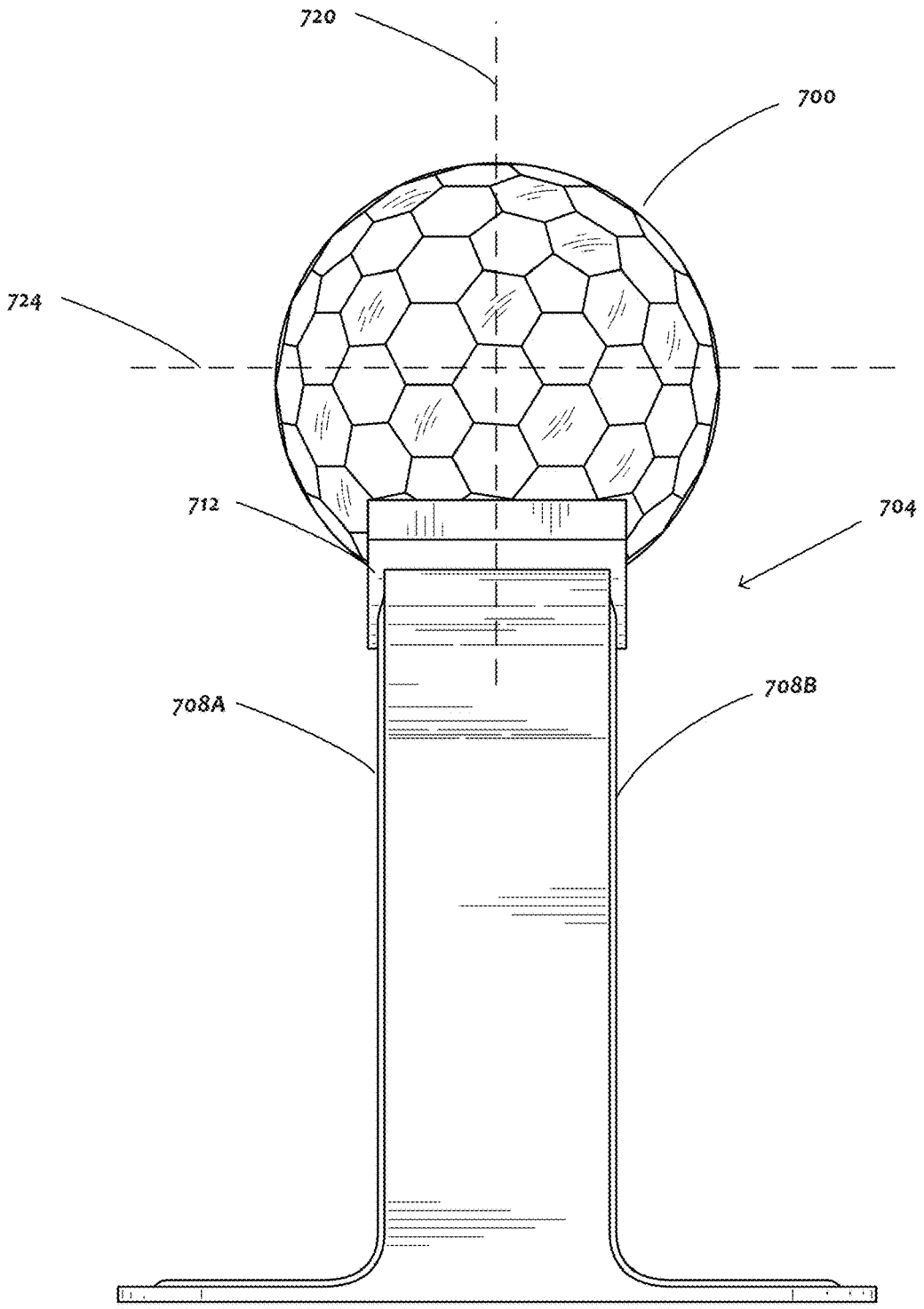
Figure 7E:
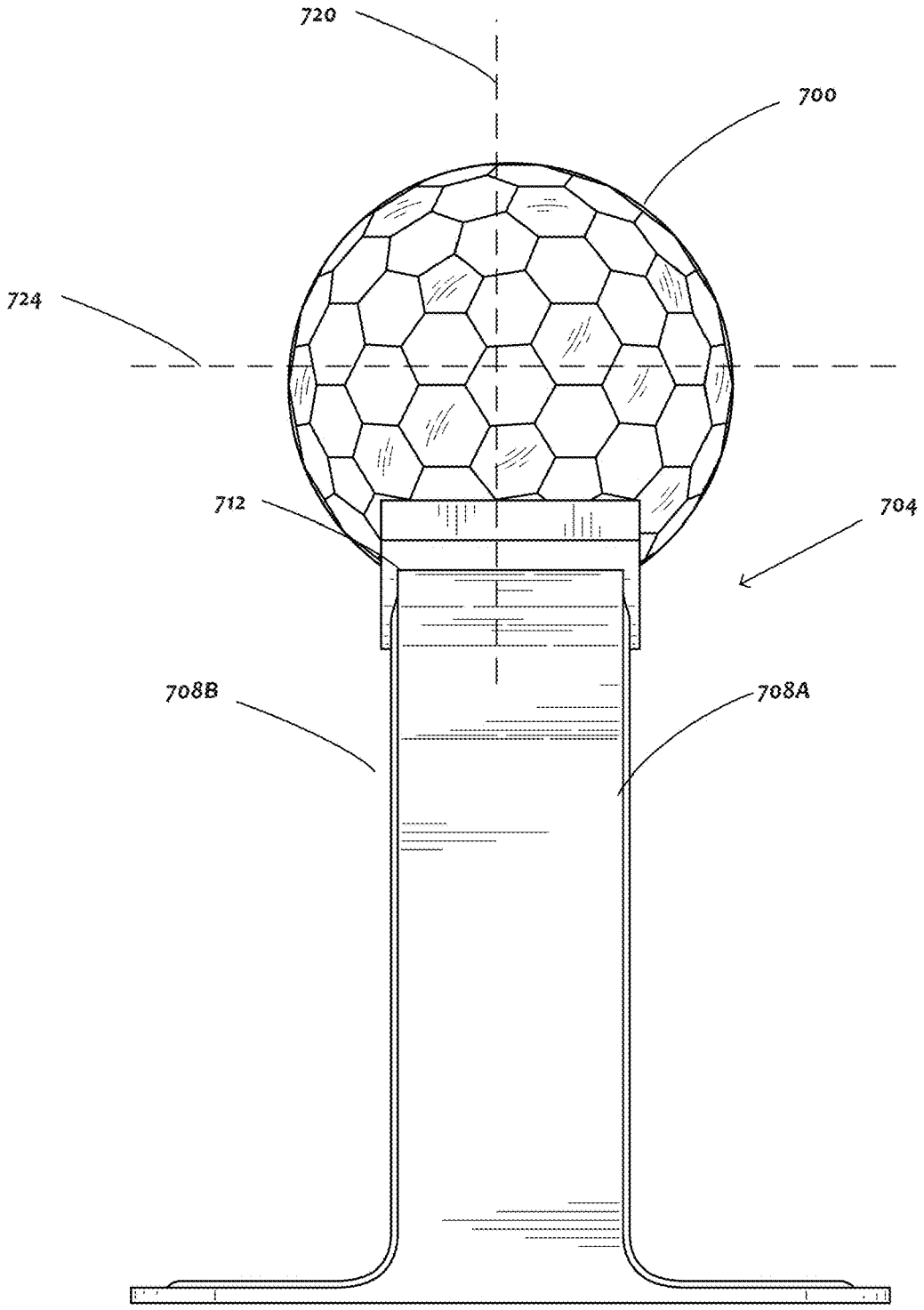
Figure 7F:
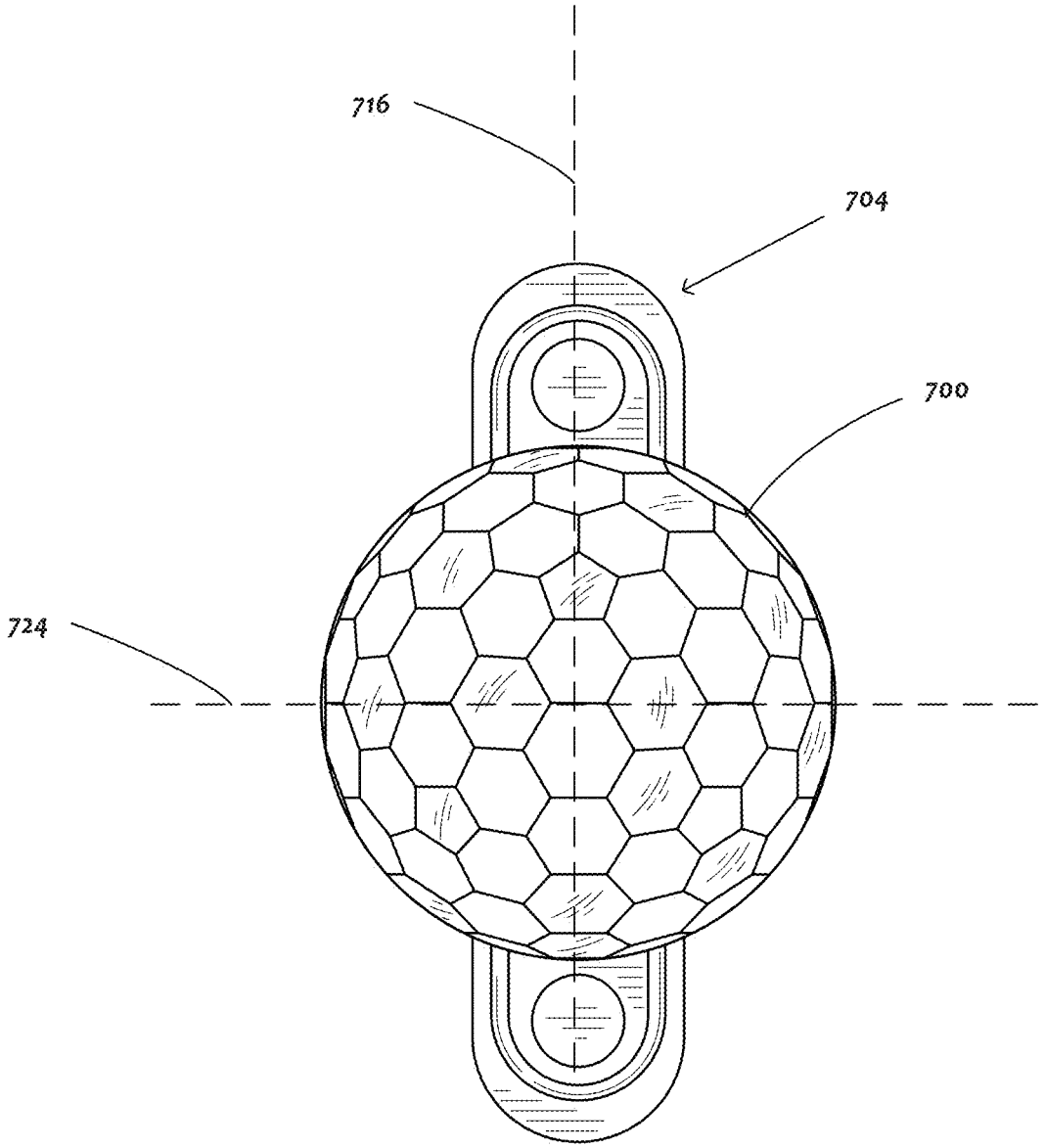

Similar to the multi-player station 504 of FIG. 5A, the fifth multi-player station 804 may include a plurality of stepper motors, or other types of motors, with rotating elements embedded in the base 812. The plurality of stepper motors may be actuated to spin the fifth spinning sphere 800, for example, when a special event occurs. The plurality of stepper motors may control the fifth spinning sphere 800 to incrementally to move, e.g., spin vertically (with respect to horizontal axis 816), horizontally (with respect to vertical axis 820), and/or diagonally (with respect to both horizontal axis 816 and vertical axis 820). For example, when individually actuated, the fifth spinning sphere 800 may spin about the vertical axis 820. Conversely, when individually actuated, the fifth spinning sphere 800 may spin at least about the horizontal axis 816.

Figure 9A:
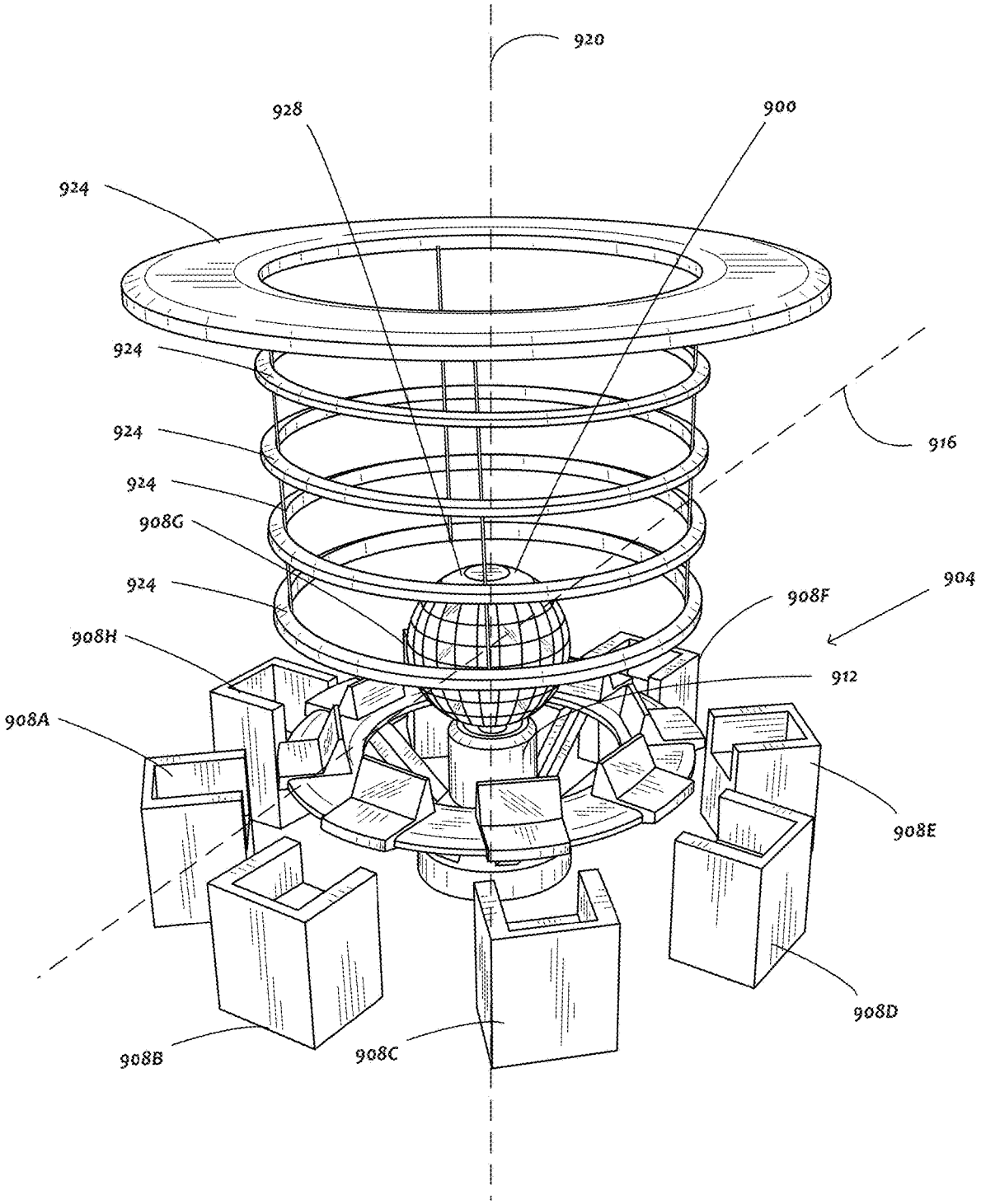
FIGS. 9A, 9B, and 9C illustrate different views of an embodiment of a sixth spinning sphere.
Figure 9B:
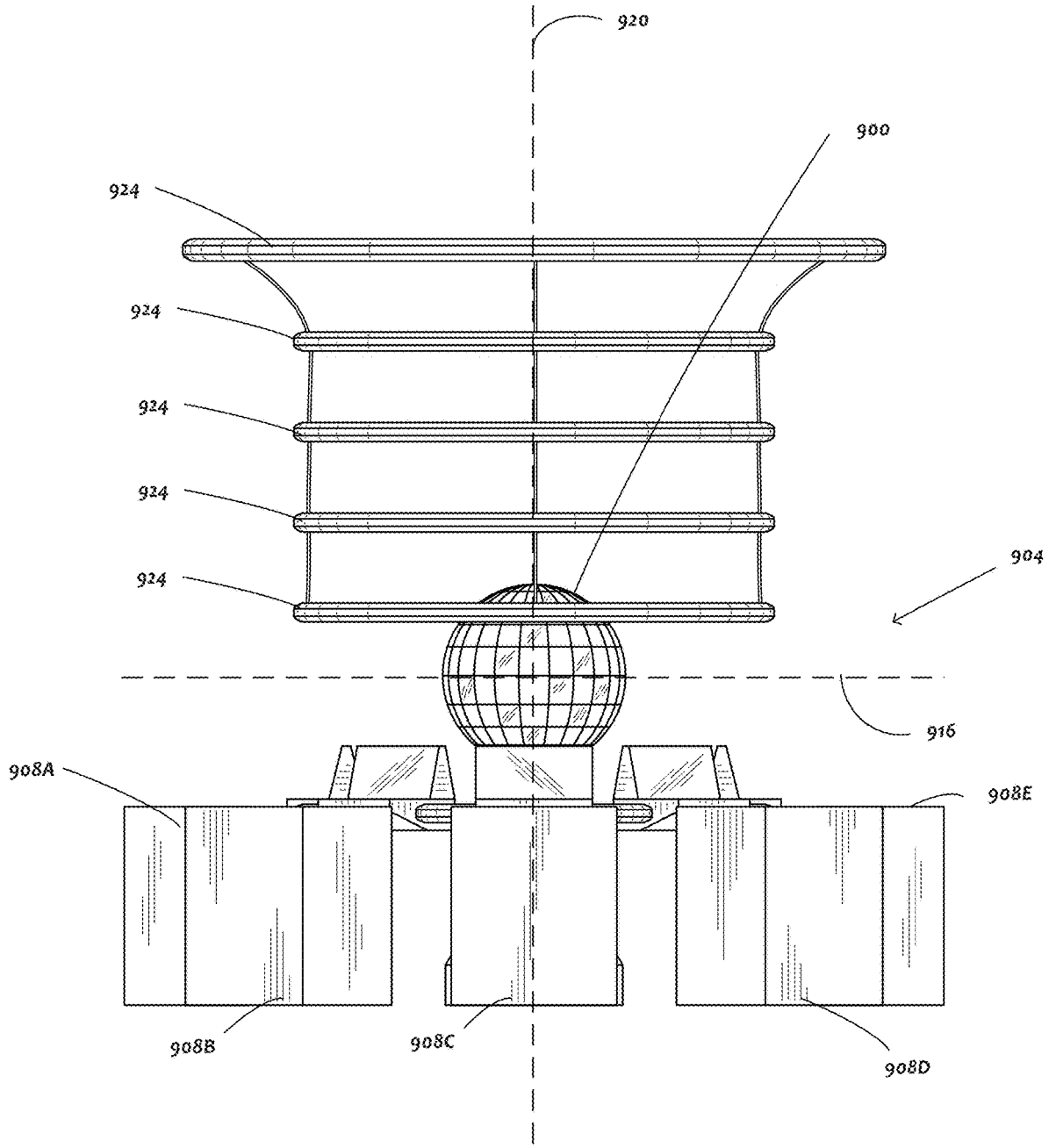
Figure 9C:
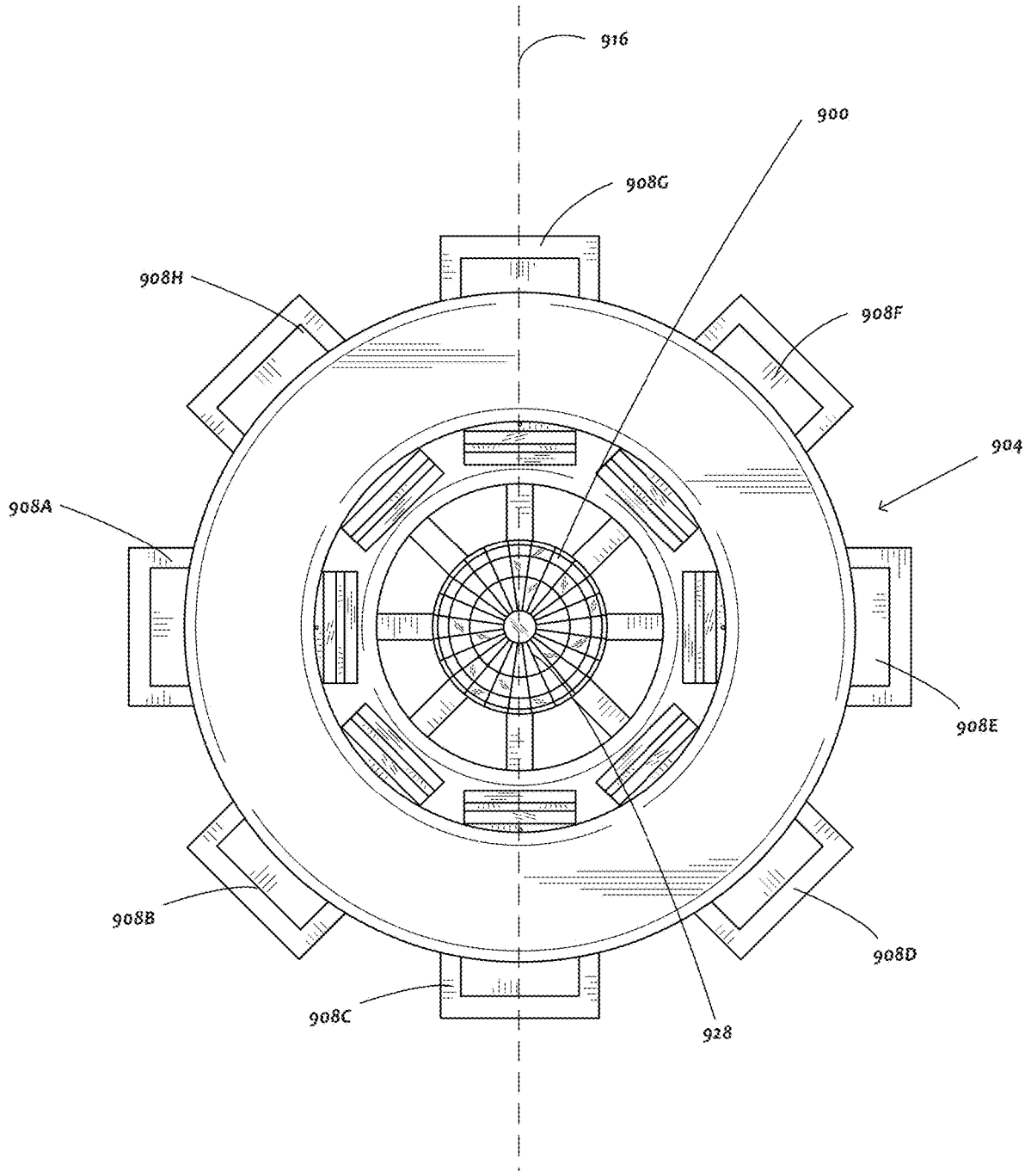
Figure 10A:
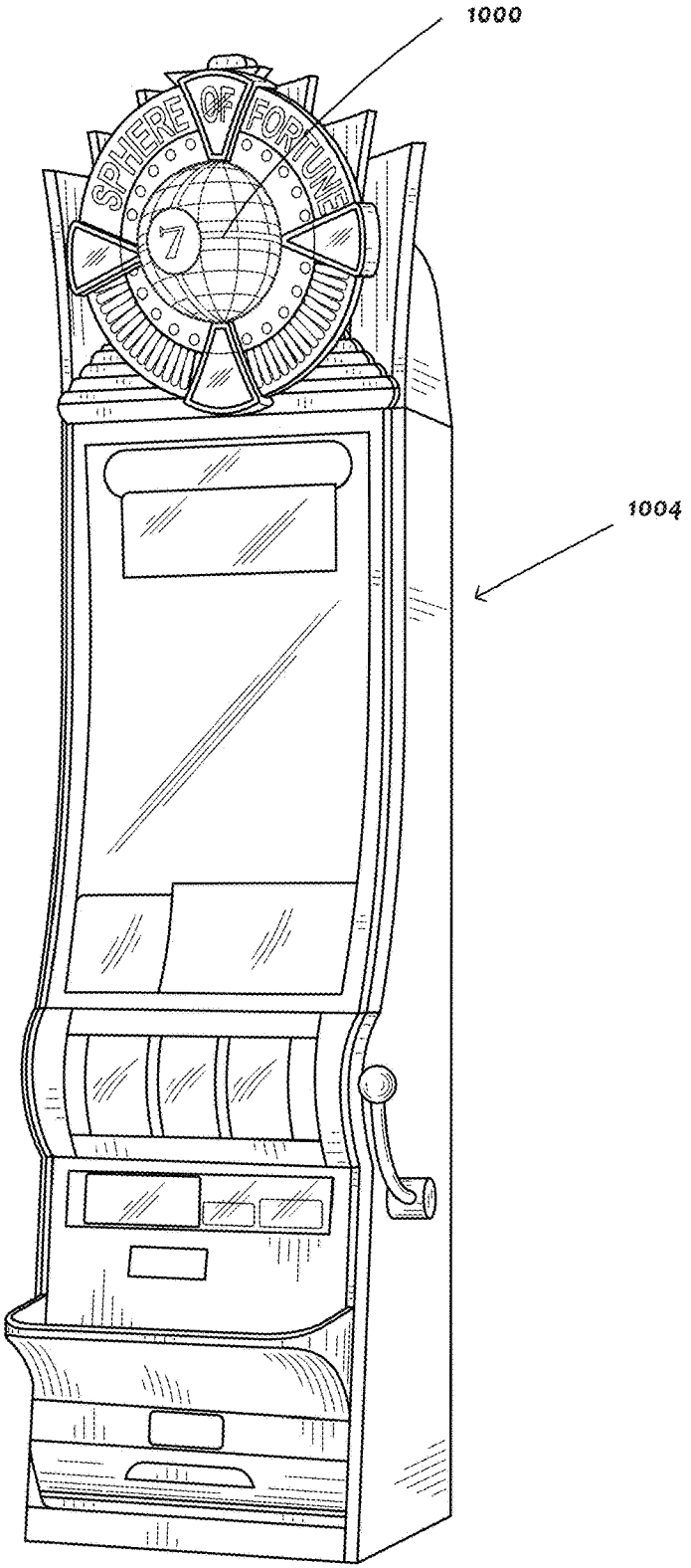
FIGS. 10A, 10B, 10C, 10D, 10E, and 10F illustrate different views of an embodiment of a seventh spinning sphere.
Figure 10B:
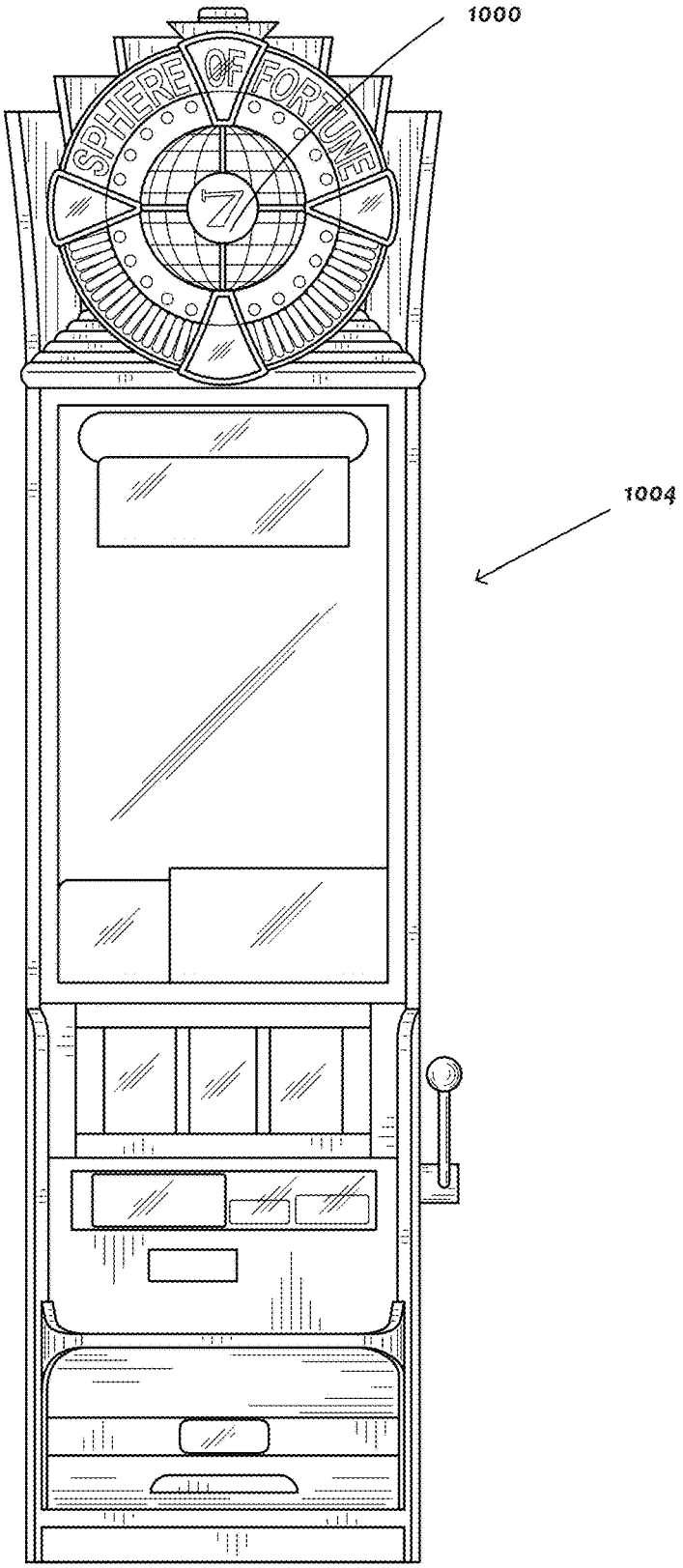
Figure 10C:
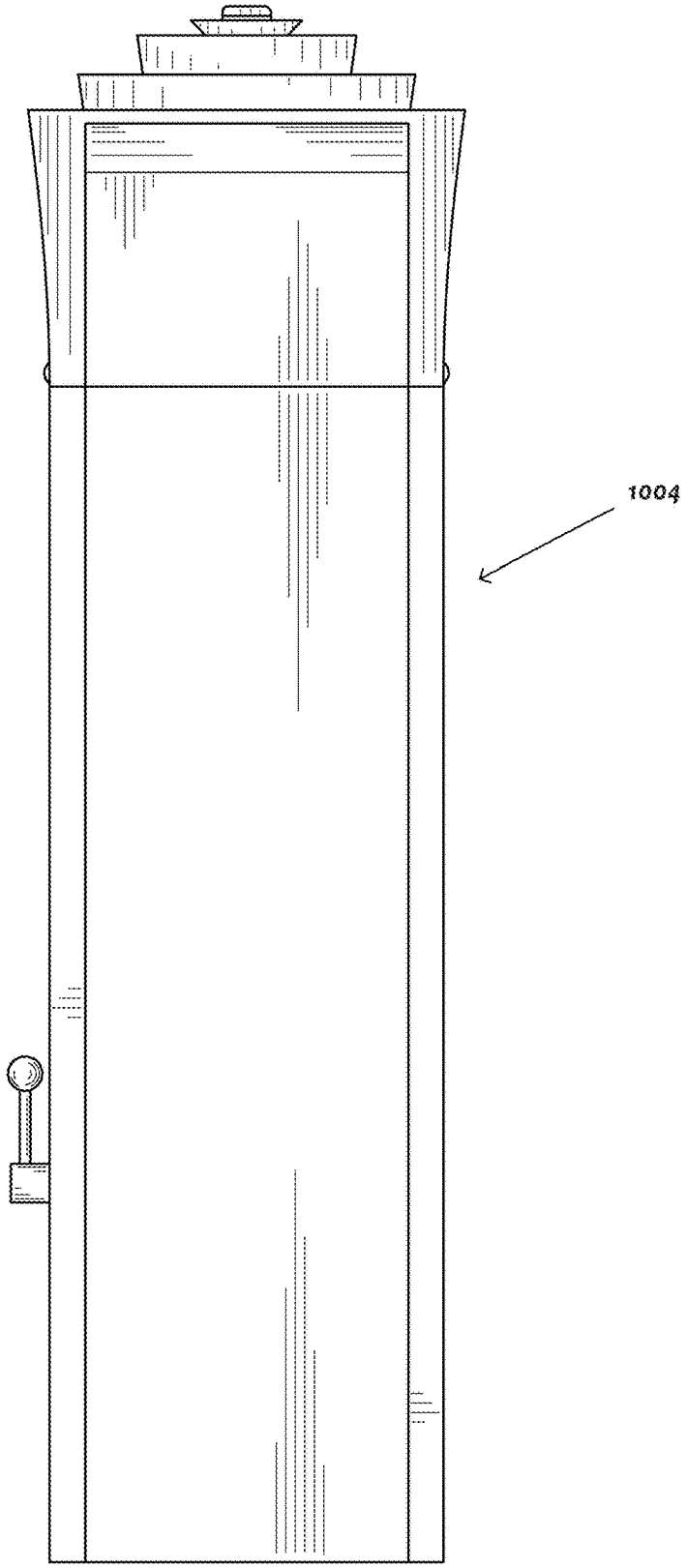
Figure 10D:
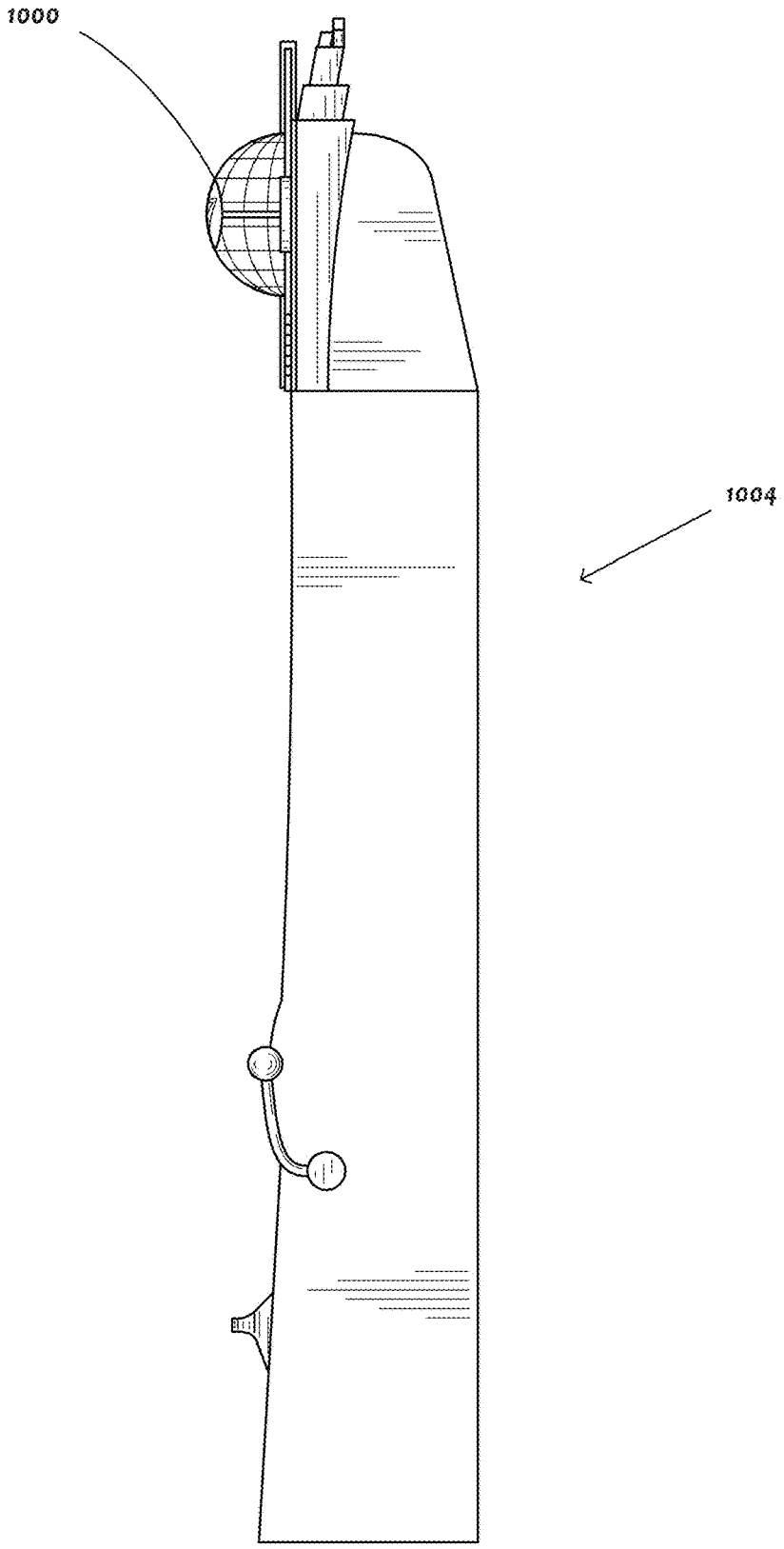
Figure 10E:
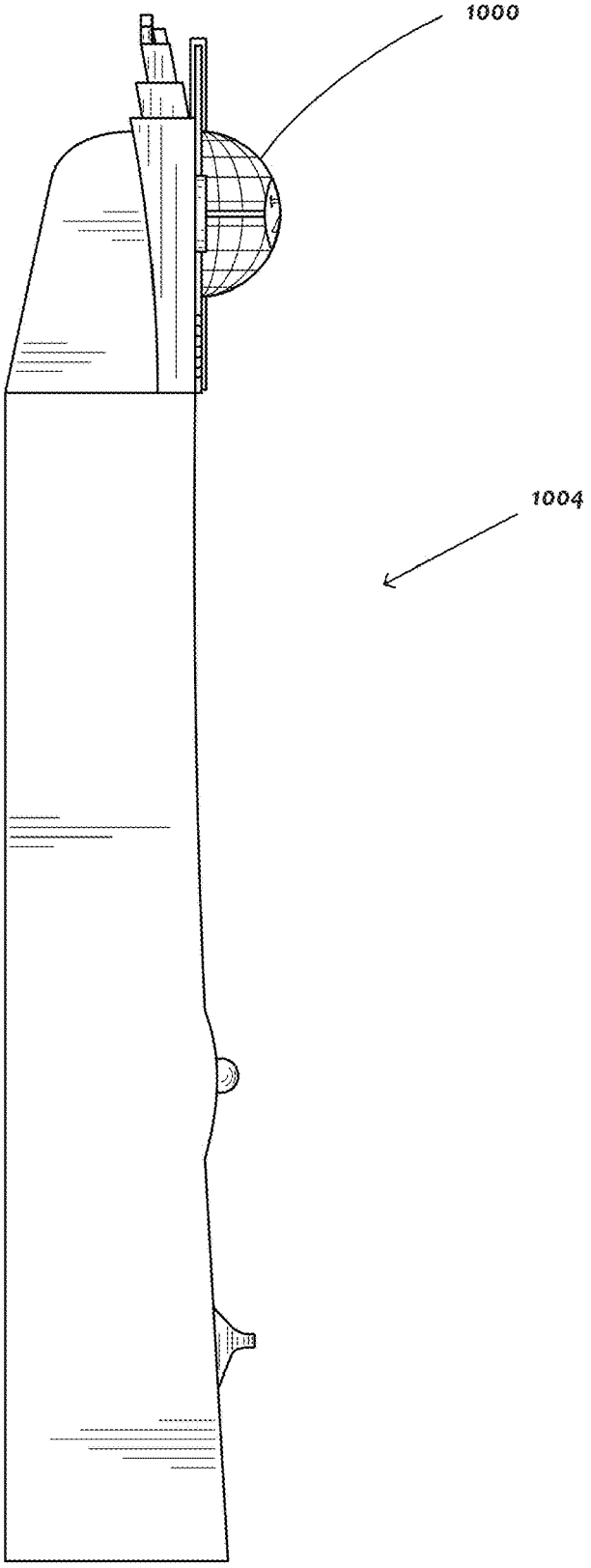
Figure 10F:
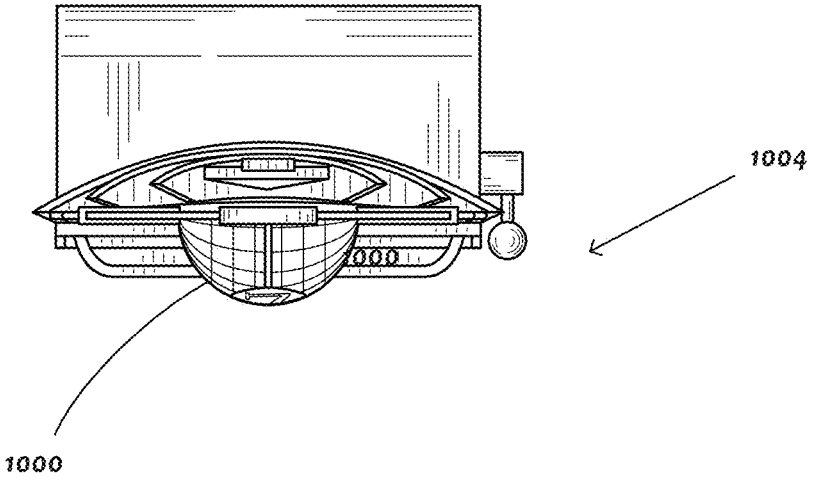

FIGS. 9A, 9B, and 9C illustrate different views of an embodiment of a sixth three-dimensional display device 900. As shown, the sixth spinning sphere 900 is a sixth communal topper display among a sixth multi-player station 904 having eight gaming devices 908A, 908B, 908C, 908D, 908E, 908F, 908G, 908H. The multi-player station 904 also includes a sixth base 912 that supports the sixth spinning sphere 900. In some cases, the sixth spinning sphere 900 may be levitatable in relation to the sixth base 912. In other cases, the sixth spinning sphere 900 may not be levitatable.

The sixth multi-player station 904 may include a plurality of stepper motors, or other types of motors, with rotating elements embedded in the sixth base 912. The plurality of stepper motors may be actuated to spin the sixth spinning sphere 900, for example, when a special event occurs. The plurality of stepper motors may control the sixth spinning sphere 900 to incrementally to move, e.g., spin vertically (in relation to horizontal axis 916), horizontally (in relation vertical axis 920), and/or diagonally (in relation both horizontal axis 916 and vertical axis 920). For example, when individually actuated, the sixth spinning sphere 900 may spin about the vertical axis 920. Conversely, when individually actuated, the sixth spinning sphere 900 may spin at least about the horizontal axis 916.

The sixth multi-player station 904 also includes a plurality of levitatable or suspendable rings 924. In some embodiments, the levitatable rings 924 may typically be stacked, and loosely or completely hide the sixth spinning sphere 900 therein. However, the levitatable rings 924 may be levitated when a triggering event occurs. For example, when a base game being played at the gaming device 908A results in a winning outcome, the rings 924 may be levitated to reveal the sixth spinning sphere 900. After the rings 924 have levitated, the sixth spinning sphere 900 may first tilt, for example, toward the gaming device 908A when the triggering event occurs at the gaming device 908A such that a special wheel 928 may be viewed by a player at the gaming device 908A. When the special wheel 928 has been tilted and directly faces the player the gaming device 908A, the plurality of stepper motors, or other types of motors. with rotating elements may be energized such that the sixth spinning sphere 900 and thus the special wheel 928 may rotate with respect to the gaming device 908A to reveal one or more prizes for the gaming device 908A. Of course, in other embodiments, the sixth spinning sphere 900 may also incrementally move, e.g., spin vertically (in relation to horizontal axis 916), horizontally (in relation to vertical axis 920), and/or diagonally (in relation to both horizontal axis 916 and vertical axis 920) without tilting the special wheel 928 toward the player at the gaming device 908A.

FIGS. 10A, 10B, 10C, 10D, 10E, and 10F illustrate different views of an embodiment of a seventh three-dimensional display device 1000. As shown, the seventh spinning sphere 1000 is a communal topper display among a seventh single-player gaming device 1004. The seventh spinning sphere 1000 spins vertically, horizontally, and/or diagonally, in response to, for example, a trigger event. As shown, only a portion of the seventh spinning sphere 1000 is viewable.

Figure 11A:
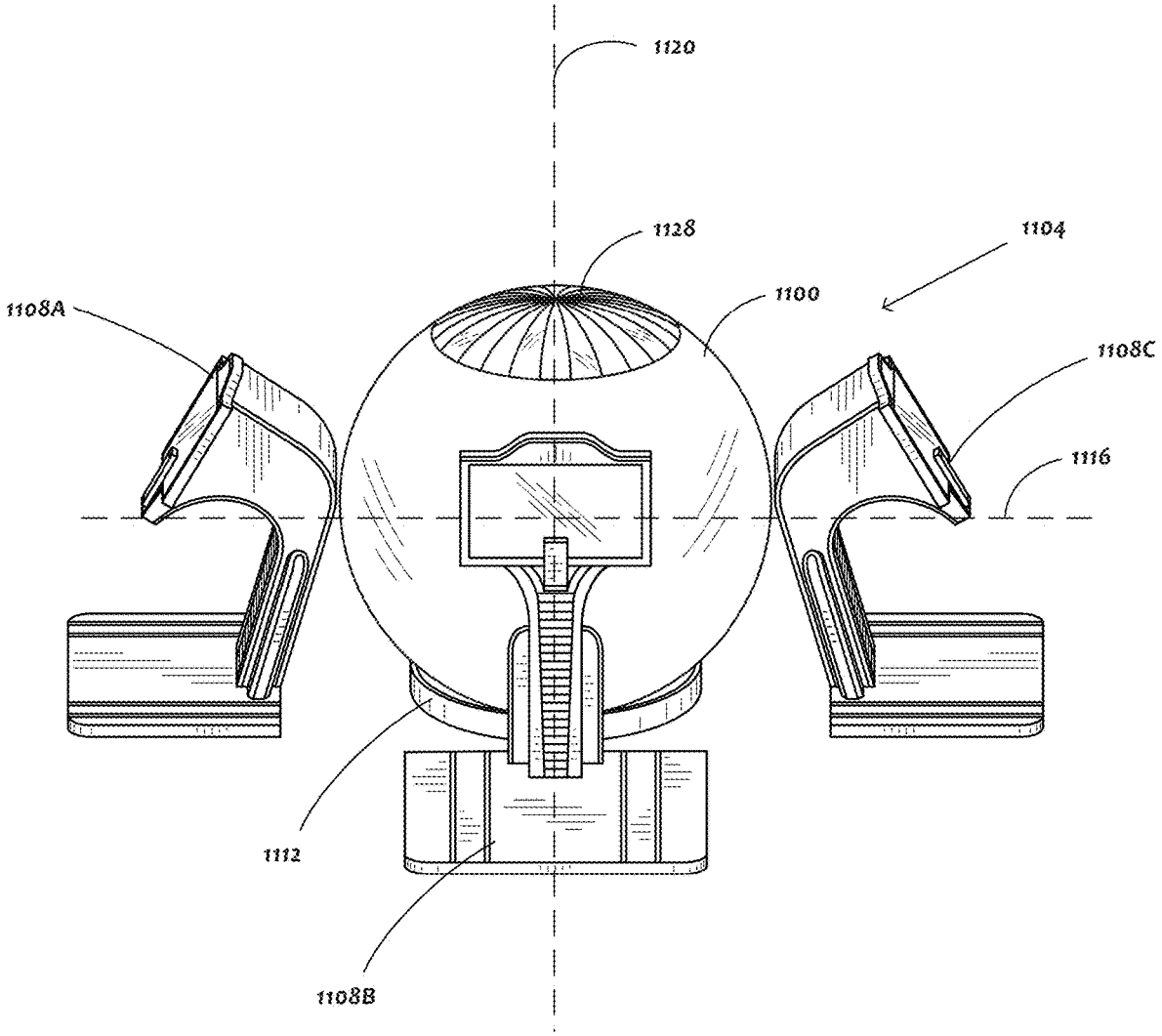
FIGS. 11A, 11B, and 11C illustrate different views of an embodiment of an eighth spinning sphere.
Figure 11B:
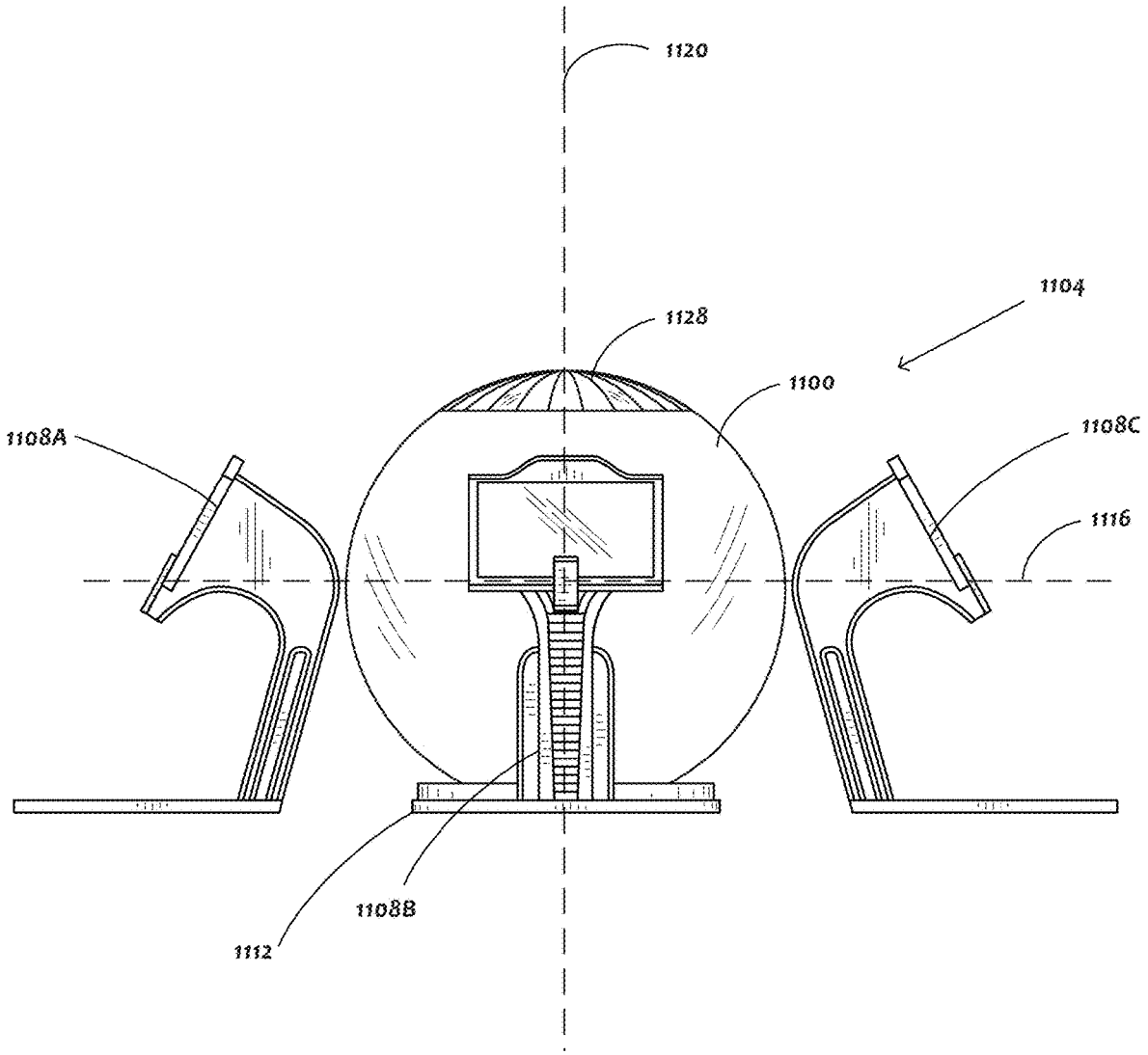
Figure 11C:
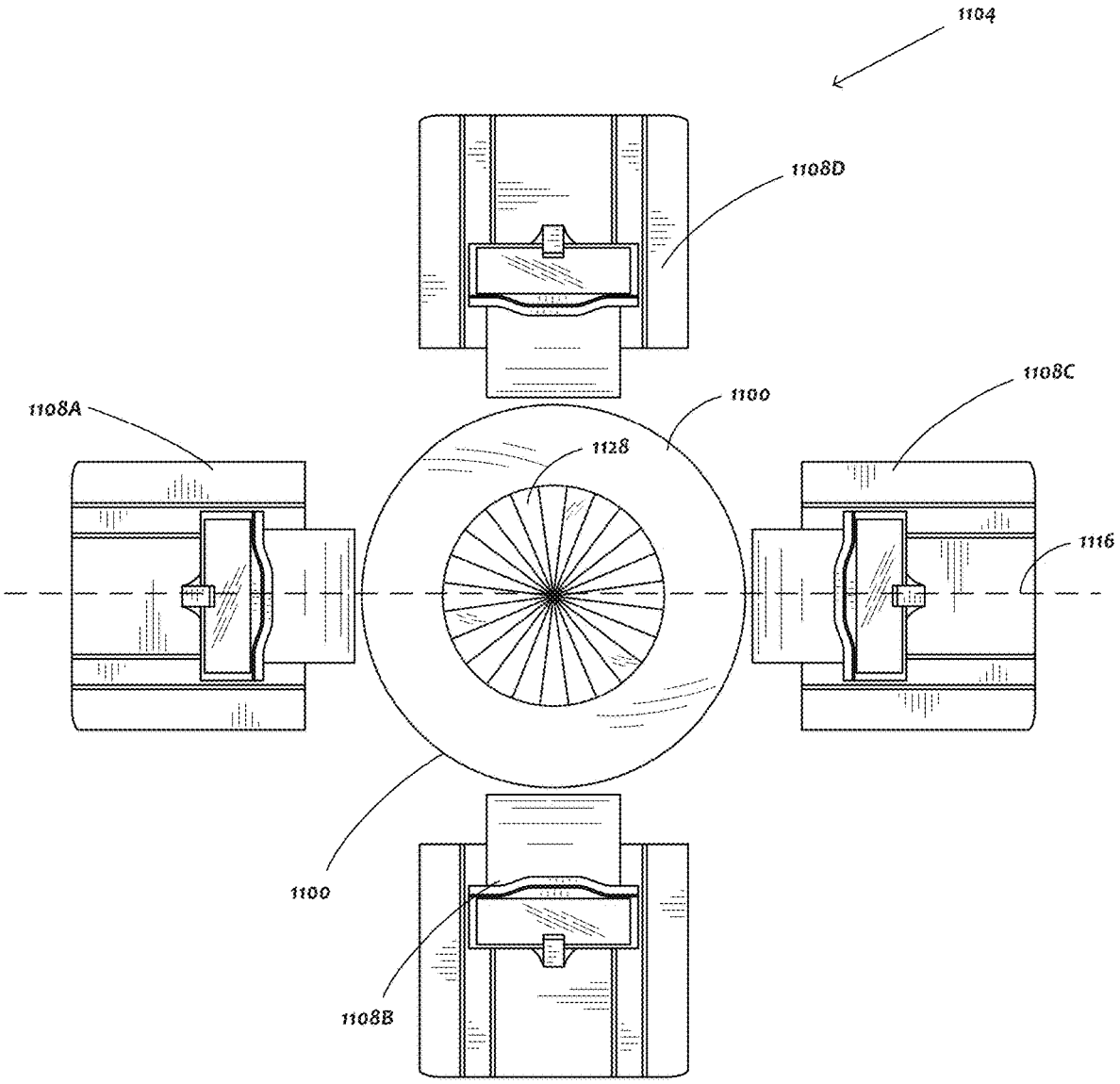

FIGS. 11A, 11B, and 11C illustrate different views of an embodiment of an eighth three-dimensional display device 1100. As shown, the eighth spinning sphere 1100 is an eighth communal topper display among an eighth multi-player station 1104 having four gaming devices 1108A, 1108B, 1108C, 1108D. The eighth multi-player station 1104 also includes an eighth base 1112 that supports the eighth spinning sphere 1100. In some cases, the eighth spinning sphere 1100 may be levitatable with respect to the eighth base 1112.

The eighth base 1112 may include a plurality of stepper motors, or other types of motors. with rotating elements to spin the eighth three-dimensional display device 1100, for example, when a special event occurs. The plurality of stepper motors may control the eighth spinning sphere 1100 to incrementally to move, e.g., spin vertically (with respect to horizontal axis 1116), horizontally (with respect to vertical axis 1120), and/or diagonally (with respect to both horizontal axis 1116 and vertical axis 1120). For example, when individually actuated, the eighth spinning sphere 1100 may spin about the vertical axis 1120. Conversely, when individually actuated, the eighth spinning sphere 1100 may spin at least about the horizontal axis 1116.

The eighth multi-player station 1104 may tilt the eighth spinning sphere 1100 toward the gaming device 1108A when a triggering event occurs at the gaming device 1108A such that a special wheel 1128 may be viewed by a player at the gaming device 1108A. When the special wheel 1128 has been tilted and directly faces the player at the gaming device 1108A, the plurality of stepper motors, or other types of motors. with rotating elements may be energized such that the eighth spinning sphere 1100 and thus the special wheel 1128 may rotate in relation to the gaming device 1108A to reveal one or more prizes for the gaming device 1108A. Of course, in other embodiments, the eighth spinning sphere 1100 may also move, e.g., spin vertically (in relation to horizontal axis 1116), horizontally (in relation to vertical axis 1120), and/or diagonally (in relation to both horizontal axis 1116 and vertical axis 1120) without tilting the special wheel 1128 toward the player at the gaming device 908A.

Figure 12A:
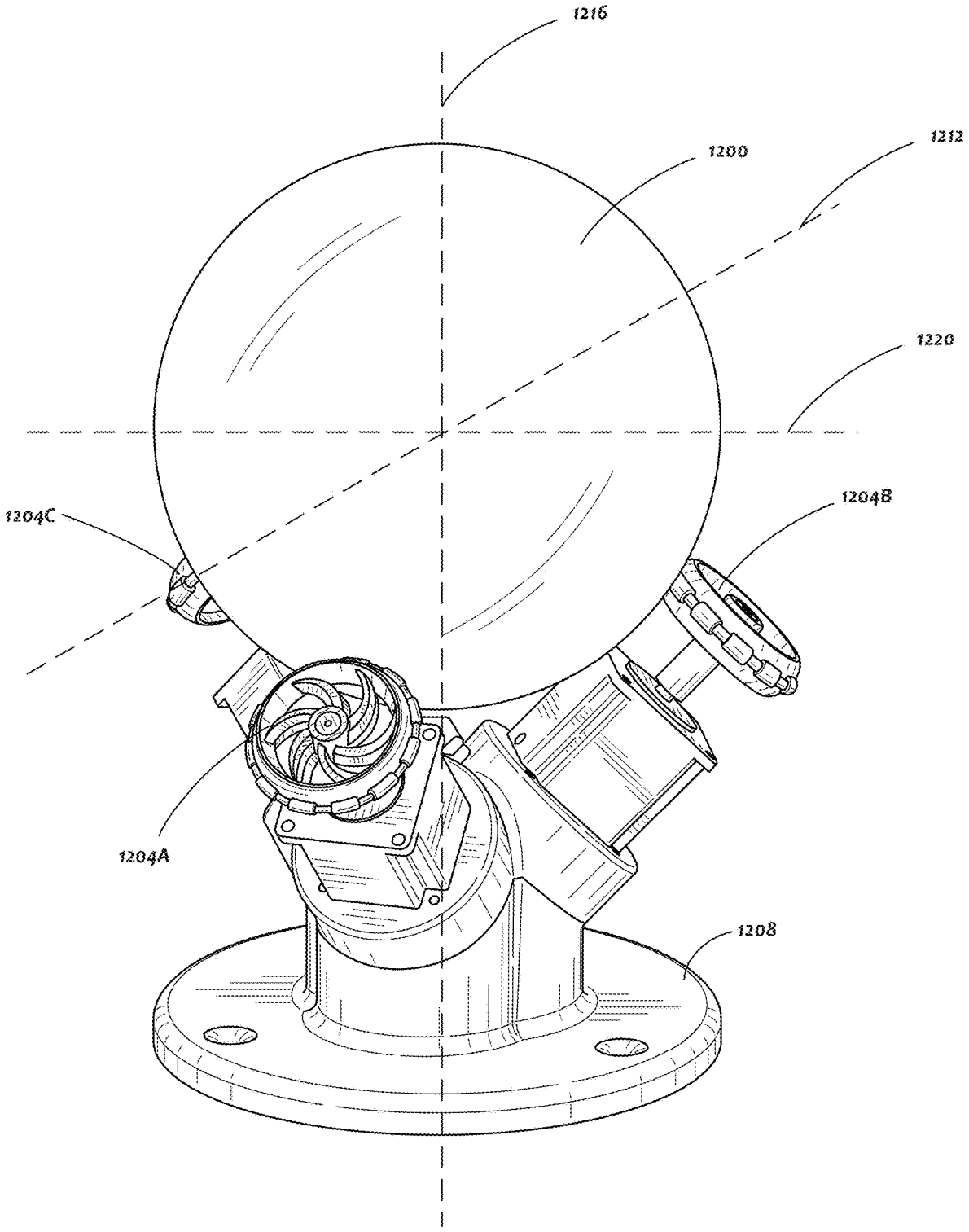
FIGS. 12A and 12B illustrate different views of an embodiment of a ninth spinning sphere.
Figure 12B:
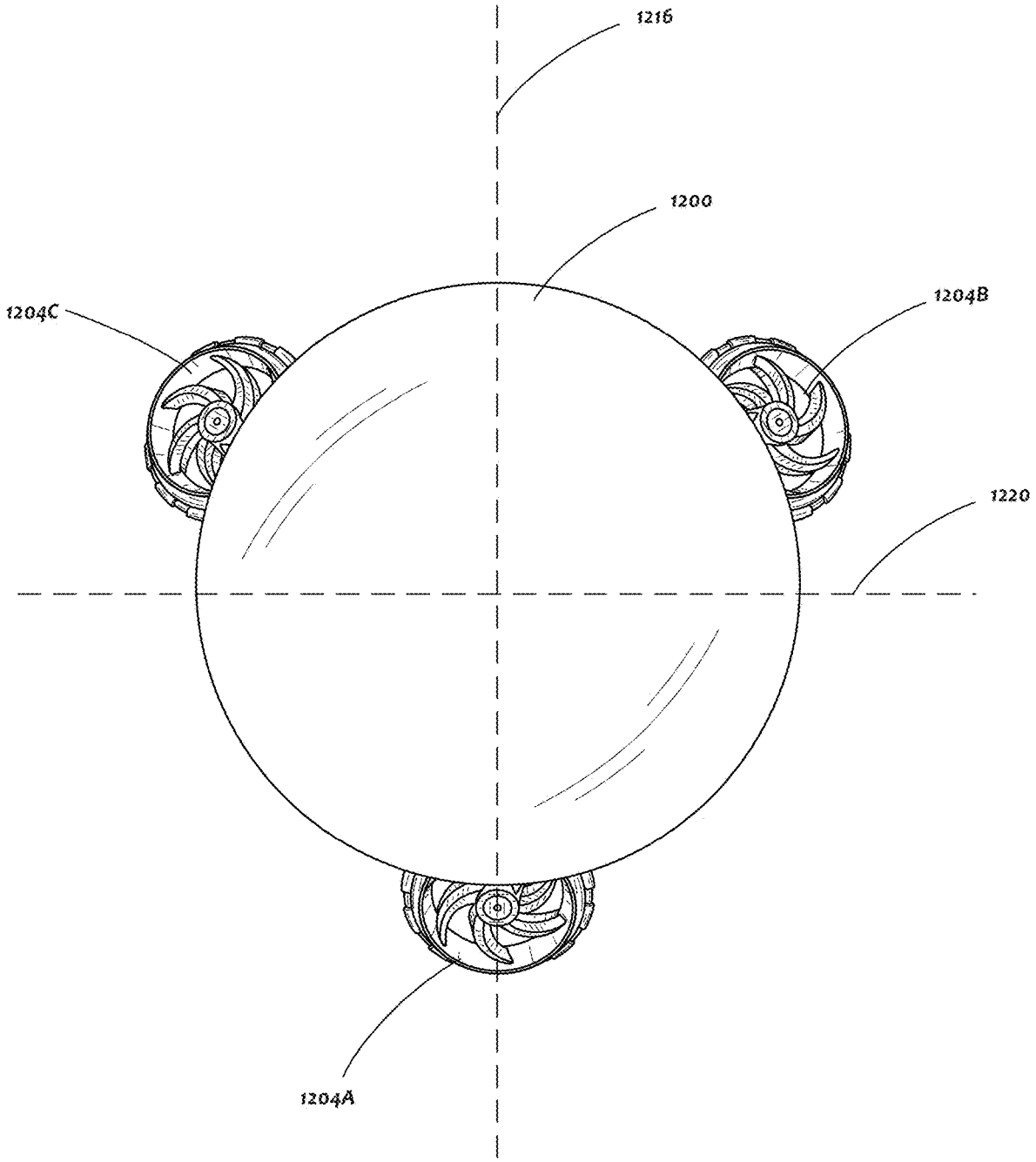

FIGS. 12A and 12B illustrate different views of an embodiment of a ninth three-dimensional display device 1200 supported by a plurality of rotating elements 1204A, 1204B, 1204C positioned on a ninth base 1208. In some embodiments, the rotating elements 1204A, 1204B, 1204C may be disposed in a multi-player station as stepping motors, or other types of motors, such as the first multi-player station 400 of FIG. 4A, for moving, e.g., spinning or tilting, the ninth spinning sphere 1200. When energized, rotating element 1204A may rotate the ninth spinning sphere 1200 with respect to vertical axis 1216. Similarly, when energized, rotating elements 1204B and 1204C may rotate the ninth spinning sphere 1200 with respect to a first horizontal axis 1212 in a first direction, or with respect to a second horizontal axis 1220 in a second direction.

Figure 13A:
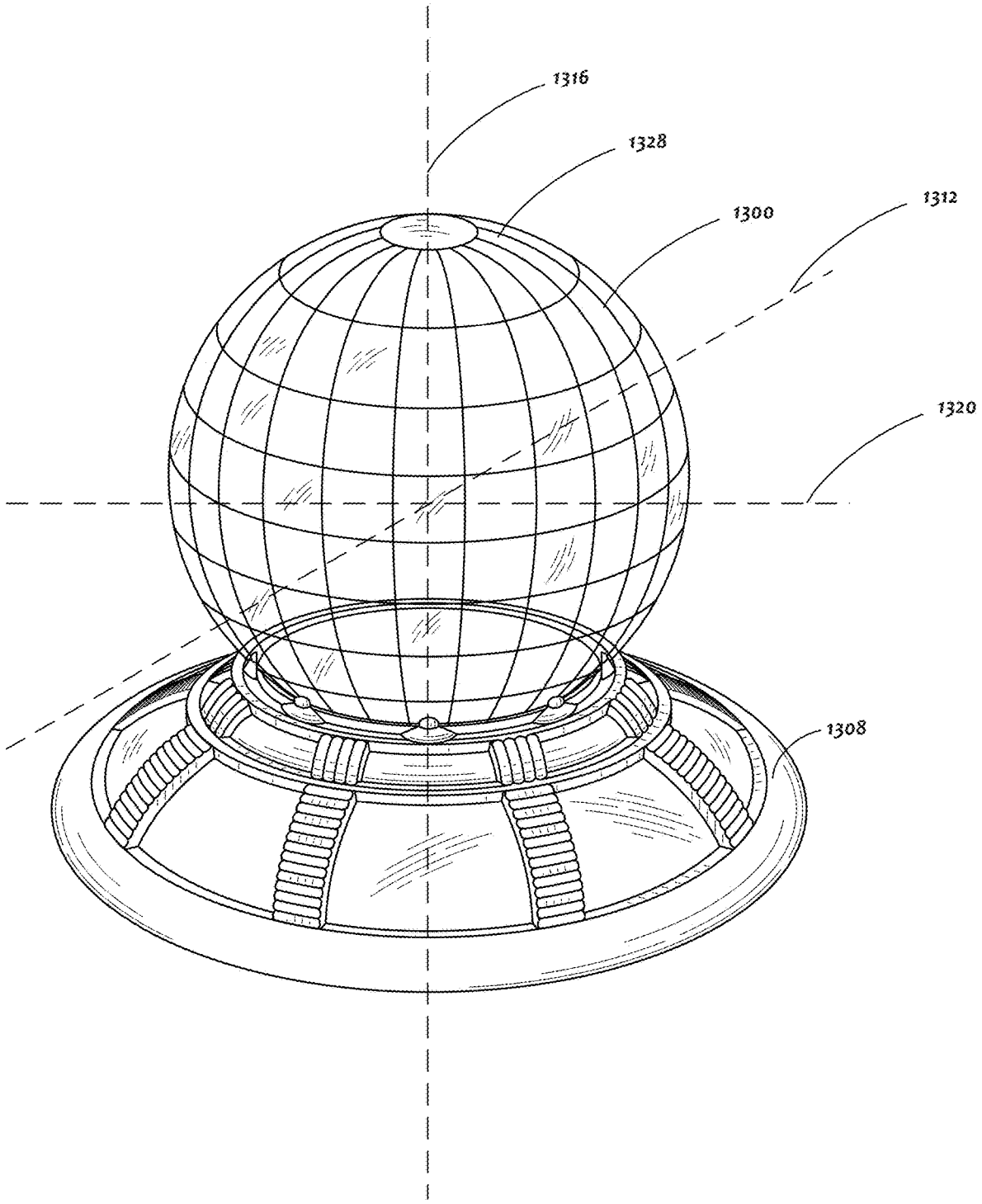
FIGS. 13A, 13B, and 13C illustrate different views of an embodiment of a tenth spinning sphere.
Figure 13B:
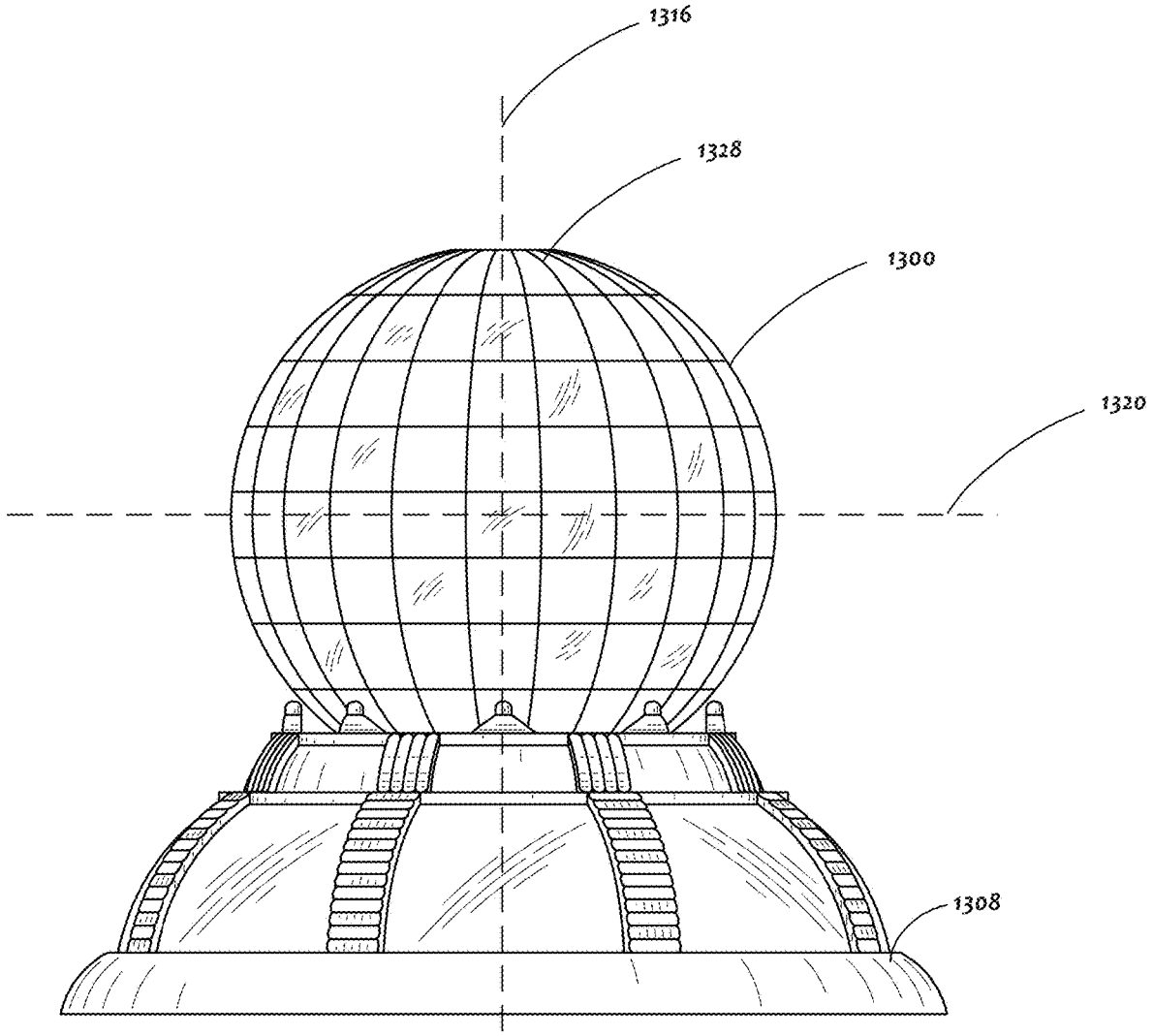
Figure 13C:
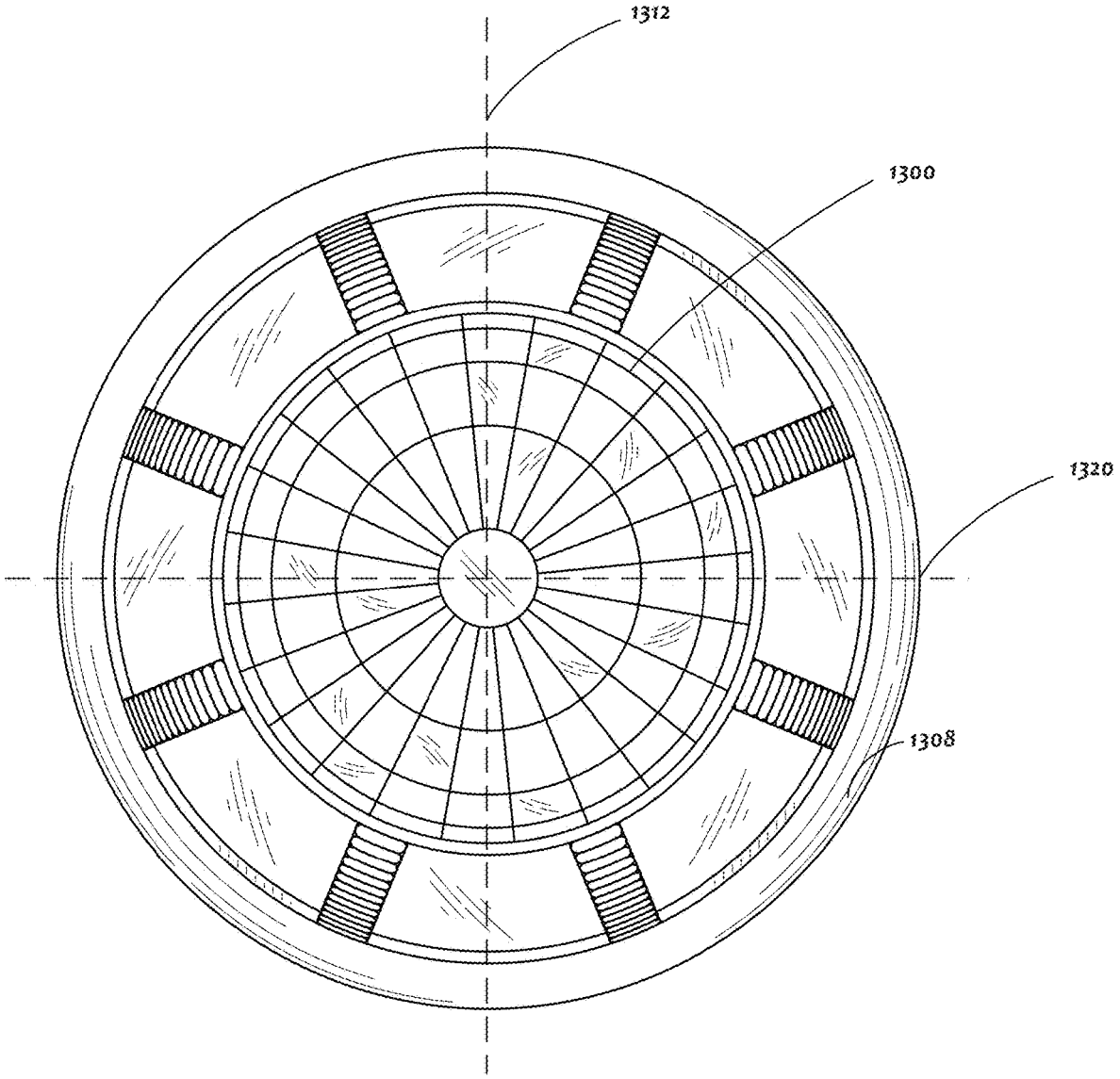

FIGS. 13A, 13B, and 13C illustrate different views of an embodiment of a tenth three-dimensional display device 1300 supported by a tenth base 1308. In some embodiments, the tenth base 1308 may include one or more rotating elements (not shown) such as the rotating elements 1204A, 1204B, 1204C of FIG. 12A. In such embodiments, the tenth spinning sphere 1300 may move, e.g., spin vertically (in relation to horizontal axis 1312), horizontally (in relation to vertical axis 1316), and/or diagonally (in relation to both horizontal axis 1312 and vertical axis 1316). For example, when individually actuated, the tenth spinning sphere 1300 may spin about the vertical axis 1316. Conversely, when individually actuated, the tenth spinning sphere 1300 may spin at least about the horizontal axis 1312. In other embodiments, the tenth base 1308 may include one or more levitation devices (not shown), such as the electrical-driven magnets as described with respect to FIG. 7B. With the levitation devices, the tenth spinning sphere 1300 may also spin vertically (in relation to horizontal axis 1312), horizontally (in relation to vertical axis 1316), and/or diagonally (in relation to both horizontal axis 1312 and vertical axis 1316), and hover over the tenth base 1308 with respect to a levitation axis 1320 by an amount of space.

In some cases, the amount of space is predetermined based on a game being played. The tenth spinning sphere 1300 may also be tilted when a triggering event occurs such that a tenth special wheel 1328 may be viewed by a player. When the special wheel 1328 has been tilted and directly faces the player, the one or more rotating elements may be energized such that the tenth spinning sphere 1300 and thus the tenth special wheel 1328 may rotate to reveal one or more prizes to a player.

Figure 14A:
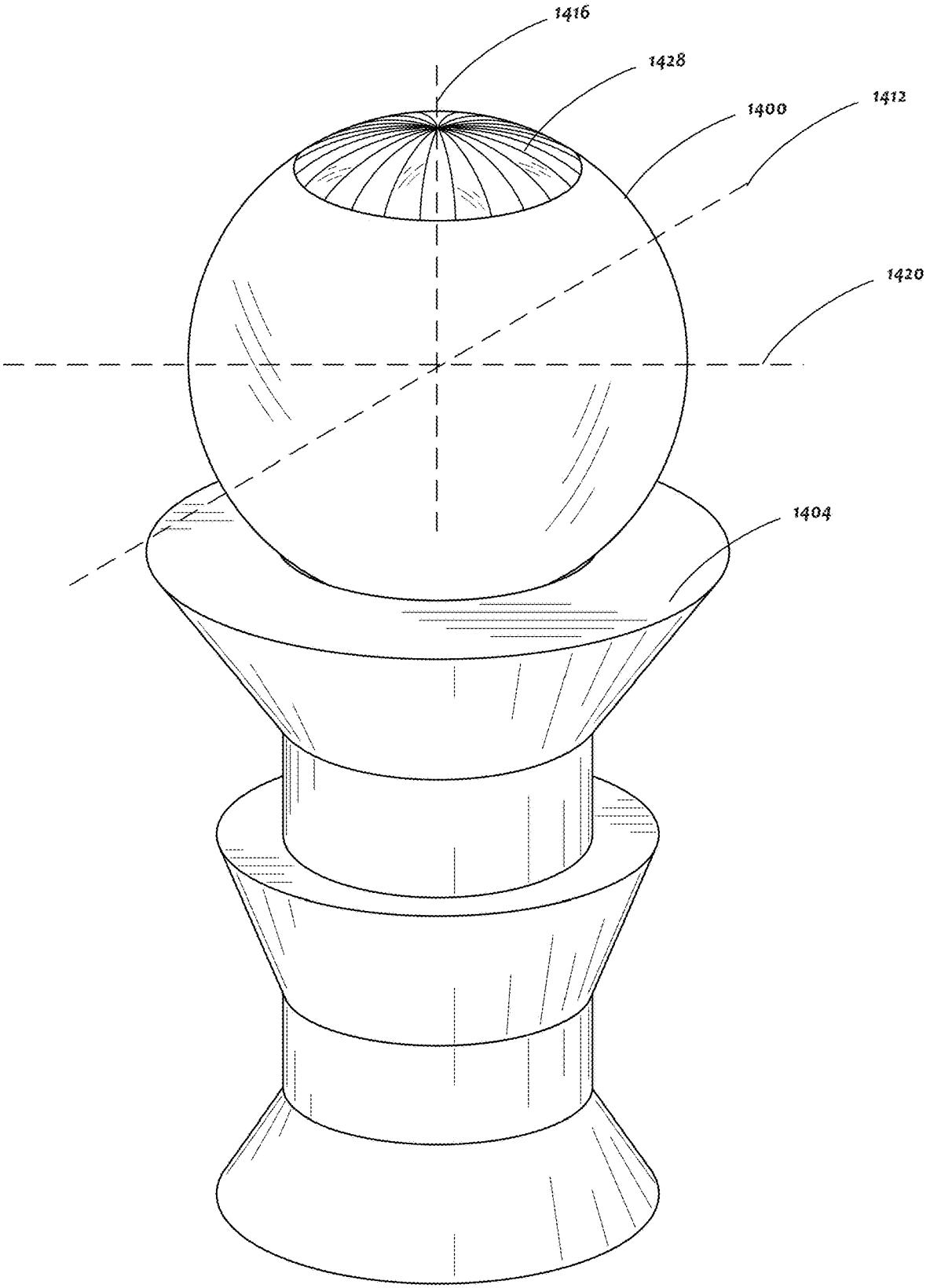
FIGS. 14A, 14B, and 14C illustrate different views of an embodiment of an eleventh spinning sphere.
Figure 14B:
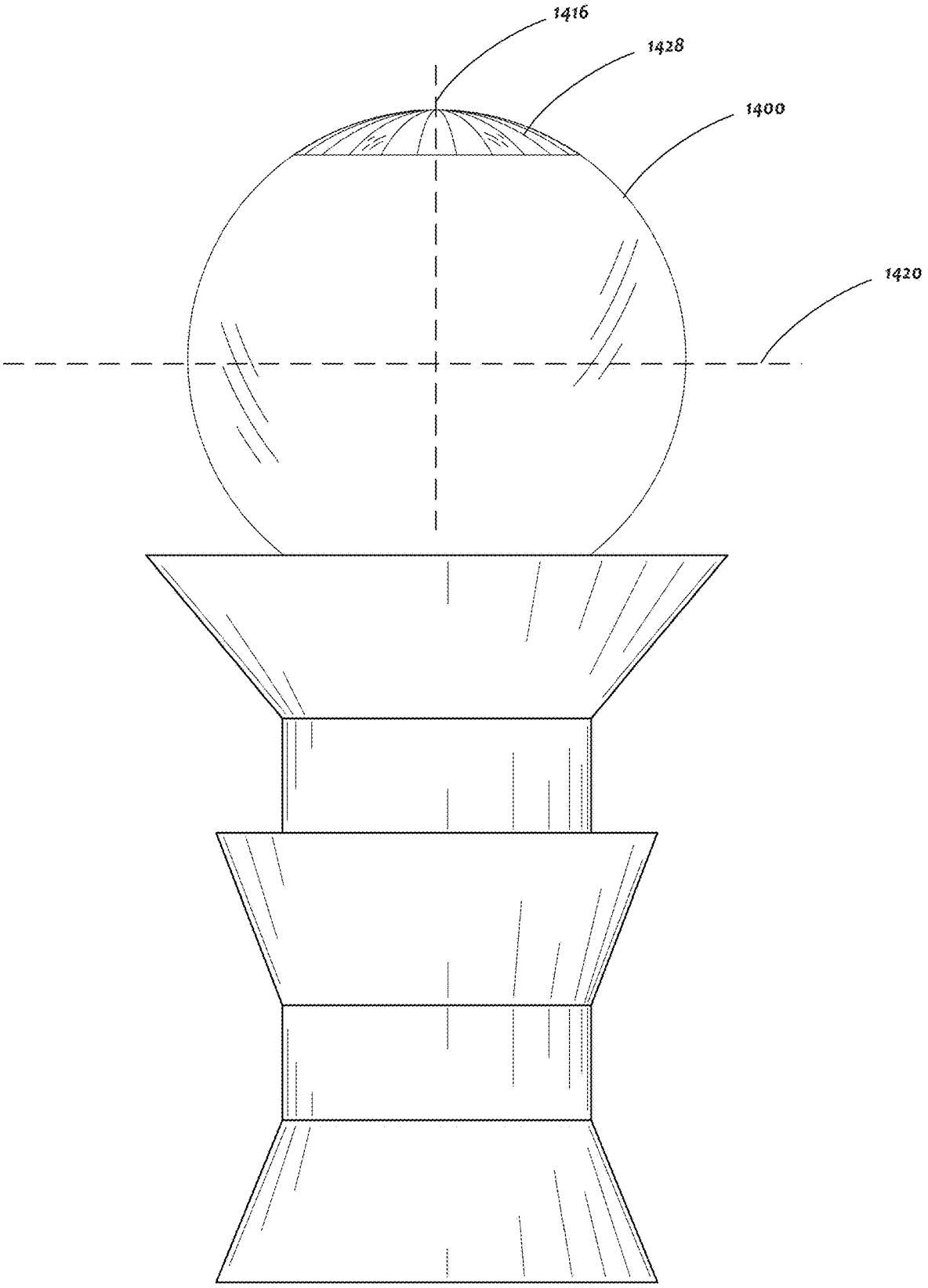
Figure 14C:
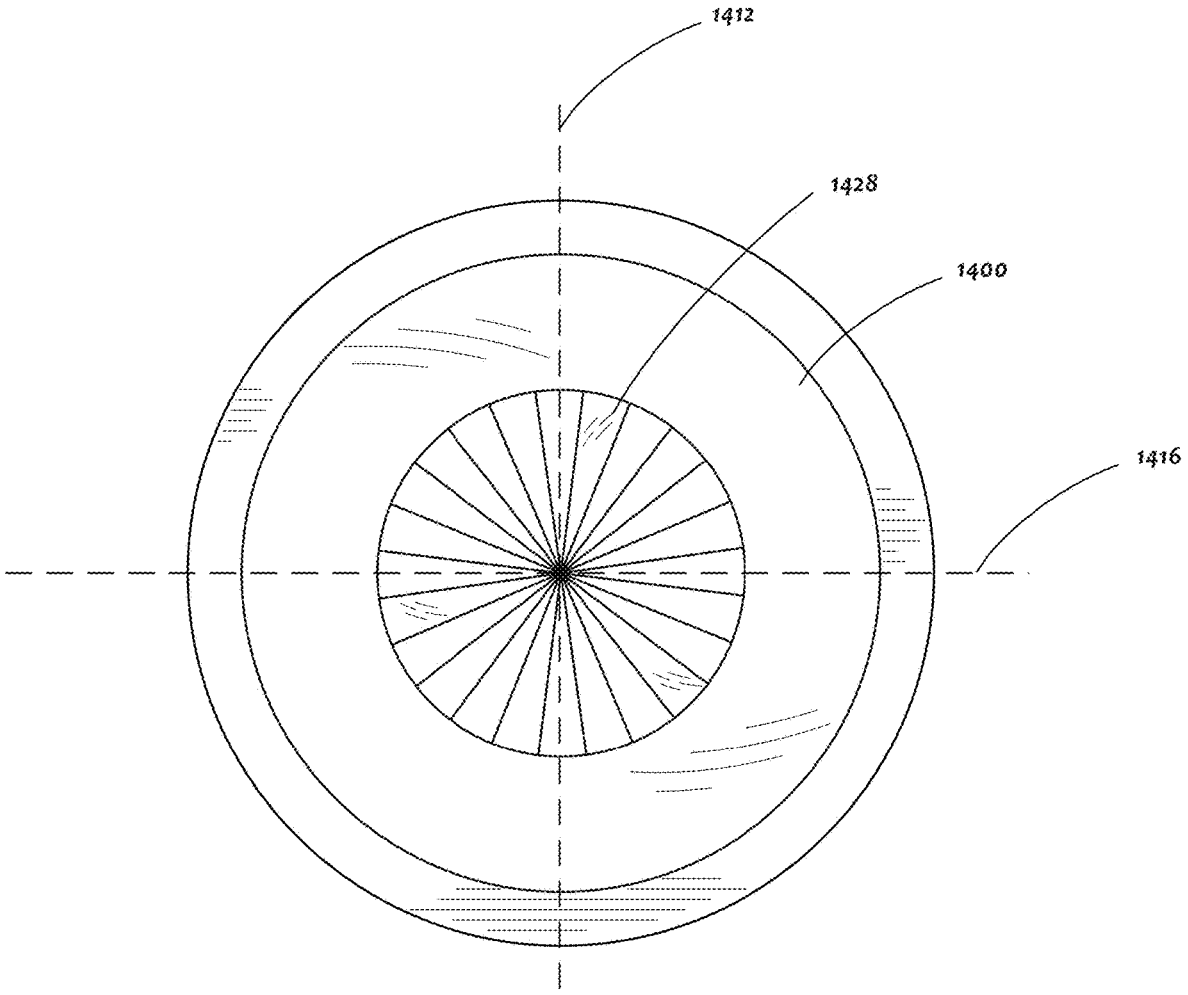

FIGS. 14A, 14B, and 14C illustrate different views of an embodiment of an eleventh three-dimensional display device 1400, similar to the tenth three-dimensional display device 1300 of FIG. 13A. As shown, the eleventh spinning sphere 1400 may be a portion of an overhead signage, and/or a topper for a gaming device. The eleventh spinning sphere 1400 is disposed on a base support 1404 that may include one or more rotating elements (not shown) such as the rotating elements 1204A, 1204B, 1204C of FIG. 12A. In such embodiments, the eleventh spinning sphere 1400 may spin vertically (with respect to horizontal axis 1412), horizontally (with respect to vertical axis 1416), and/or diagonally (with respect to both horizontal axis 1412 and vertical axis 1416). For example, when individually actuated, the eleventh spinning sphere 1400 may spin at least about the vertical axis 1416. Conversely, when individually actuated, the eleventh spinning sphere 1400 may spin about the horizontal axis 1412. In other embodiments, the base support 1404 may include one or more levitation devices (not shown), such as the electrical-driven magnets as described in relation to FIG. 7B. With the levitation devices, the eleventh spinning sphere 1400 may also move, e.g., vertically (in relation to horizontal axis 1412), horizontally (in relation to vertical axis 1416), and/or diagonally (in relation to both horizontal axis 1412 and vertical axis 1416), and hover over the base support 1404 with respect to a levitation axis 1420 by an amount of space that may be predetermined based on a game being played. The eleventh spinning sphere 1400 may also be tilted when a triggering event occurs such that an eleventh special wheel 1428 may be viewed by a player. When the eleventh special wheel 1428 has been tilted and directly faces the player, the one or more rotating elements may be energized such that the eleventh spinning sphere 1400 and thus the eleventh special wheel 1428 may rotate to reveal one or more prizes to a player.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming device comprising:

a first display device operable to present a game;

an activation structure;

a three-dimensional second display device positioned relative to the first display device and the activation structure; and a game controller having at least one processor and a memory storing a set of symbols and at least a sequence of instructions, which, when executed, cause the at least one processor to at least:

levitate the three-dimensional second display device relative to the first display device and the activation structure, move, in response to a signal from a sensing module, the three-dimensional second display device in relation to at least one of a plurality of axes, and display game information on the three-dimensional second display device.

2. The electronic gaming device of claim 1, wherein the three-dimensional second display device is a three-dimensional shape with at least one viewing surface, and wherein the sequence of instructions, when executed, further causes the at least one processor to levitate, in response to a trigger in the game, the three-dimensional second display device via air jet controls.

3. The electronic gaming device of claim 1, wherein the activation structure comprises a plurality of electrical coils, the three-dimensional second display device includes a plurality of magnets therein, and the sequence of instructions, when executed, further causes the at least one processor to energize one or more of the plurality of electrical coils to rotate, tilt, or levitate the three-dimensional second display device vertically, diagonally, horizontally, or randomly, with respect to the plurality of axes.

4. The electronic gaming device of claim 3, wherein the sequence of instructions, when executed, further causes the at least one processor to energize one or more of the plurality of electrical coils to levitate the three-dimensional second display device above the activation structure.

5. The electronic gaming device of claim 1, wherein the activation structure comprises one or more actuating arms holding the three-dimensional second display device in place with respect to the activation structure, and the sequence of instructions, when executed, further causes the at least one processor to individually control each of the one or more actuating arms to rotate, tilt, or levitate the three-dimensional second display device vertically, diagonally, horizontally, or randomly, with respect to the plurality of axes.

6. The electronic gaming device of claim 1, wherein the activation structure comprises one or more motors and a plurality of rotating elements, and the sequence of instructions, when executed, further causes the at least one processor to individually actuate each of the one or more motors and the plurality of rotating elements to rotate or tilt the three-dimensional second display device vertically, diagonally, horizontally, or randomly, with respect to the plurality of axes.

7. The electronic gaming device of claim 1, further comprising the sequence of instructions, when executed, further causes the at least one processor to select a plurality of symbols from the set of symbols, based on one or more random numbers generated by a random number generator, display at a plurality of symbol positions on the three-dimensional second display device, and determine an outcome based on the plurality of symbols displayed at the plurality of symbol positions.

8. An electronic gaming system comprising:

a plurality of electronic gaming machines comprising a first display device and an input device;

a three-dimensional second display device; and an activation structure, the activation structure and at least one of the plurality of electronic gaming machines operable, by at least one processor and a memory storing at least a sequence of instructions, which, when executed, cause the at least one processor, to at least:

levitate the three-dimensional second display device relative to the activation structure, move the three-dimensional second display device in relation to at least one of a plurality of axes, and display game information on the three-dimensional second display device.

9. The electronic gaming system of claim 8, wherein the sequence of instructions, when executed, further causes the at least one processor to move the three-dimensional second display device in response to an input at the input device.

10. The electronic gaming system of claim 8, wherein the sequence of instructions, when executed, further causes the at least one processor to levitate the three-dimensional second display device in response to a signal from a sensing module.

11. The electronic gaming system of claim 10, wherein the sensing module is operable to sense and generate the signal in response to one or more conditions: a proximity of the three-dimensional second display device from at least one of the plurality of electronic gaming machines, a body condition, a body movement, or a symbol being displayed at one or more of a plurality of symbol positions.

12. The electronic gaming system of claim 8, wherein the activation structure further comprises a plurality of electrical coils, the three-dimensional second display device includes a plurality of magnets therein, and the sequence of instructions, when executed, further causes the at least one processor to energize one or more of the plurality of electrical coils to rotate, tilt, or levitate the three-dimensional second display device vertically, diagonally, horizontally, or randomly, with respect to the plurality of axes.

13. The electronic gaming system of claim 8, wherein the three-dimensional second display device is translucent, and further comprising controlling the three-dimensional second display device to display a plurality of symbols from a set of symbols, based on one or more random numbers generated by a random number generator, at a plurality of symbol positions on the three-dimensional second display device.

14. A non-transitory computer-readable medium for conducting a game on an electronic gaming system that comprises a) an activation structure, b) a plurality of game devices, each of the plurality of game devices comprising a first display device operable to present at least a portion of the game, c) a three-dimensional second display device disposed relative to the activation structure and defining a plurality of axes, d) a sensor module and e) a game server having at least one processor and a memory storing a set of symbols and at least a sequence of instructions, which, when executed, cause the at least one processor, in response to a signal from the sensor module, to perform the steps of:

levitating the three-dimensional second display device above the activation structure;

rotating the three-dimensional second display device in relation to at least one of the plurality of axes; and displaying game information on the three-dimensional second display device.

15. The non-transitory computer-readable medium of claim 14, wherein the three-dimensional second display device is a three-dimensional shape with at least one viewing surface, and wherein the sequence of instructions, when executed, further causes the at least one processor to levitate, in response to a trigger in the game, the three-dimensional second display device via air jet controls.

16. The non-transitory computer-readable medium of claim 14, wherein the activation structure comprises one or more motors and a plurality of rotating elements, and wherein the sequence of instructions, when executed, further causes the at least one processor to perform the step of individually actuating each of the one or more motors and the plurality of rotating elements to rotate or tilt the three-dimensional second display device vertically, diagonally, horizontally, or randomly, with respect to the plurality of axes.

17. The non-transitory computer-readable medium of claim 16, wherein the activation structure further comprises a plurality of electrical coils, the three-dimensional second display device further comprises a plurality of magnets therein, and the sequence of instructions, when executed, further causes the at least one processor to perform the step of energizing one or more of the plurality of electrical coils to rotate or tilt the three-dimensional second display device vertically, diagonally, horizontally, or randomly, with respect to the plurality of axes.

18. The non-transitory computer-readable medium of claim 17, wherein the sequence of instructions, when executed, further causes the at least one processor to perform the step of energizing one or more of the plurality of electrical coils to levitate the three-dimensional second display device above the activation structure.

19. The non-transitory computer-readable medium of claim 14, wherein the activation structure further comprises one or more actuating arms operable to levitate the three-dimensional second display device, and further comprising the sequence of instructions, when executed, further causes the at least one processor to perform the step of independently controlling each of one or more actuating arms to rotate, tilt, or levitate the three-dimensional second display device vertically, diagonally, horizontally, or randomly, with respect to the plurality of axes.

20. The non-transitory computer-readable medium of claim 14, wherein the three-dimensional second display device is transparent, and further comprising controlling the three-dimensional second display device to display a plurality of symbols selected from the set of symbols, based on one or more random numbers generated by a random number generator, at a plurality of symbol positions on the three-dimensional second display device.

* * * * *